US006324351B1

(12) United States Patent
Kurimoto et al.

(10) Patent No.: US 6,324,351 B1
(45) Date of Patent: Nov. 27, 2001

(54) IMAGE-FORMING APPARATUS UNIT AND IMAGE-FORMING APPARATUS

(75) Inventors: Atsushi Kurimoto, Nara; Syouichi Fujita, Kashiba; Hirofumi Sakita, Tenri; Hideji Saiko, Kitakatsuragi-gun, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/469,079

(22) Filed: Dec. 21, 1999

(30) Foreign Application Priority Data

Dec. 22, 1998 (JP) ..... 10-364207

(51) Int. Cl.[7] ..... G03G 15/00
(52) U.S. Cl. ..... 399/12; 399/13
(58) Field of Search ..... 399/12, 13, 27, 399/90, 111, 119, 1, 411; 358/296

(56) References Cited

U.S. PATENT DOCUMENTS 5,600,445 * 2/1997 Omi ..... 358/296
5,930,553 * 7/1999 Hirst et al. ..... 399/8
6,019,461 * 2/2000 Yoshimura et al. ..... 347/86

FOREIGN PATENT DOCUMENTS 4-1682 1/1992 (JP) .
7-121016 5/1995 (JP) .

* cited by examiner

*Primary Examiner*—William J. Royer
(74) *Attorney, Agent, or Firm*—Dike, Bronstein, Roberts & Cushman IP Group; David G. Conlin; David A. Tucker

(57) ABSTRACT

In an image-forming section, a communication device is attached to the top surface of a developing cartridge that is detachably attached to a developing device, and a main body side communication device is attached to a copying machine main body in a manner so as to face the top portion of the communication device. When a loading operation of the developing cartridge to the copying machine main body is carried out, the main body side communication device detects this operation, and sends an electric wave for an electrical supply to the developing cartridge. The communication device transmits individual information of the developing cartridge by means of radio waves, and the main body side communication device receives, demodulates and reads this information. Based upon the results thereof, it makes a judgment as to conformity and suitability of the developing cartridge, and displays the results of the judgement or gives a warning as to the results. Thus, it becomes possible to prevent an erroneous insertion of any unit to the image-forming apparatus main body by using a method with high reliability at low costs. It is possible to provide not only the developer supplying container, but also image-forming apparatus units serving as various units related to image-forming processes and an image-forming apparatus using such units.

44 Claims, 47 Drawing Sheets

IMAGE-FORMING APPARATUS UNIT AND IMAGE-FORMING APPARATUS

FIELD OF THE INVENTION

The present invention relates to an image-forming apparatus unit such as a developing device, used in an image-forming apparatus such as a copying machine, a facsimile, and a printer, and an image-forming apparatus, and more specifically, concerns an image-forming apparatus unit which can communicate with the image-forming apparatus on information related to the unit itself, and the image-forming apparatus provided with such a unit.

BACKGROUND OF THE INVENTION

Conventionally, the image-forming apparatus of the electrophotographic system is generally provided with a developing device which has a plurality of developing members containing predetermined developers, placed face to face with an image-bearing body, and developer supplying containers installed in toner supplying sections corresponding to the respective developing members so as to supply developers to the respective developing members, and which visualizes an electrostatic latent image formed on the image-bearing body.

With respect to misinsertion preventing mechanisms used at the time of loading a toner cartridge to the toner supplying section of such a developing device as a developer supplying container, for example, Japanese Laid-Open Patent Application No. 1682/1992 (Tokukaihei 4-1682, published Jan. 7, 1992) has proposed such a mechanism. In this mechanism, a bar code reader, attached to the toner supplying section as an information reading means, reads bar code information placed on the toner cartridge, and based upon the results of the reading operation, a judgment is made as to whether or not the toner cartridge to be inserted is a suitable one; thus, based upon the results of the judgment, a misinsertion preventing shutter is operated so as to prevent misinsertion of the toner cartridge.

Moreover, there is another well-known method in which, when a developer supplying container having an information storage medium such as an non-volatile memory is inserted to the toner supplying section of a developing device, an electric circuit is formed between the developing member and the developer supplying container. In this method, information possessed by the developer supplying container is applied to the developing member side or the apparatus main body side, and based upon the results of the judgment, misinsertion is prevented.

However, when the misinsertion preventing mechanism of the toner cartridge disclosed in the above-mentioned Japanese Laid-Open Patent Publication No. 1682/1992 (Tokukaihei 4-1682) is adopted, a bar code needs to be placed on each toner cartridge and an information reading means such as a bar code reader needs to be attached to each toner supplying section, resulting in an increase in costs.

Moreover, since the bar code placed on the toner cartridge is located in the vicinity of developers and toners, it tends to be contaminated, and the optical information reading means such as a bar code reader is also susceptible to developer and toner contamination, thereby causing problems such as errors in reading the bar code.

Similarly, in the above-mentioned method in which the electric circuit is formed between the developing member and the developer supplying container provided with an information storage medium such as a non-volatile memory so as to transmit and receive the information possessed by the developer supplying container by means of electric signals, the contacts tend to be contaminated by toners and developers closely located, resulting in problems such as malcontact and abrasion.

SUMMARY OF THE INVENTION

The present invention has been devised so as to solve the above-mentioned conventional problems, and its objective is to provide an image-forming apparatus unit serving not only as a developer supplying container but also as one of various units related to image-forming processes, which can prevent an erroneous insertion to an image-forming apparatus main body by using an inexpensive method with high reliability, and also to provide an image-forming apparatus using such an image-forming apparatus unit.

The image-forming apparatus unit of the present invention, which is detachably attached to a predetermined portion of the main body of an image-forming apparatus, is provided with a communication means which transmits individual information that is information related to the unit itself to a main body side communication means installed in the main body of the image-forming apparatus by means of electric waves, following the loading operation of the image-forming apparatus unit to the predetermined portion.

With the above-mentioned arrangement, the image-forming apparatus unit has a communication means, and the communication means carries out transmission by using electric waves so that it can transmit the individual information related to the unit itself to the main body side communication means installed in the main body of the image-forming apparatus by means of radio waves. Here, the transmission is carried out following the loading operation of the image-forming apparatus unit to the predetermined portion; therefore, the individual information of the image-forming apparatus unit itself to be inserted is transmitted to the main body side communication means installed in the image-forming apparatus main body.

Thus, the image-forming apparatus is allowed to make a judgment as to whether or not the image-forming apparatus unit to be inserted is suitable for the loading operation based upon the received individual information.

Here, since only one main body side communication means needs to be installed, and since, different from the conventional system, bar code readers need not be installed for the individual toner supply sections, it becomes possible to reduce costs.

Moreover, since the communication is carried out by radio waves, no adverse effect is given to the communication even if the image-forming apparatus units and/or the image-forming apparatus are contaminated by toner, etc., and since the communication is automatically started at the time of attaching any of the copying machine units to the copying machine main body, no complex operation is required for carrying out the communication.

Furthermore, since the communication is made in a non-contact state, limitations in an installation method due to the necessity for constructing an electrical circuit between the image-forming apparatus unit and the main body of the image-forming apparatus are no longer imposed, and the directivity of communication is widened as compared with the bar-code reading, thereby making it possible to improve the degree of freedom in designing the installation mode. The resulting simple construction of the image-forming apparatus reduces a space required and the resulting elimination of terminals (connectors) makes it possible to improve the durability.

Therefore, it is possible to provide an image-forming apparatus unit which can prevent an erroneous insertion to the image-forming apparatus main body by using an inexpensive method with high reliability.

The image-forming apparatus of the present invention is provided with: a predetermined portion to which an image-forming apparatus unit for carrying out an image forming process is detachably attached; a detection means for detecting an loading operation of the image-forming apparatus unit; a main body side communication means which, upon detection by the detection means, receives individual information that is information related to the image-forming apparatus unit by means of electric waves; and judgment means which makes a judgment on the individual information based upon a predetermined standard, and outputs the results of the judgement.

In accordance with the above-mentioned arrangement, in the image-forming apparatus, when the loading operation of an image-forming apparatus unit is carried out, the detection means detects this operation. Next, following the detection, the main body side communication means (reception means) receives the individual information transmitted from the communication means of the image-forming apparatus unit through electric waves.

Therefore, since the reception is carried out following the loading operation of the image-forming apparatus unit to the predetermined portion, the individual information of the image-forming apparatus unit itself to be inserted can be transmitted to the main body side communication means installed in the image-forming apparatus main body. Moreover, since the reception is carried out following the loading operation to the predetermined portion, the communication is automatically started at the time of attaching the copying machine unit to the copying machine main body; thus, no complex operation is required for carrying out the communication.

The above-mentioned judgment means can make a judgment as to whether or not the image-forming apparatus unit to be inserted is suitable for the loading operation based upon the received individual information.

In other words, the above-mentioned judgment means makes a judgment on the individual information based upon the predetermined standard relating to conformity indicating whether or not a position to which the image-forming apparatus unit has been attached conforms to the predetermined position of the image-forming apparatus and to suitability indicating whether or not the image-forming apparatus unit attached to the predetermined position is an appropriate one, and outputs the results of the judgment. Therefore, this arrangement allows the user to easily confirm the suitability of an image-forming apparatus unit that has been attached, thereby making it possible to prevent the image-forming apparatus unit from being erroneously attached to the image-forming apparatus.

Here, since only one main body side communication means needs to be installed, and since, different from the conventional system, bar code readers need not be installed for the individual toner supply sections, it becomes possible to reduce costs.

Moreover, since the communication is carried out by radio waves, no adverse effect is given to the communication even if the image-forming apparatus units and/or the image-forming apparatus are contaminated by toner, etc., and since the communication is automatically started at the time of attaching any of the copying machine units to the copying machine main body, no complex operation is required for carrying out the communication.

Furthermore, since the communication is made in a non-contact state, limitations in an installation method due to the necessity for constructing an electrical circuit between the image-forming apparatus unit and the main body of the image-forming apparatus are no longer imposed, thereby making it possible to improve the degree of freedom in designing the installation mode. The resulting simple construction of the image-forming apparatus reduces a space required and the resulting elimination of terminals (connectors) makes it possible to improve the durability.

For a fuller understanding of the nature and advantages of the invention, reference should be made to the ensuing detailed description taken in conjunction with the accompanying drawings.

DESCRIPTION OF THE EMBODIMENTS

[Embodiment 1]

Referring to FIGS. 1 through 42, the following description will discuss one embodiment of an image-forming apparatus unit and an image-forming apparatus provided with such a unit in accordance with the present invention.

Figure 1:
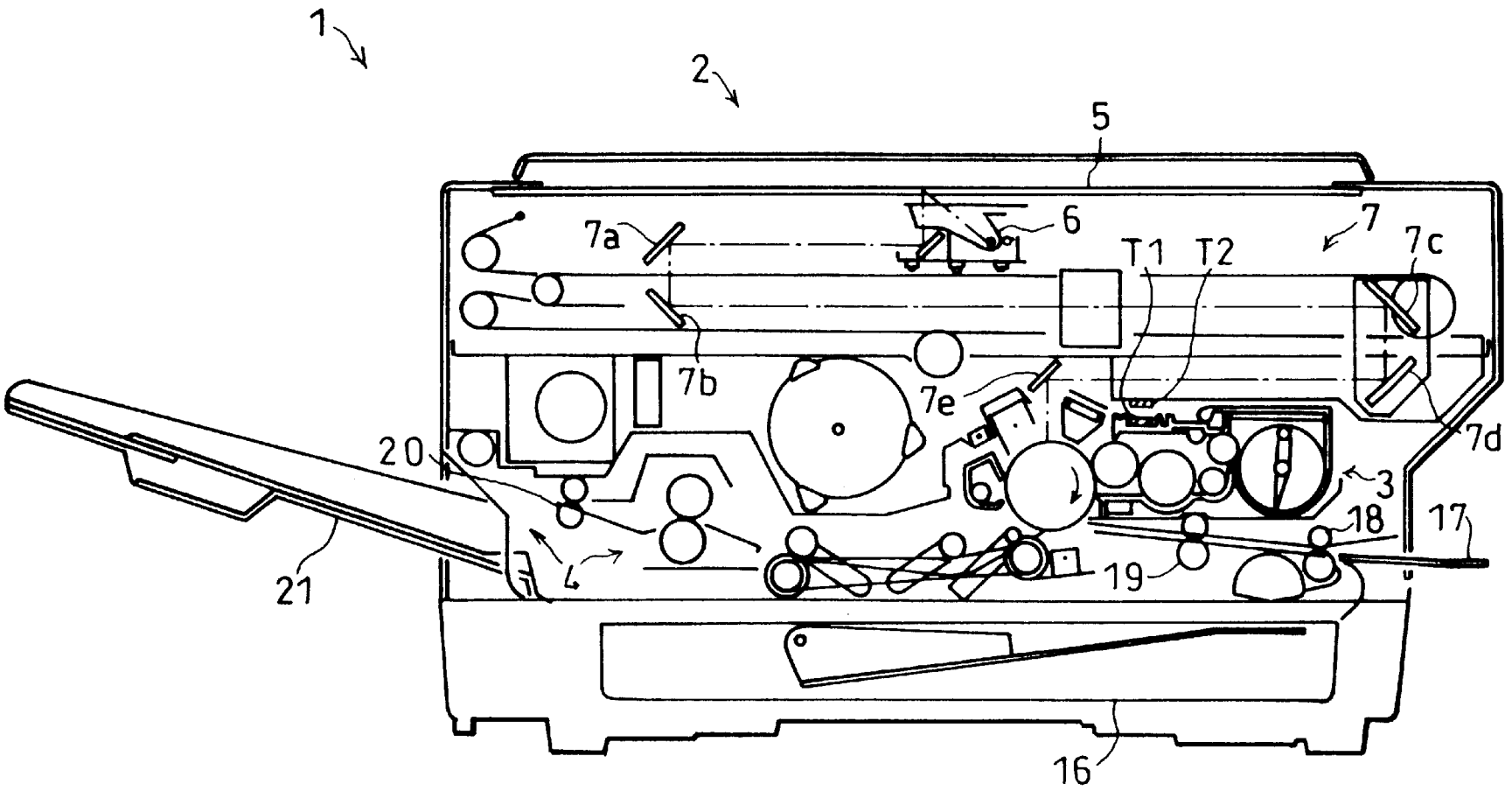
FIG. 1 is a cross-sectional view showing a construction of an image-forming apparatus unit and an image-forming apparatus of one embodiment in accordance with the present invention.

FIG. 1 shows a copying machine 1 that serves as the image-forming apparatus of the present embodiment. The copying machine 1 is mainly constituted by a document reading section 2, an image-forming section 3, and a transport section 4.

The document reading section 2 is constituted by a document platen 5 and a scanner 6, and an image of an original document is read by scanning the original document placed on the document platen 5. Upon reading the image, light reflected from the original document is directed to a photoreceptor 8, which will be described later, through reflection mirrors 7*a,* 7*b,* 7*c,* 7*d* and 7*e* that constitute an exposure device 7, which will be described later.

Figure 2:
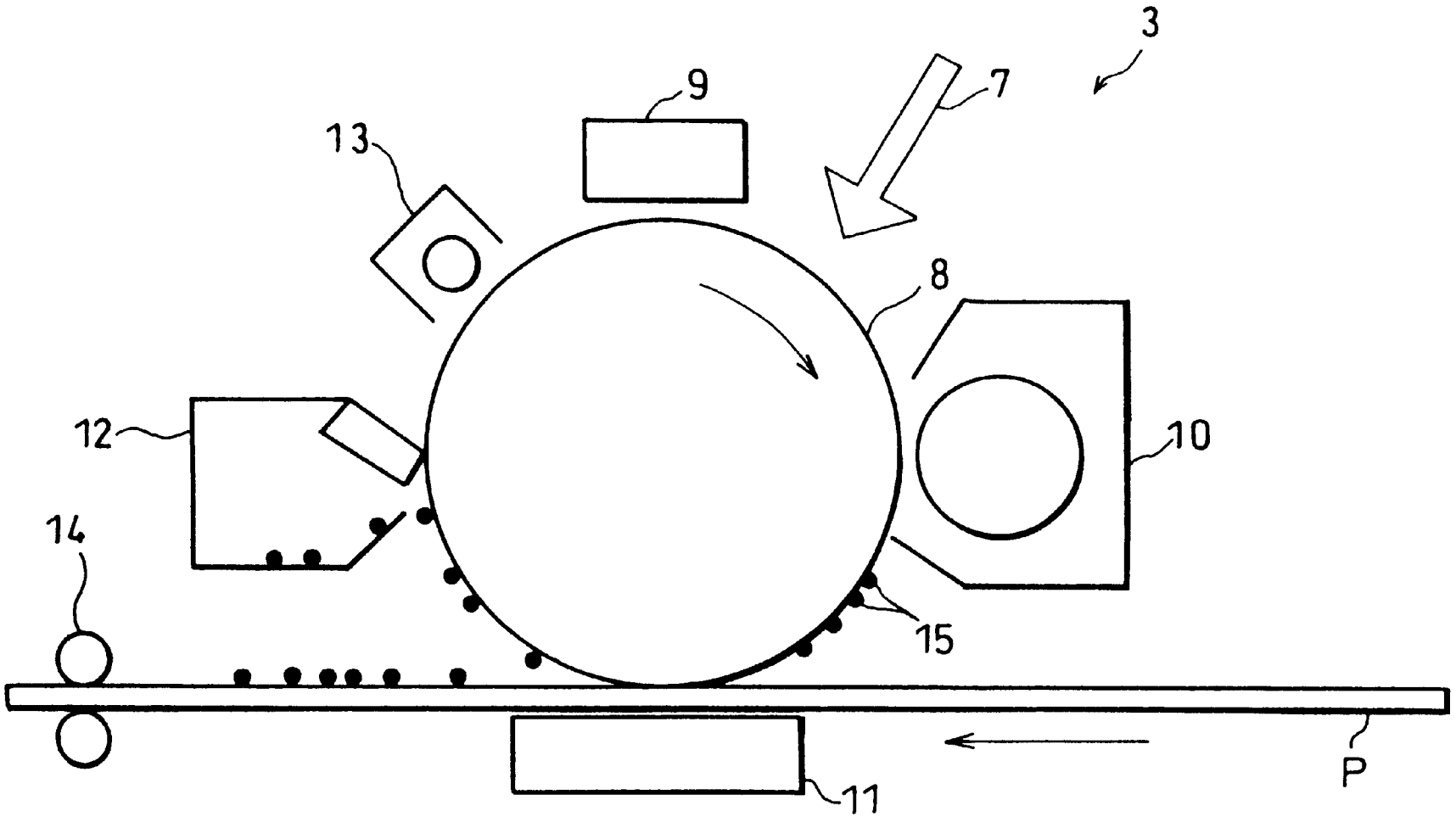
FIG. 2 is a cross-sectional view showing a construction of an image-forming section of the image-forming apparatus of FIG. 1.

As illustrated in FIG. 2, the image-forming section 3 is constituted by an exposure device 7, a photoreceptor 8, a charging device 9, a developing device 10, a transfer device 11, a cleaning device 12, a static eliminating device 13, and a fixing device 14. The image-forming section 3 carries out an electrophotographing process as follows: First, the surface of the photoreceptor 8 serving as an electrostatic latent image bearing body is charged by the charging device 9 so as to apply a charge thereto. Next, the exposure device (the reflection mirrors 7*a,* 7*b,* 7*c,* 7*d* and 7*e*) 7, which is a latent image forming means, is used to expose the surface of the photoreceptor 8 so as to form an electrostatic latent image. Then, the electrostatic latent image is developed by applying toner 15 that is a developing agent onto the photoreceptor 8 using developing device 10 so that the electrostatic latent image is visualized as a toner image.

Figure 3:
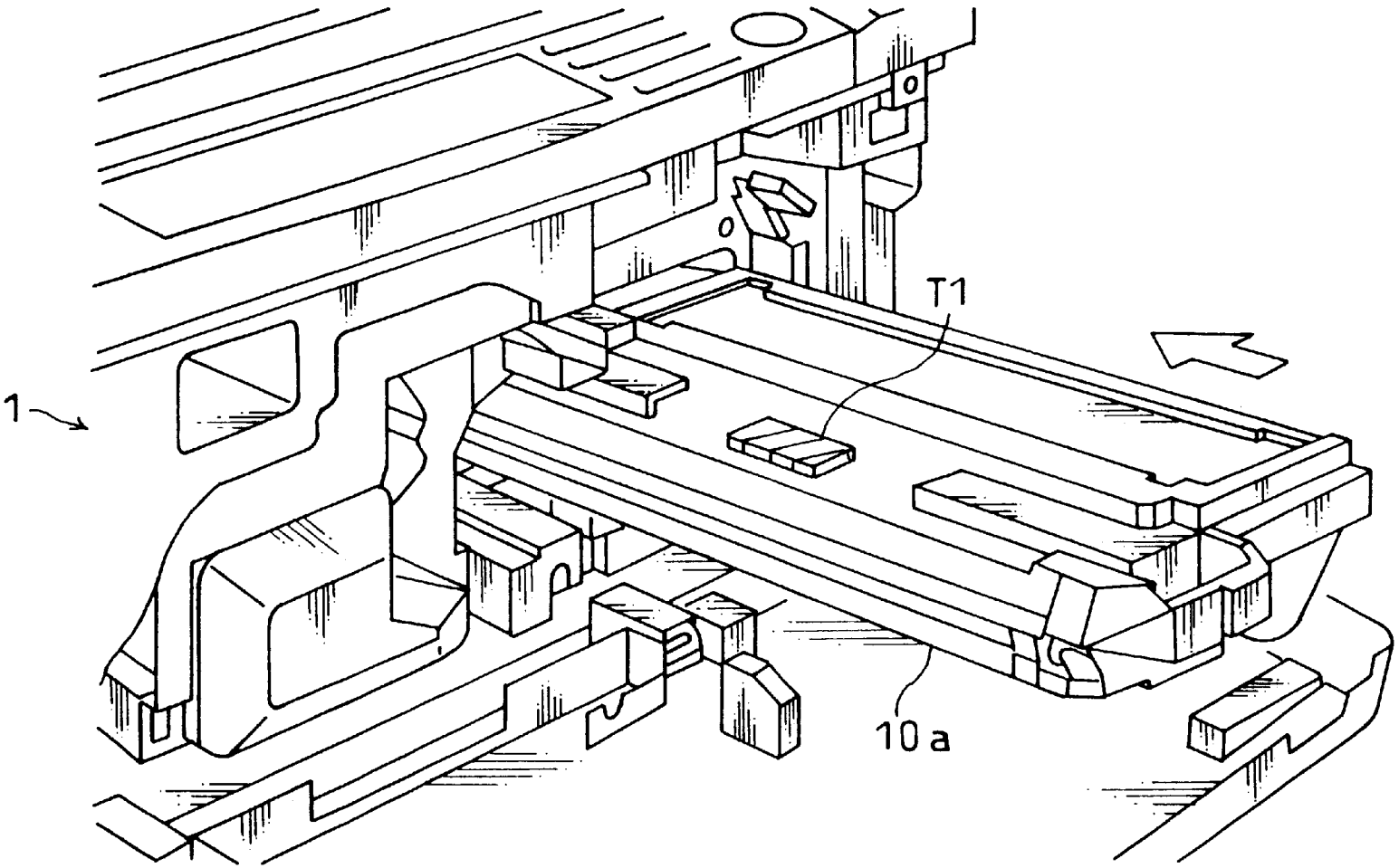
FIG. 3 is an explanatory drawing that shows a state in which a developing cartridge, provided as one example of the image-forming apparatus unit of FIG. 1, is attached to an image-forming apparatus main body.

As illustrated in FIG. 3, a developing cartridge 10*a* for supplying toner 15 to the developing device 10 is detachably attached to a toner supply section of the developing device 10. Moreover, as illustrated in the same Figure, a communication device (communication means) T1, which will be described later, is attached to a developing cartridge 10*a* so as to communicate with a main body side communication device (main body side communication means) T2 installed on the main body side of a copying machine. The toner image is transferred on copying paper (copying material) P by the transfer device 11, and further fixed by the fixing device 14.

Toner 15 remaining on the photoreceptor 8 is scraped off by the cleaning device 12 and collected therein as waste toner. Even if the remaining toner has been removed, a slight charge still remains on the photoreceptor 8; therefore, this is static-eliminated by a static eliminating device 13. Upon completion of the static eliminating process, the surface of the photoreceptor 8 is allowed to return to its initial level, and set ready for the next new copying cycle.

The transport section 4 transports copying paper P from a paper feed tray 16 or a manual feed tray 17 to the image-forming section 3 by using a paper feed roller 18 and a PS roller 19, and also ejects the copying paper P that has been subjected to the image-forming processes onto a paper discharge tray 21 by using a paper discharge roller 20.

In the above-mentioned example, the developing cartridge 10*a* is used as the image-forming apparatus unit; however, the present invention is not intended to be limited by this, and the following devices etc. that can be detachably attached to the copying machine main body correspond to image-forming apparatus units (hereinafter, referred to as copying machine units) as will be respectively referred to in the present embodiments. Those devices etc. in the copying machine 1 having the above-mentioned construction include: a scanner (document reading optical unit) 6, a photoreceptor (photoreceptor unit) 8, a charging device (photoreceptor charging unit ) 9, an exposure device (photoreceptor exposure unit) 7, a developing device (developing unit) 10, a transfer device (transfer unit) 11, a cleaning device (photoreceptor cleaning unit) 12, a static eliminating device (photoreceptor static eliminating unit) 13, a fixing device (fixing unit) 14, a toner bottle (developing agent supply container), which is temporarily attached at the time of maintenance, and process units, each having not less than two of the respective units of the image-forming section in a composite manner.

Figure 4:
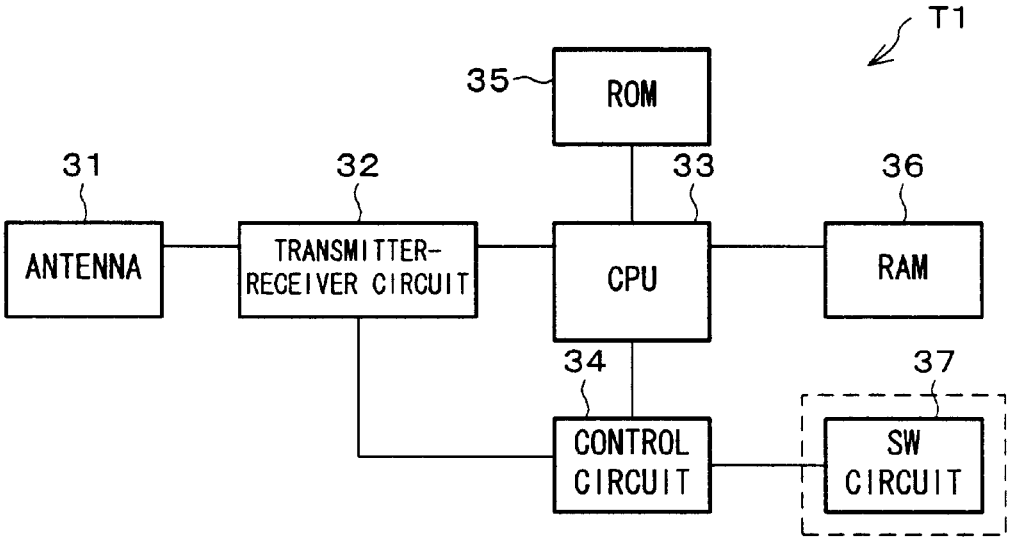
FIG. 4 is a block diagram showing a construction of a communication device of the image-forming apparatus unit of FIG. 1.

As illustrated in FIG. 4, the communication device T1 of the copying machine unit is constituted by an antenna (communication means) 31, a reception and transmission circuit (communication means) 32, a CPU 33, a control circuit 34, a ROM 35, and a RAM (storage means) 36*a* provided with a ferroelectric memory (FRAM), etc.

Figure 5:
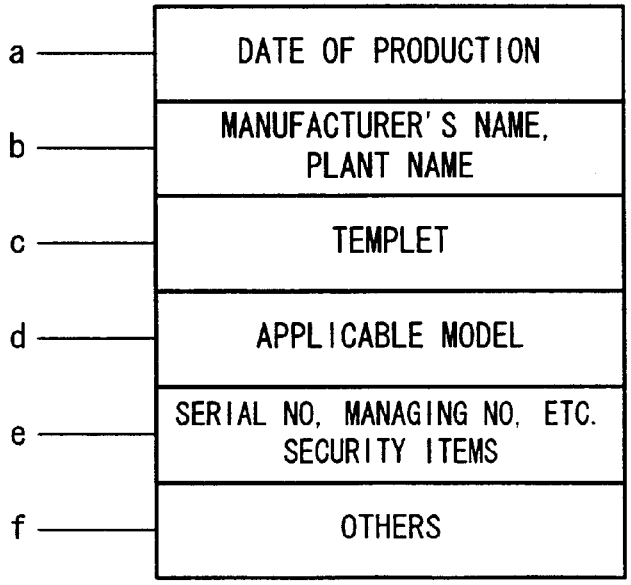
FIG. 5 is an explanatory drawing that shows a memory map stored in a RAM in the communication device of FIG. 4.

The RAM 36 stores individual information related to each of copying machine units themselves. For example, as illustrated in FIG. 5, RAM 36 has a memory map including: region a indicating the date of packing; region b indicating a manufacturing company name and a manufacturing plant name; region c indicating a serial number; region d indicating applicable model numbers; region e indicating security matters such as a production number and a management number, and region f indicating other necessary information on demand.

The ferroelectric memory, which is a non-volatile memory, is superior in the maintaining property of individual information of each of the copying machine units, and enables higher-speed re-writing as compared with conventional non-volatile memories such as EEPROMs and flash memories, thereby greatly reducing the load imposed on the controlling CPU 33. Moreover, its low power consumption makes it possible to reduce running costs, and its superior re-writing durability of not less than 1 trillion times ensures long service life.

The control circuit 34 reads out necessary information from the memory map in the RAM 36, and transmits it from the transmitter-receiver circuit 32. Upon transmission of individual pieces of information, these are continuously transmitted after the start of transmission; thus, it is possible to simplify the control of the transmission since the transmission is carried out by using a continual signal. In contrast, in the case of intermittent transmission of the individual pieces of information, it is possible to reduce power consumption since the transmission is carried out by using an intermittent signal. With respect to the selection of these transmission modes, the user can freely decide desirably. Moreover, the transmitter-receiver circuit 32 also has a function for receiving electric waves for electrical supply from a main body side communication device T2, which will be described later. In the present invention, the electric wave refers to an electromagnetic wave having a frequency not more than 3000 GHz.

The CPU 33 provides control for executing programs stored in the ROM 35, for reading and transmitting information stored in the RAM 36, and for transmitting information from the antenna 31.

Figure 6:
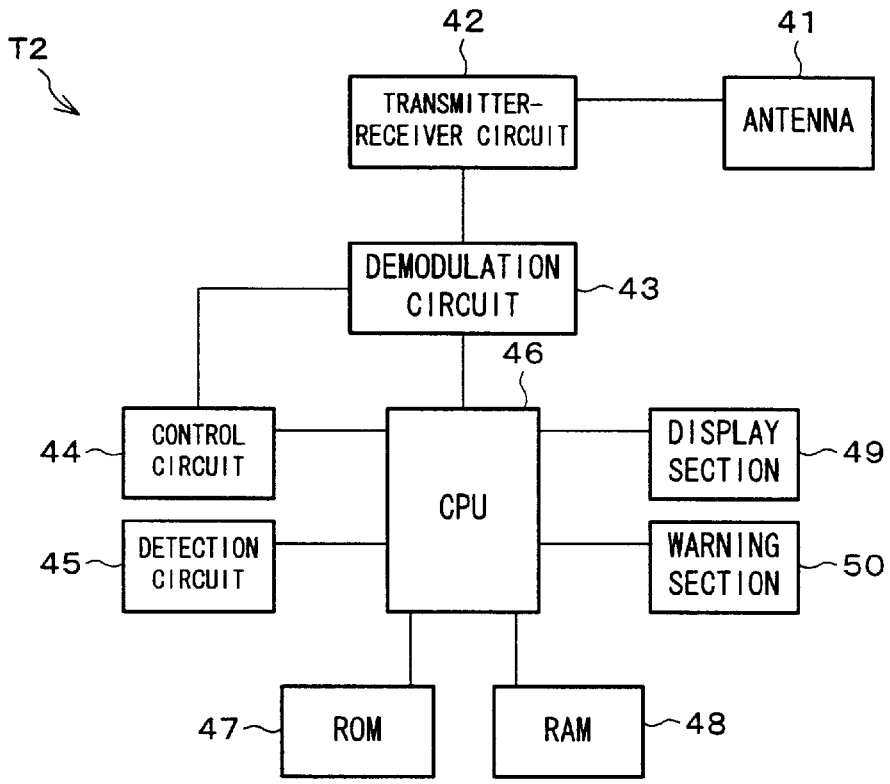
FIG. 6 is a block diagram showing a construction of a communication device on the main body side of the image-forming apparatus of FIG. 1.

Here, as illustrated in FIG. 6, the main body side communication device T2 of the copying machine is constituted by an antenna 41, a transmitter-receiver circuit 42, a demodulation circuit 43, a control circuit 44, a detection circuit 45, a CPU 46, a ROM 47, a RAM 48, a display section 49, and a warning section 50. FIG. 1 exemplifies a case in which the main body side communication device 12 (where the display section 49 and the warning section 50 are placed in the vicinity of the operation panel of the copying machine 1) is attached to a portion facing the developing cartridge 10*a* of FIG. 3 above it.

When an operation is carried out so as to attach a copying machine unit to the copying machine main body, the detection circuit (detection means) 45 detects this operation, and the control circuit 44 controls the transmitter-receiver circuit 42 so as to allow it to send an electric wave for electrical supply to the copying machine unit. In other words, this provides a signal for requesting the copying machine unit to send an individual piece of information. Then, the individual piece of information, transmitted by the transmitter-receiver circuit 32 of the copying machine unit, is received by the transmitter-receiver circuit (reception means, transmitter-receiver means) 42, and demodulated by the demodulation circuit (reading means) 43 so as to be read out.

Based upon the individual information thus demodulated, the CPU (judgment means) 46 makes judgments as to conformity indicating whether or not the position to which the copying machine unit has been attached is a proper position in the copying machine main body and as to suitability indicating whether or not the copying machine unit attached to the proper position in the copying machine main body is an appropriate one, and outputs the results of the judgments.

The judgment as to conformity is made based upon how much intensity the electric wave released by the copying machine unit has when received by the reception and transmission device 42 of the copying machine main body. If the copying machine unit is attached to the right position, the electric wave released therefrom will be detected by the reception side with an always constant intensity. When, for any reason, the received electric wave is weak, it is considered that the copying machine unit is attached to a place apart from the original appropriate position.

In contrast, if the intensity of the received electric wave is too strong, it is considered that the attached position of the copying machine unit is too close to the receiving side, or that another different electric wave is being detected. Therefore, it is one of effective methods to detect the intensity of the electric wave in order to make a judgement as to the conformity (to make an accurate judgement as to the installation position of the copying machine unit).

Moreover, each of the copying machine units is designed to release a signal having a specific level to the copying machine main body for each copying machine unit, and based upon this signal level, the judgement as to the conformity is carried out. This arrangement makes it possible to easily identify a specific copying machine unit from other units, and consequently to prevent the units from being erroneously attached. In this manner, it is effective to carry out the judgements as to conformity and suitability based upon the intensity and the signal level of an electric wave.

The results of the judgments are displayed on the display section (display means) 49, and if any of the units is erroneously attached, an warning is given from the warning section (warning means) 50. Moreover, the display section 49 also has a function for displaying the transmission state and the results of the transmission of the individual information possessed by the copying machine units. With this arrangement, since the display shows whether or not the copying machine unit is being currently in communication with the copying machine main body or whether or not the communication has been completely made, the user is allowed to easily confirm the current situation by observing the display.

Moreover, the CPU 46 executes a program stored in the ROM 47, reads out and transfers data stored in the RAM 48, controls information transmission and receipt to and from the antenna 41, and controls the operations of the detection circuit 45, the display section 49 and the warning section 50.

Figure 7:
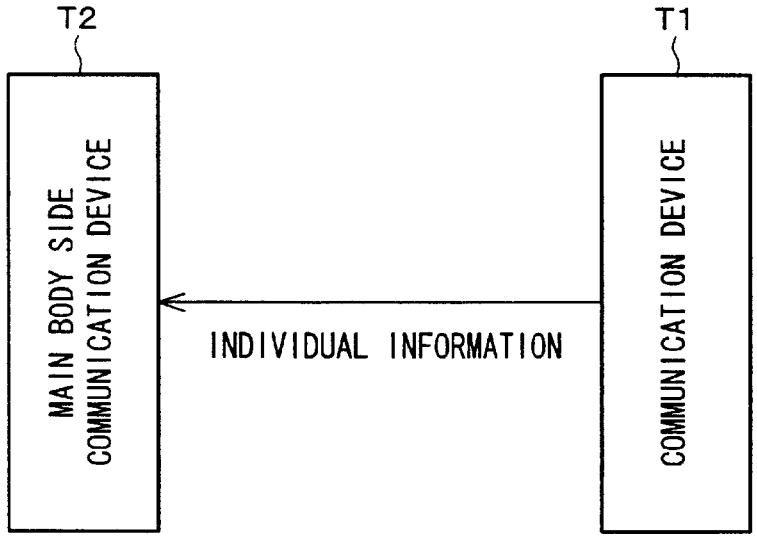
FIG. 7 is an explanatory drawing that shows a communication mode of the communication device of FIG. 4 and the main body side communication device of FIG. 6.

With respect to the communication between the communication device T1 and the communication device T2 on the main body side, as illustrated in FIG. 7, only one-way communication for transmitting individual information from the communication device T1 to the communication device T2 on the main body side is carried out.

FIG. 3 exemplifies a case in which the copying machine unit is a developing cartridge 10*a* as described above, and shows a state in which the communication device T1 is attached and secured to the top surface of the developing cartridge 10*a*. On the copying machine main body side, the main body side communication device T2 of FIG. 6 is attached above the communication device T1 in a manner so as to face it. As illustrated in FIG. 3, the developing cartridge 10*a* to which the communication device T2 has been attached is pushed into the copying machine main body so as to be loaded therein, and following this operation, a transmission process for individual information is started.

Figure 8:
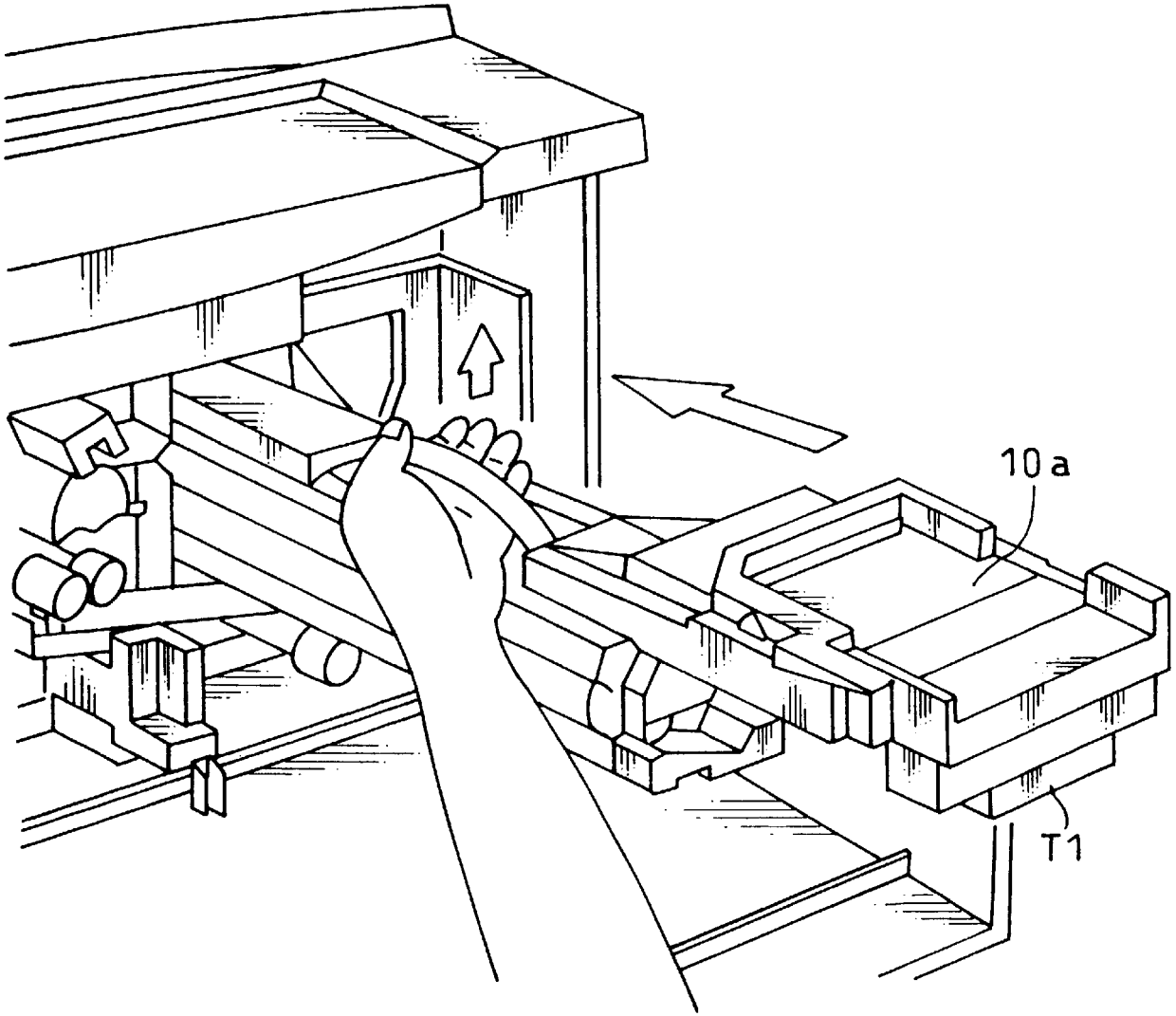
FIG. 8 is an explanatory drawing that shows a state in which a developing cartridge, provided as another example of the image-forming apparatus unit of FIG. 1, is attached to an image-forming apparatus main body.
Figure 9:
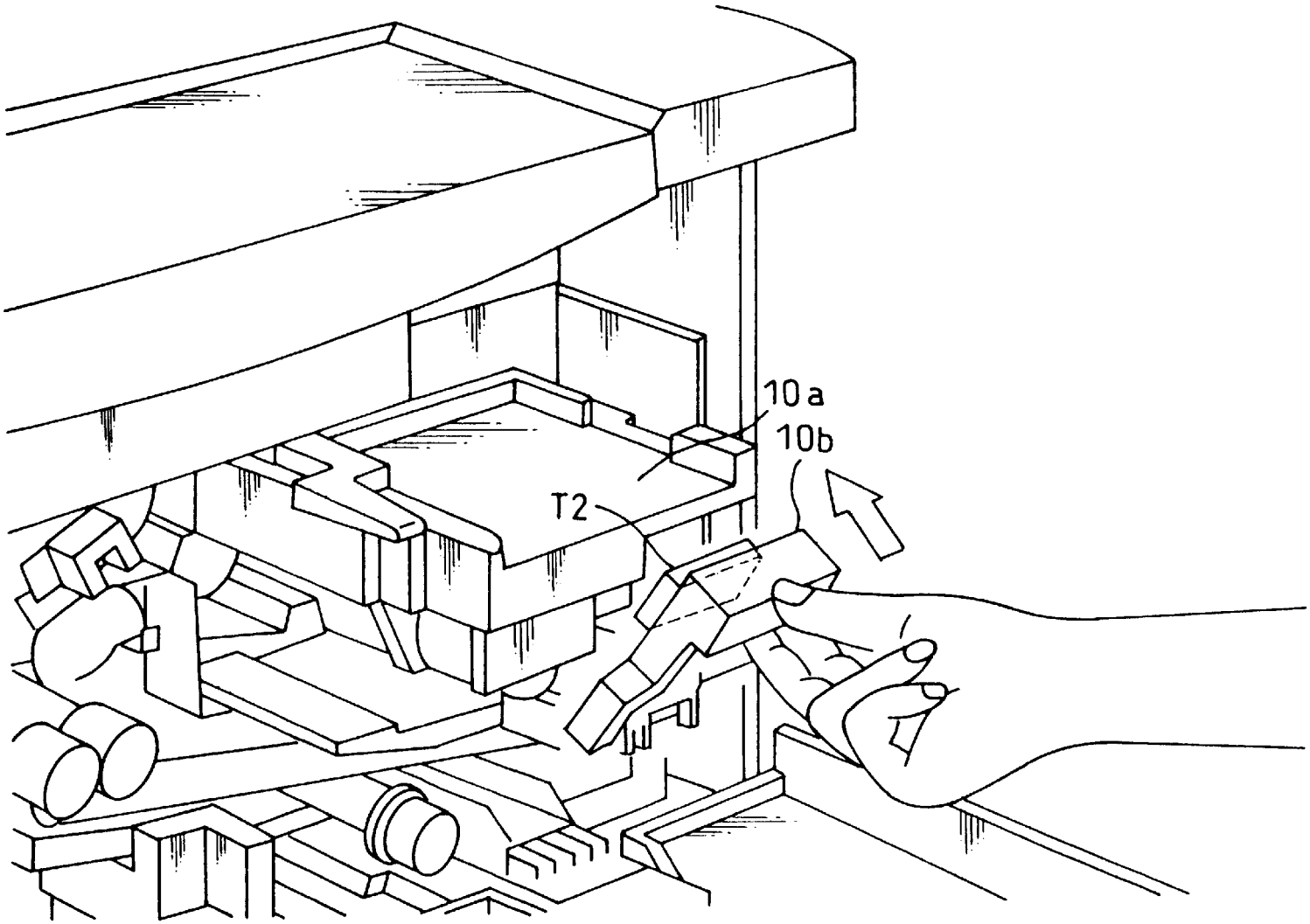
FIG. 9 is an explanatory drawing that shows a state in which a developing cartridge, provided as the example of FIG. 8 of the image-forming apparatus unit of FIG. 1, is attached to an image-forming apparatus main body.

Moreover, FIG. 8 and FIG. 9 show another examples of layouts of the communication device T1 and the main body side communication device T2 in which the copying machine unit is provided as the developing cartridge 10*a*. In this case, as illustrated in FIG. 8, the communication device T1 is attached to the bottom of the front side of the developing cartridge 10*a*, and as illustrated in FIG. 9, the main body side communication device T2 is attached to the inside of a developing unit lever (holding member, movable section) 10*b* that releases locking at the time of attaching the developing cartridge 10*a* to the copying machine main body.

With this arrangement, as soon as the developing cartridge 10*a* is attached to the copying machine main body, the transmission process for individual information is started, thereby making it possible to carry out a smooth communication process. This is because, upon attaching the developing cartridge 10*a* to the copying machine main body, the developing unit lever 10*b* is brought from a locked state (normal state) to a lock-released state (preparation state) so that the antenna 41 of the main body side communication device T2 is separated from the copying machine main body, with the result that the antenna 41 and the antenna 31 of the communication device T1 are allowed to face each other with the closest distance and allowed to start transmitting individual information.

Here, the completion of the transmission is allowed to coincide with the time when, after the developing cartridge 10*a* has been set in the copying machine main body, the developing unit lever 10*b* is returned to its locked state.

Figure 10:
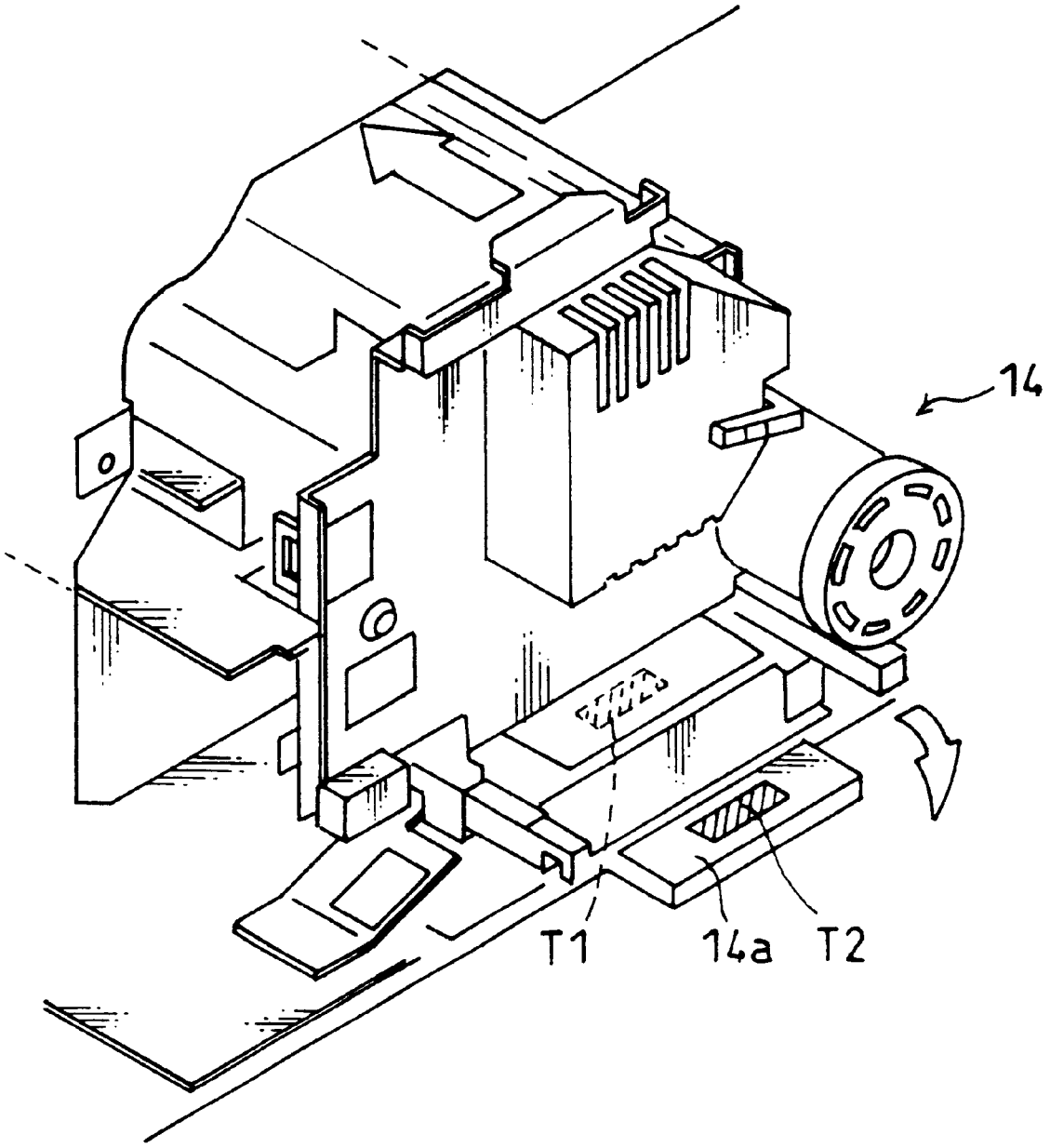
FIG. 10 is an explanatory drawing that shows a state in which a fixing device, provided as an example of the image-forming apparatus unit of FIG. 1, is attached to an image-forming apparatus main body.

FIG. 10 shows an example of a layout of the communication device T1 and the main body side communication device T2, in which the copying machine unit is provided as the fixing device 14. In this case, the communication device T1 is attached to the bottom of the front side of the fixing device 14, and the main body side communication device T2 is attached to the inside of a fixing unit lever (holding member, movable section) 14*b* that releases locking at the time of attaching the fixing device 14 to the copying machine main body.

With this arrangement, following the operation of attaching the fixing device 14 to the copying machine main body, the transmission process for individual information is started, thereby making it possible to carry out a smooth communication process. This is because, upon attaching the fixing device 14 to the copying machine main body, the fixing unit lever 14*a* is brought from a locked state (normal state) to a lock-released state (preparation state) so that the antenna 41 of the main body side communication device T2 is separated from the copying machine main body, with the result that the antenna 41 and the antenna 31 of the communication device T1 are allowed to face each other with the closest distance and allowed to start transmitting individual information.

Here, the completion of the transmission is also allowed to coincide with the time when, after the fixing device 14*a* has been set in the copying machine main body, the fixing unit lever 14*b* is returned to its locked state.

Figure 11:
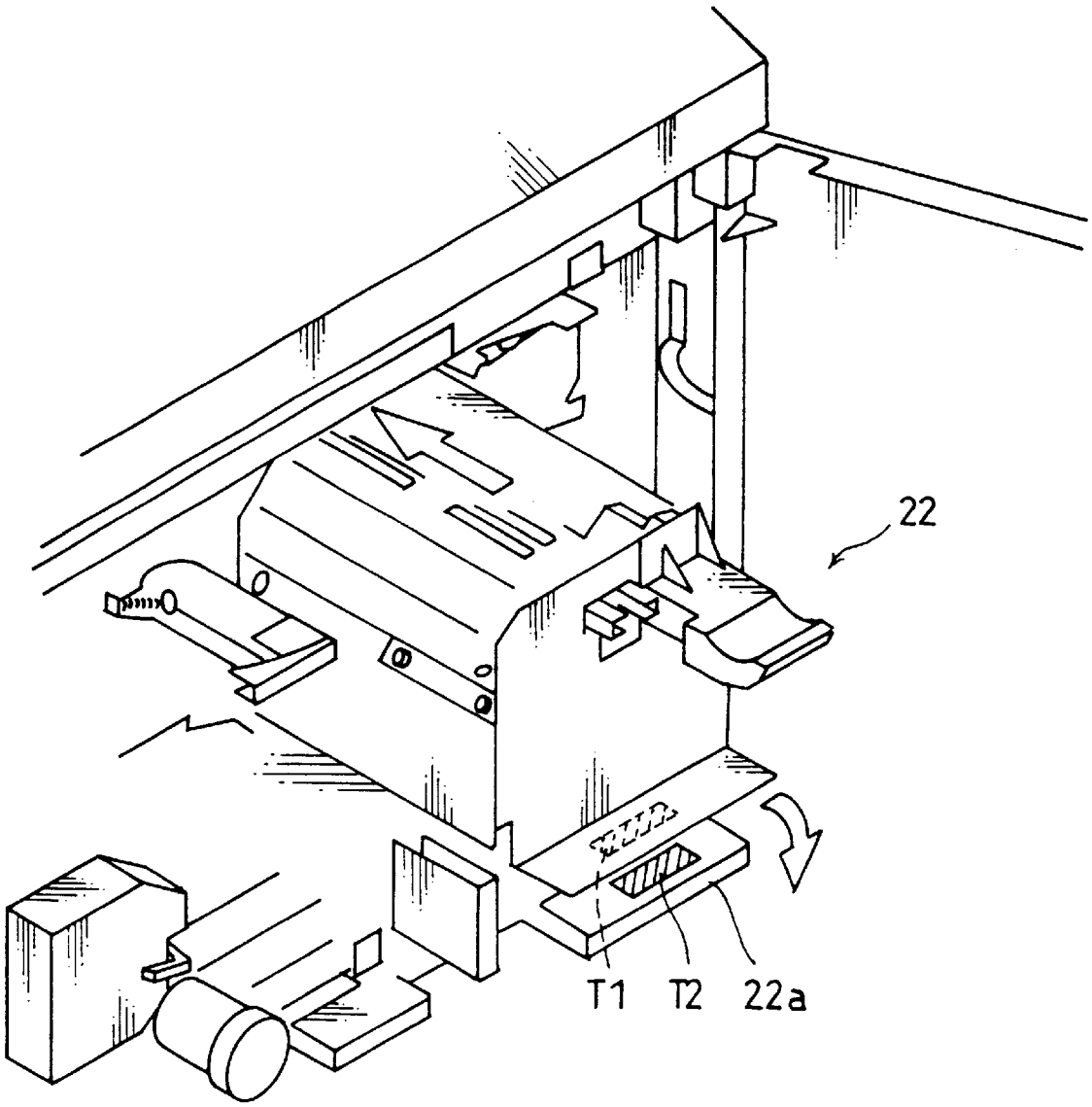
FIG. 11 is an explanatory drawing that shows a state in which a process unit, provided as an example of the image-forming apparatus unit of FIG. 1, is attached to an image-forming apparatus main body.

Moreover, FIG. 11 shows an example of a layout of the communication device T1 and the main body side communication device T2, in which the copying machine unit is provided as a process unit 22 consisting of not less than two composite units among the respective units in the image-forming section. In this case, the communication device T1 is attached to the bottom of the front side of the process unit 22, and the main body side communication device T2 is attached to the inside of a process unit lever (holding member, movable section) 22*a* that releases locking at the time of attaching the process unit 22 to the copying machine main body.

With this arrangement, following the operation of attaching the process unit 22 to the copying machine main body, the transmission process for individual information is started, thereby making it possible to carry out a smooth communication process. This is because, upon attaching the process unit 22 to the copying machine main body, the process unit lever 22*a* is brought from a locked state (normal state) to a lock-released state (preparation state) so that the antenna 41 of the main body side communication device T2 is separated from the copying machine main body, with the result that the antenna 41 and the antenna 31 of the communication device T1 are allowed to face each other with the closest distance and allowed to start transmitting individual information.

Here, the completion of the transmission is also allowed to coincide with the time when, after the process unit 22 has been set in the copying machine main body, the process unit lever 22*a* is returned to its locked state.

Figures 12A, 12B, 12C:
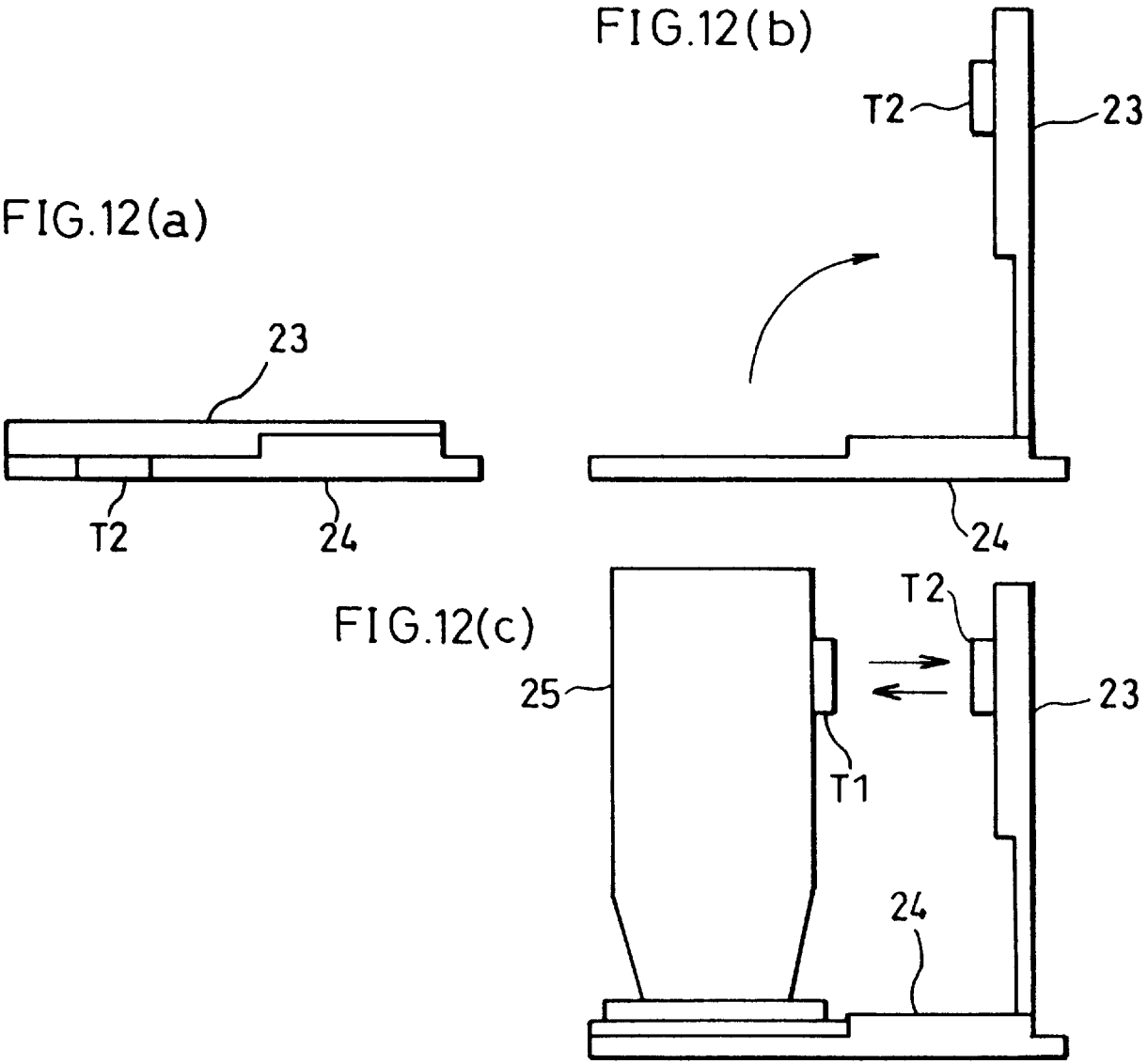
FIGS. 12(*a*) through 12(*c*) are explanatory drawings that show a state in which toner bottles, provided as an example of the image-forming apparatus unit of FIG. 1, is attached to an image-forming apparatus main body.

Furthermore, FIGS. 12(*a*), 12(*b*) and 12(*c*) shows an example of a layout of the communication device T1 and the main body side communication device T2, in which the copying machine unit is provided as a toner bottle 25. As illustrated in FIG. 12(*a*), the main body side communication device T2 is attached to a supply inlet cover (movable section) 23 of the copying machine main body, and as illustrated in FIG. 12(*b*), the supply inlet cover 23 is brought from a closed state (normal state) to an open state (preparation state) with the supply inlet cover 23 being in an upright state on the supply inlet 24; thus, the main body side communication device T2 is placed at the farthest position from the main body. Then, as illustrated in FIG. 12(*c*), the toner bottle 25 to which the communication device T1 has been attached is loaded into the supply inlet 24. This allows the antenna 31 of the communication device T1 attached to the side face of the toner bottle 25 and the antenna 41 of the main body side communication device T2 attached to the supply inlet cover 23 to be aligned face to face with each other with the closest distance.

With this arrangement, following the operation of attaching the toner bottle 25 to the copying machine main body, the transmission process for individual information is started, thereby making it possible to carry out a smooth communication process. If the result of the transmission is "OK", toner 15 is supplied to a reservoir section, not shown, for storing the toner 15. Moreover, in this example, provision may be made so that the transmission for individual information from the communication device T1 is automatically transmitted when the supply inlet cover 23 has become the open state from the closed state.

Additionally, not shown in Figures, the copying machine unit may be provided as a scanner 6. In this case, the main body side communication device T2 is attached to the document cover (movable section) that is opened in a departing manner from the copying machine main body, following an opening operation of the covering member from the copying machine main body. In this case, when the document cover is brought from its closed state (normal state) to its open state (preparation state), both the antenna of the communication device T1 attached to the scanner 6 and the antenna of the main body side communication device T2 are sufficiently separated from the copying machine main body, and also allowed to come closer to each other.

In this manner, the copying machine main body is allowed to carry out communication for individual information with the copying machine unit. Therefore, the copying machine main body can make a judgement as to whether or not any copying machine unit to be attached is an appropriate one based upon the received individual information, and since only one main body side communication device T2 is required, and since, different from the conventional system, bar code readers need not be installed for the individual toner supply sections, it becomes possible to reduce costs.

Moreover, since the communication is carried out by radio waves, no adverse effect is given to the communication even if the copying machine units and/or the copying machine main body are contaminated by toner 15, etc., and since the communication is automatically started at the time of attaching any of the copying machine units to the copying machine main body, no complex operation is required for carrying out the communication.

Furthermore, since the communication is made in a non-contact state, limitations in an installation method, which have been imposed on the conventional construction of an electric circuit between the copying machine unit and the copying machine main body, are no longer required, thereby improving the degree of freedom in designing the installation mode. The resulting simple construction of the copying machine unit reduces a space required and the resulting elimination of terminals (connectors) makes it possible to improve the durability.

With an arrangement in which the main body side communication device T2 is installed in any movable section that is shifted upon attaching the copying machine unit to the predetermined position of the copying machine main body, communication with the copying machine unit is carried out at a position sufficiently apart from the main body frame that is made of metal; therefore, it becomes possible to ensure a stable transferring state in electric waves. In particular, when provision is made so that the antenna 31 of the communication device T1 and the antenna 41 of the main body side communication device T2 come closest to each other in a state where the movable section is located at the farthest position from the main body, it becomes possible to further ensure the communication at the time of attaching the copying machine unit. At this time, since no metal parts interrupting electric waves are located between the antenna 31 of the communication device T1 and the antenna 41 of the main body side communication device T2, and since the movable section is located farthest from the metal parts constituting the copying machine main body, electric waves are less susceptible to interruption in the communication at the time of attaching the copying machine unit.

Referring to various examples, the following description will discuss a sequence of communication processes between the copying machine units having the above-mentioned construction and the copying machine main body.

Figure 13:
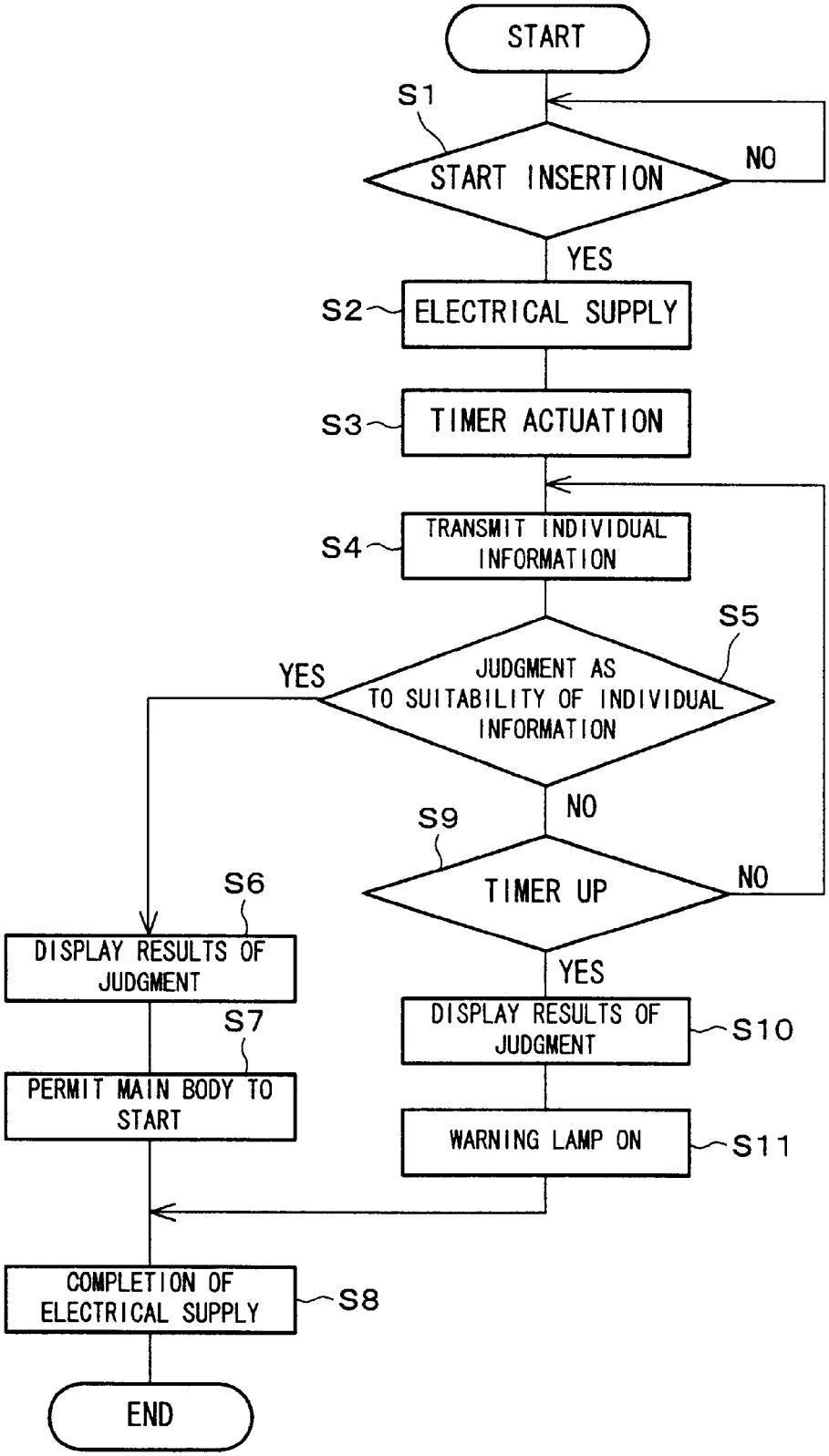
FIG. 13 is a flow chart that shows an example of a sequence of communication processes between the communication device of FIG. 4 and the main body side communication device of FIG. 6.
Figure 14:
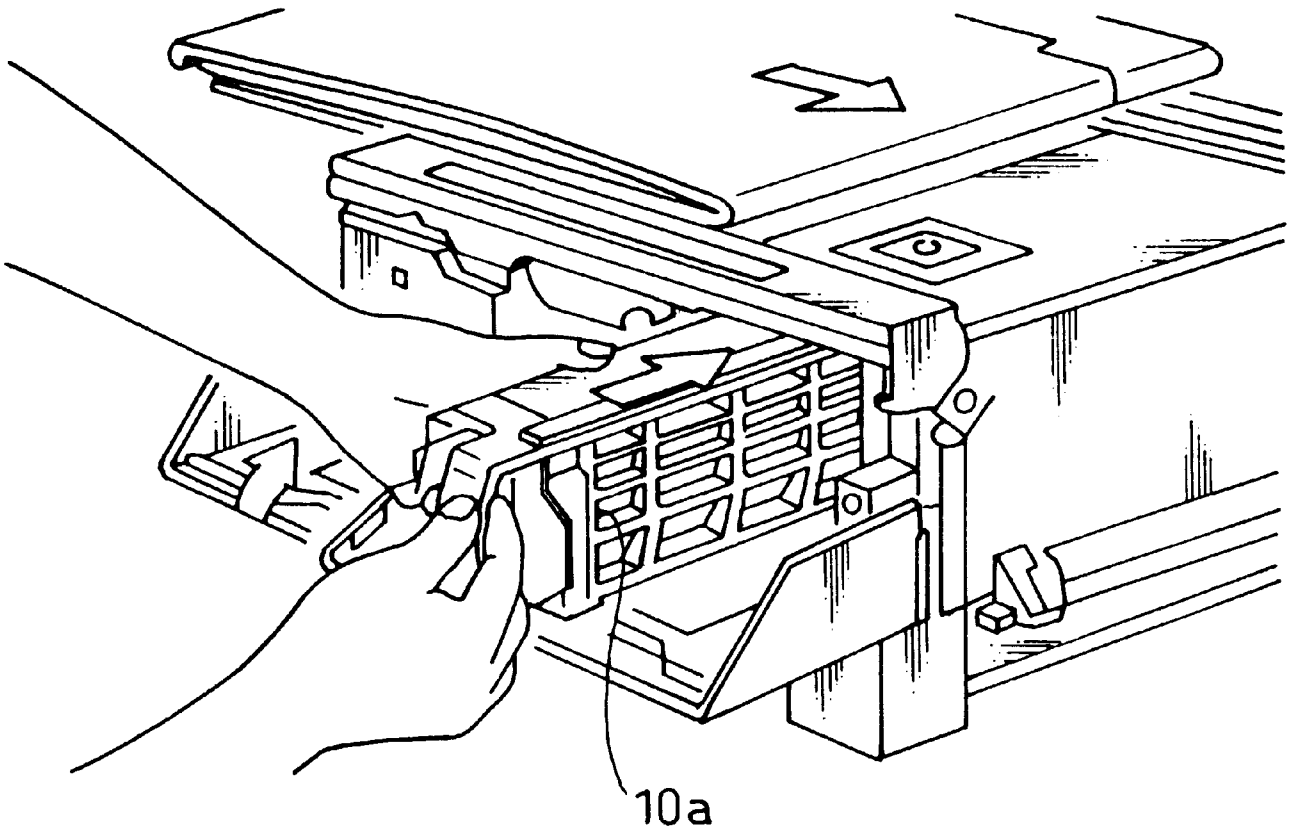
FIG. 14 is an explanatory drawing that shows a first example of the start of attaching operation in the flow chart of FIG. 13.
Figure 15:
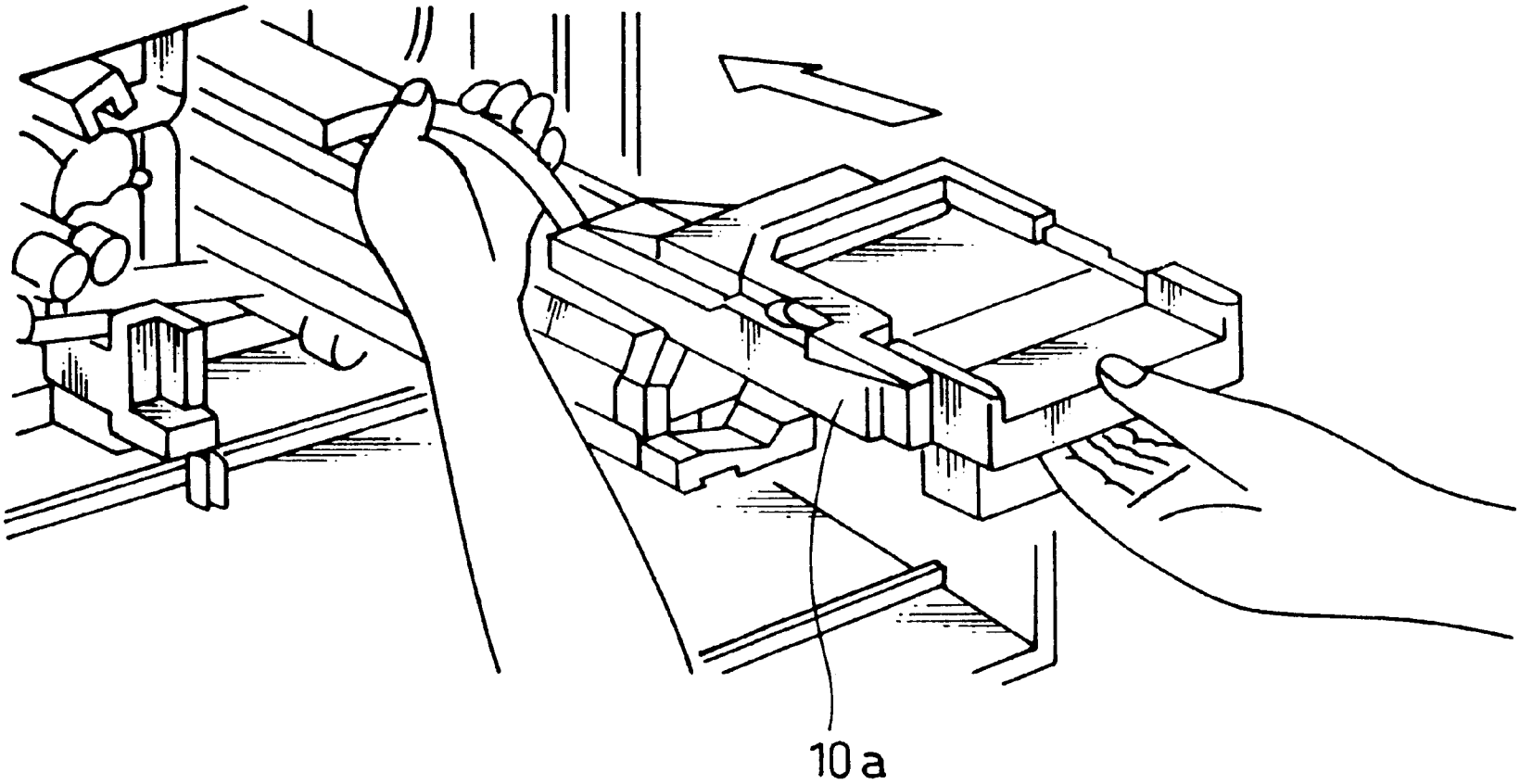
FIG. 15 is an explanatory drawing that shows a second example of the start of attaching operation in the flow chart of FIG. 13.
Figure 16:
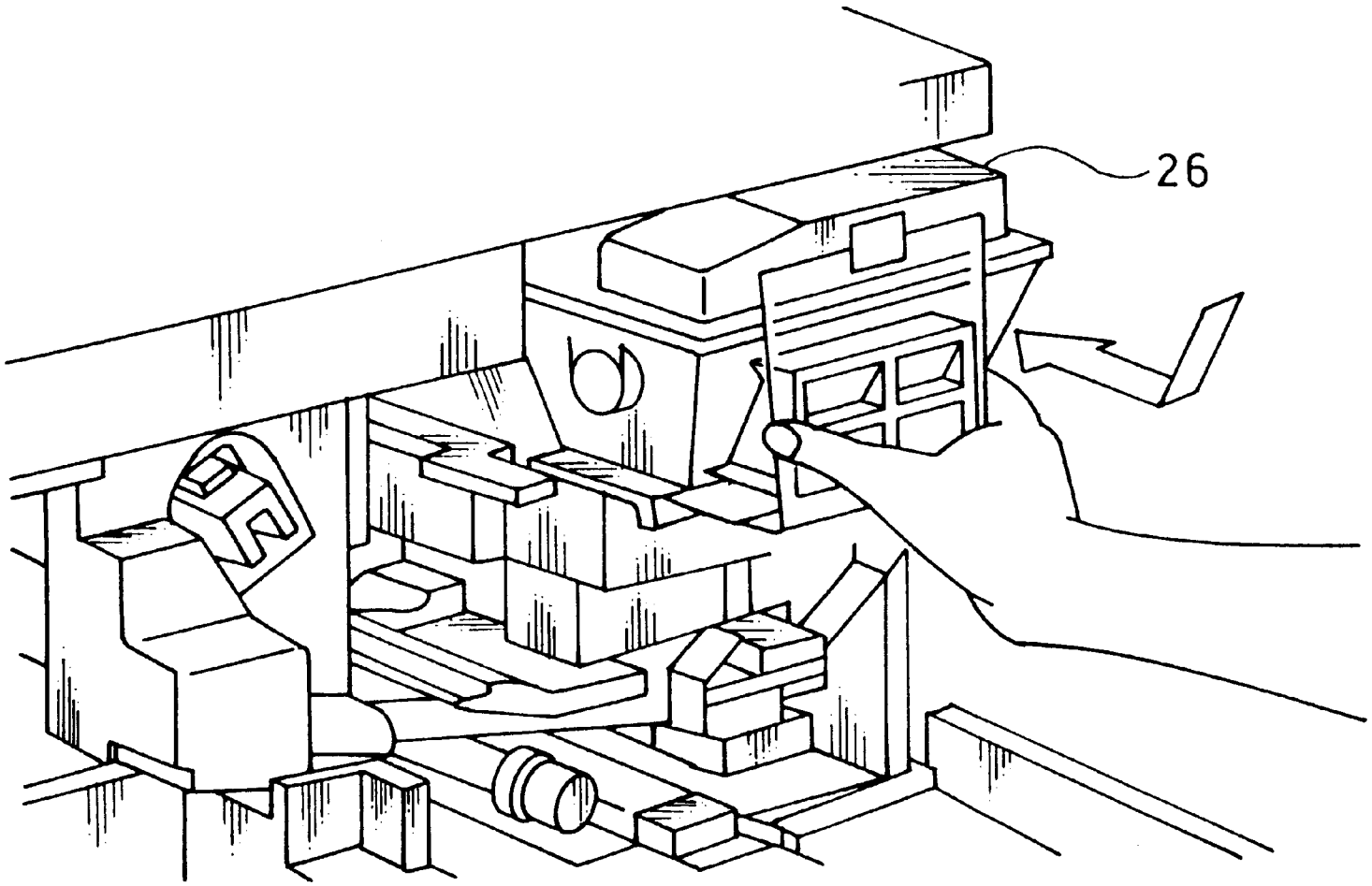
FIG. 16 is an explanatory drawing that shows a third example of the start of attaching operation in the flow chart of FIG. 13.
Figure 17:
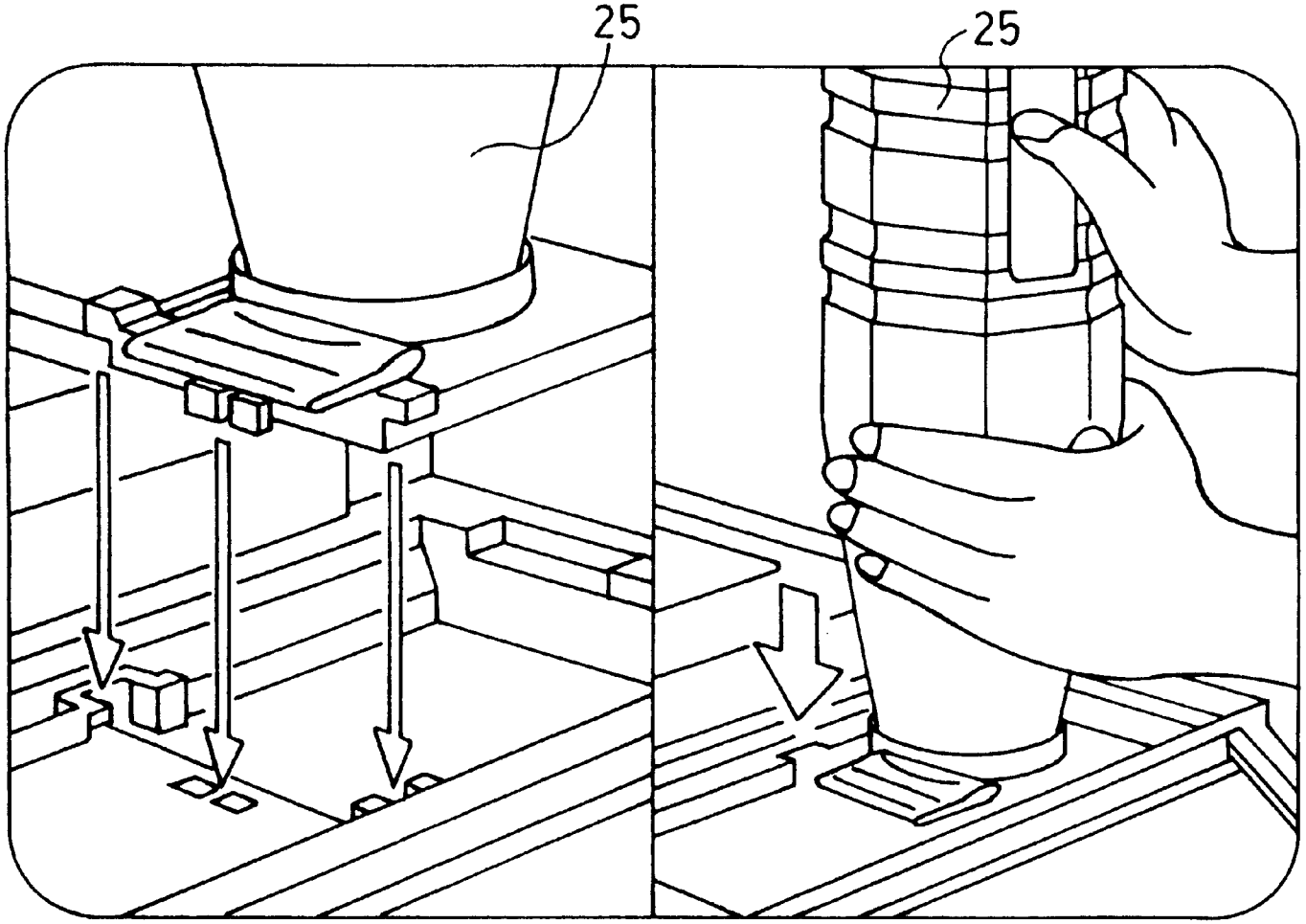
FIG. 17 is an explanatory drawing that shows a fourth example of the start of attaching operation in the flow chart of FIG. 13.
Figure 18:
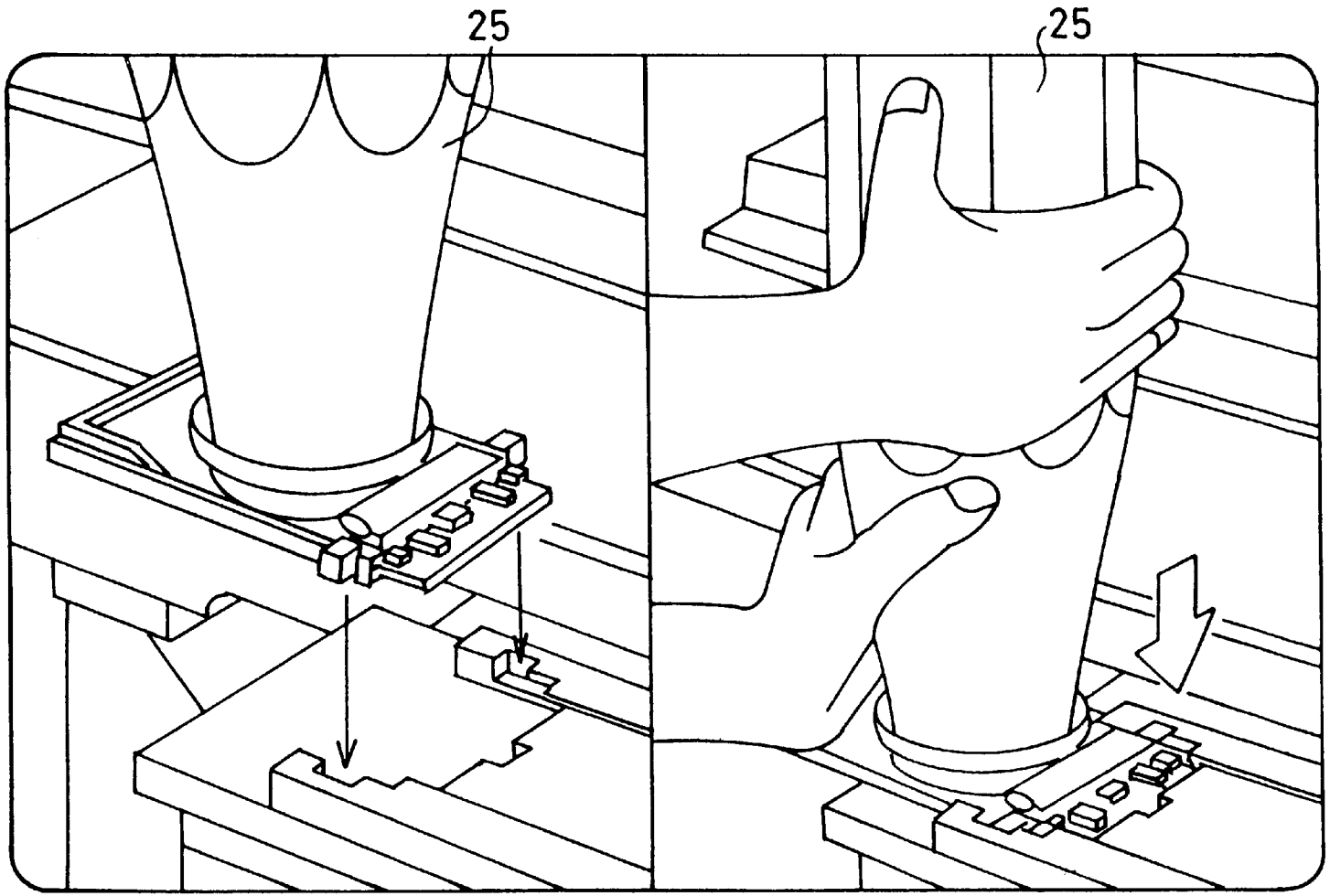
FIG. 18 is an explanatory drawing that shows a fifth example of the start of attaching operation in the flow chart of FIG. 13.

FIG. 13 is a flow chart that shows the most typical communication processes in the present embodiment. When the insertion process of a copying machine unit is started at S1, the detection circuit 45 on the main body side communication device T2 detects this action at S2, and an electric wave is supplied from the transmitter-receiver circuit 42 to the transmitter-receiver circuit 32 of the communication device T1 of the copying machine unit so that electrical supply is given to the communication device T1. Upon receipt of the electrical supply, a timer in the copying machine main body, not shown, is actuated at S3. The start of the insertion process refers to a point of time at which, as illustrated in FIGS. 14 through 18, one of the units, such as the developing cartridge 10*a*, the toner cartridge 26 and the toner bottle 25, is set at an attaching preparation position on a predetermined portion of the machine.

At S4, the communication device T1 transmits individual information read from the RAM 36 from the transmitter-receiver circuit 32, and at S5, the main body side communication device T2 receives this information at the transmitter-receiver circuit 42, and after this has been demodulated by the demodulation circuit 43, the CPU 46 refers to information preliminarily stored in the RAM 48 so as to make a judgment as to the conformity and/or suitability of the individual information based upon the information. When the conformity and suitability are satisfied, the sequence proceeds to S6, and the results of such judgments are displayed on the display section 49, and since, in accordance with this process, the starting of the copying machine main body is permitted at S7, the electric wave supply to the communication device T1 is stopped at S8, thereby completing the electrical supply.

At S5, if the CPU 46 has made a judgment that the individual information fails to satisfy the conformity and/or the suitability, the sequence proceeds to S9, and the sequence returns to S4 and repeats the transmission of the individual information within a predetermined period of time, that is, until the time counted by the timer is up. When the time is up at S9, the judgment is finally made that the individual information has failed to satisfy the conformity and/or the suitability, and the results of such judgments are displayed on the display section 49 at S10. Thus, at S11, a warning is given by the warning section 50, for example, in the form of lighting up of a warning lamp, and the sequence proceeds to S8 at which the electric wave supply to the communication device T1 is stopped so that the electrical supply is complete.

In this case, the processes up to the display or the warning are completed from the operation step indicating the start of insertion of the copying machine unit to the predetermined portion until the operation step indicating the completion of the insertion, that is, for example, from the opening of the front cabinet to the closing thereof. Therefore, prior to completion of the insertion of the copying machine unit to the copying machine main body, the display or the warning as to the results of the judgment is given in such a manner that it becomes possible to prevent an erroneous insertion beforehand.

Figure 19:
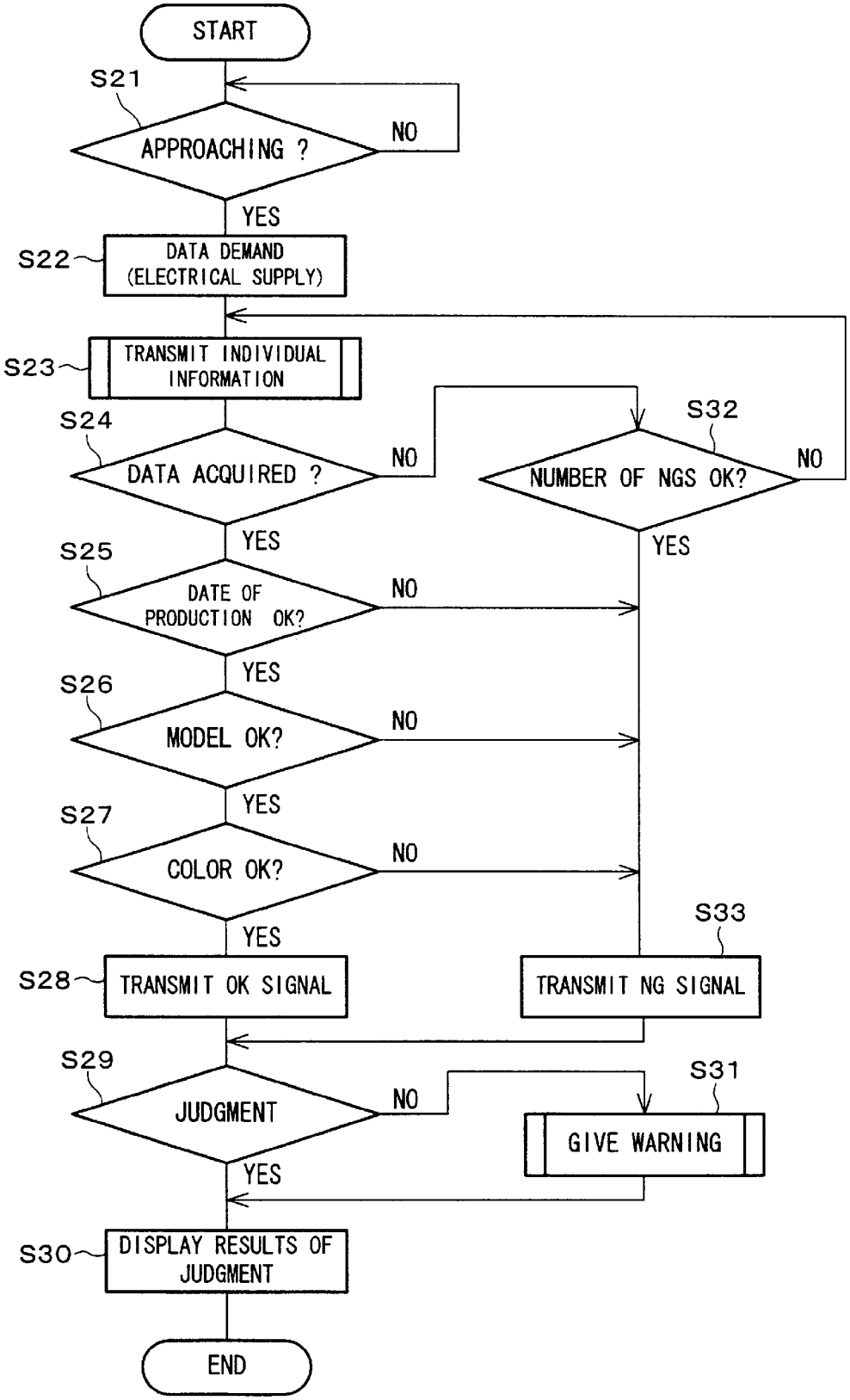
FIG. 19 is a flow chart that shows another example of the sequence of communication processes between the communication device of FIG. 4 and the main body side communication device of FIG. 6.

FIG. 19 is a flow chart that shows communication processes in the case when the detection circuit 45 of the main body side communication device T2 is provided as a proximity detection circuit in order to automatically carry out an electrical supply to the copying machine unit, simultaneously as the insertion of the copying machine unit is started.

When the copying machine unit approaches the predetermined portion of the copying machine main body, the proximity detection circuit of the main body side communication device T2 detects this state at S21. In this case, approaching refers to a state in which it is located within a predetermined distance from the predetermined portion of the copying machine main body. Next, at S22, an electric wave is supplied from the transmitter-receiver circuit 42 to the communication device T1 so as to give an electrical supply and to demand for a transmission of individual information. Then, the communication device T1 reads out a piece of individual information stored in the RAM 36 at S23, and transmits this from the transmitter-receiver circuit 32 to the main body side communication device T2.

The main body side communication device T2 makes a judgment as to whether or not the individual information has been received and accepted at S24, and if it has been accepted, judgments are successively made as to whether or not factors included in the individual information, such as the manufacture time, the type of the device and the kinds of colors, are suitable ones (in the case when the copying machine unit is the developing cartridge 10*a*, the toner cartridge 26, or the toner bottle 25)(S25, S26, S27). If all the factors are suitable ones, an OK signal is transmitted at S28, and at S29, the CPU 46 makes a judgment as to the suitability of the individual information based upon the OK signal. If the result of the judgment is "OK", the corresponding display is provided on the display section 49 at S30, and if the result is "NO", a warning is given by the warning section 50 at S31, and the sequence then proceeds to S30 where the corresponding display is given on the display section 49.

Here, in the case when, at S32, the acquiring process for individual information from the copying machine main body side is not valid even after a predetermined number of transmissions from the copying machine unit, or in the case when, at S25, S26 or S27, any of the judgements as to the manufacture time, the type of the device or the kind of colors shows that the individual information is invalid, an NG signal is transmitted at S33, and the sequence proceeds to S29 where the CPU 46 makes a judgment as to the suitability of the individual information based upon the NG signal.

With the proximity detection for the copying machine unit, for example, even if the copying machine unit is in a packaged state, by allowing this to come closer to the predetermined portion, it is possible to make a judgement as to whether or not it is a suitable copying machine unit (for example, in the case of the toner cartridge 26, as to whether or not it is a right toner or a different toner) and consequently to give the corresponding display or warning, even before unpackaging it.

Figure 20:
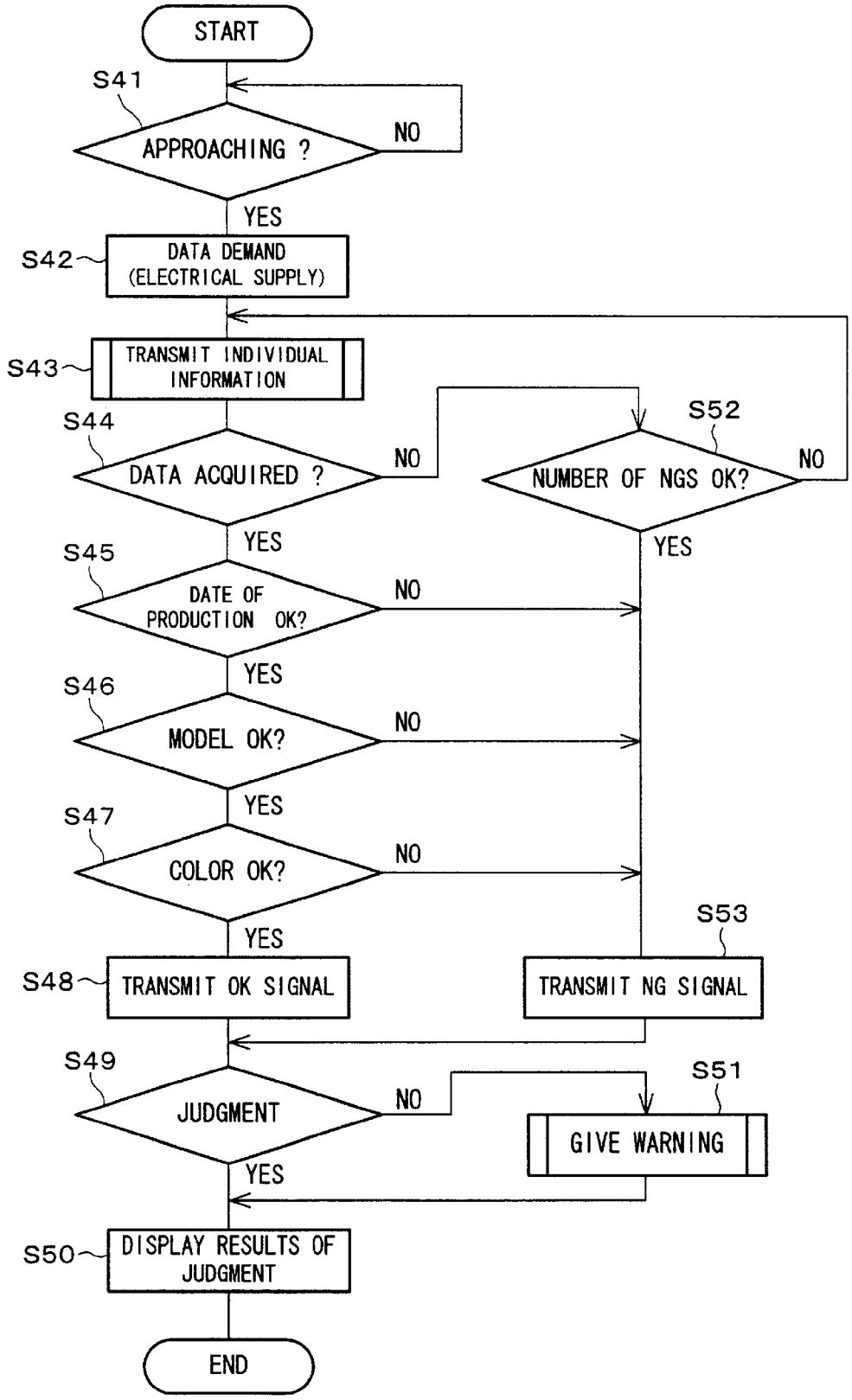
FIG. 20 is a flow chart that shows still another example of a sequence of communication processes between the communication device of FIG. 4 and the main body side communication device of FIG. 6.
Figure 21:
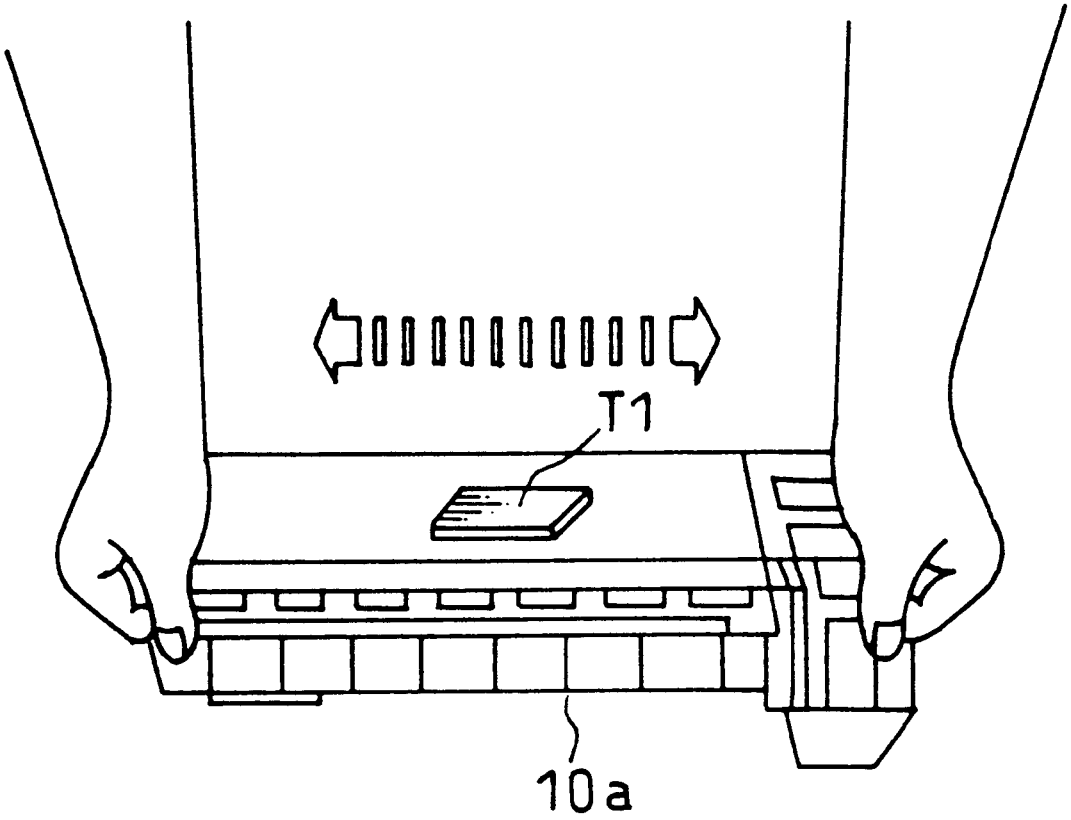
FIG. 21 is an explanatory drawing that shows a first example of an operation for applying acceleration in the flow chart of FIG. 20.
Figure 22:
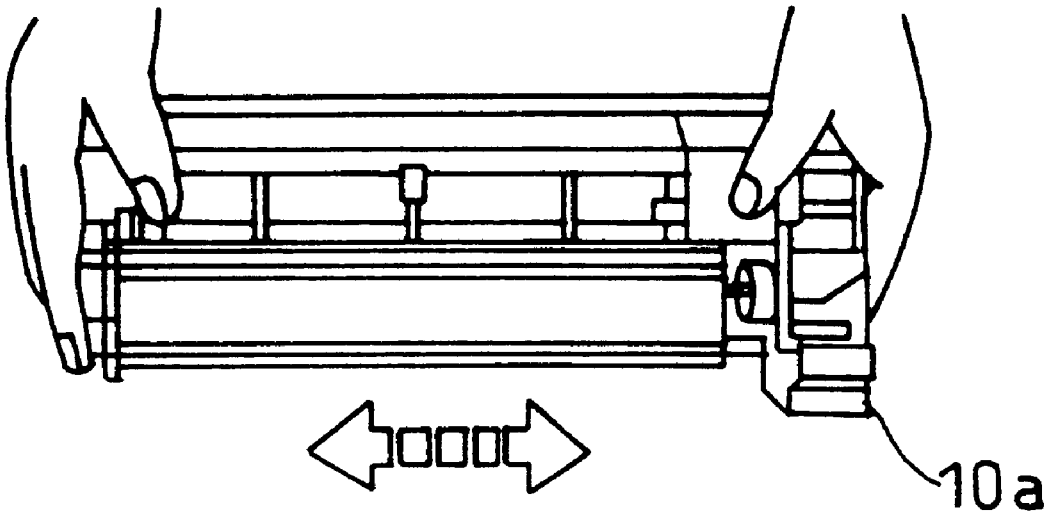
FIG. 22 is an explanatory drawing that shows a second example of the operation for applying acceleration in the flow chart of FIG. 20.
Figure 23:
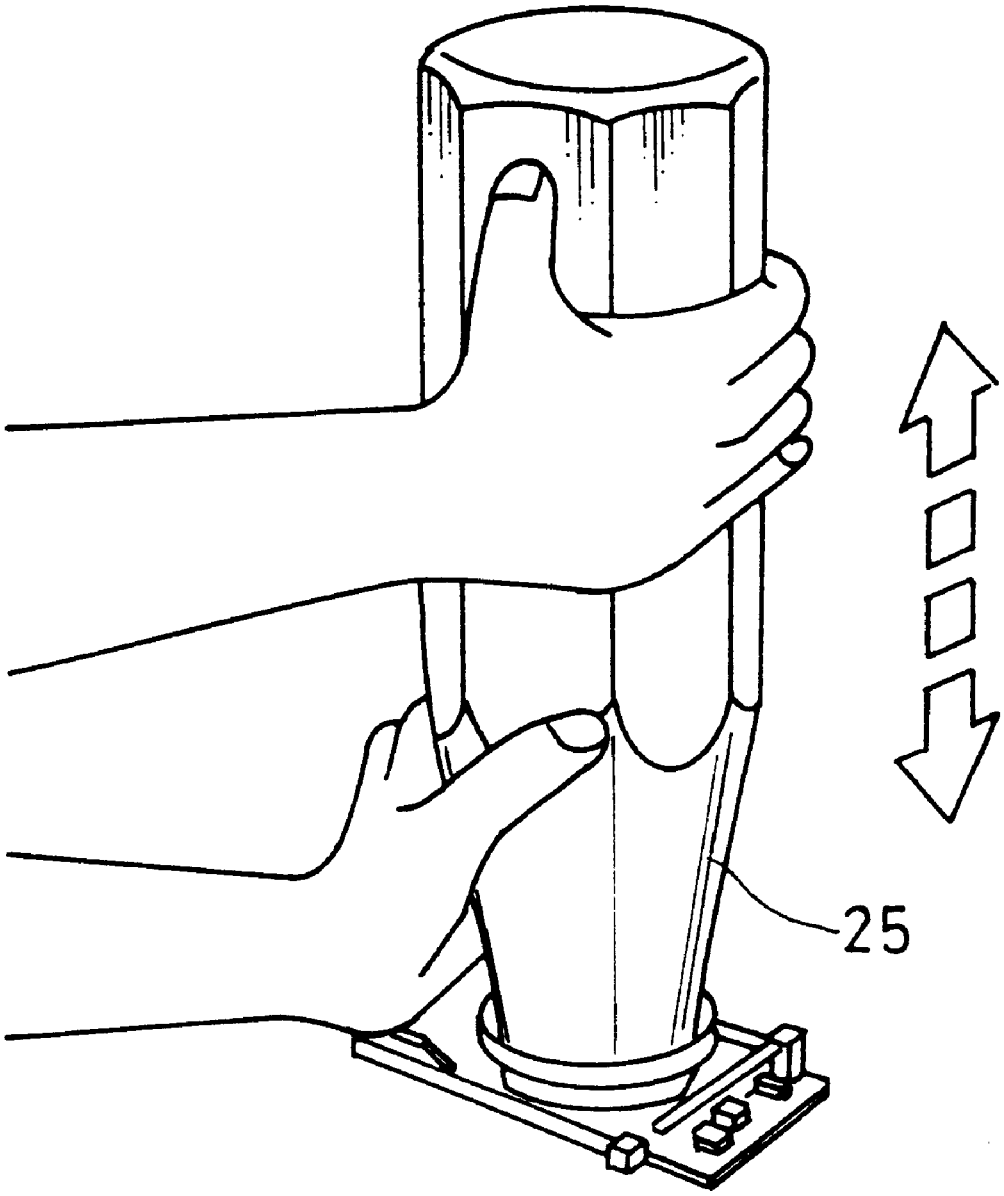
FIG. 23 is an explanatory drawing that shows a third example of the operation for applying acceleration in the flow chart of FIG. 20.
Figure 24:
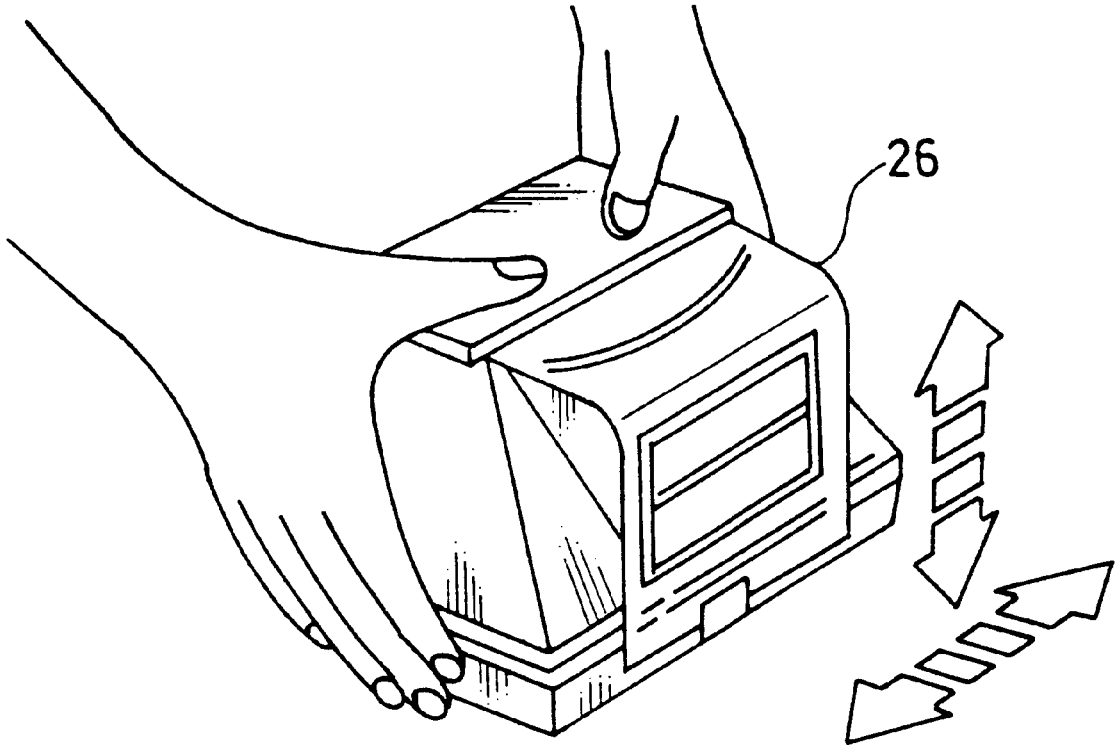
FIG. 24 is an explanatory drawing that shows a fourth example of the operation for applying acceleration in the flow chart of FIG. 20.

FIG. 20 is a flow chart that shows a case in which the detection circuit 45 of the main body side communication device T2 is designed so as to detect the acceleration of the copying machine unit and to give an electrical supply, in order to automatically carry out the electrical supply to the copying machine unit, simultaneously as the insertion of the copying machine unit is started. In this case, the timing in which an electrical supply is given to the communication device T1 is made coincident with a point of time when the copying machine unit has received a predetermined acceleration at S41.

For example, as illustrated in FIGS. 21 through 24, when a developing cartridge 10*a* (FIG. 21 and FIG. 22), a toner bottle 25 (FIG. 23), or a toner cartridge 26 (FIG. 24) is shaken prior to the insertion so as to stir the toner, an acceleration is exerted by the shaking. A coil and a magnet are preliminarily assembled into these parts as constituent elements, and when the shaking causes an acceleration with the result that an electric current is generated due to the electromagnetic induction phenomenon, the electric current is detected by the detection circuit 45 of the main body side communication device T2 so as to give an electrical supply to the copying machine unit.

Since steps from S42 to S53 are the same as the above-mentioned steps from S22 to S33 of FIG. 19, the description thereof is omitted. As described above, by detecting the receipt of a predetermined acceleration, it becomes possible to easily make a judgment as to the suitability of the applied copying machine unit. Therefore, for example, if a copying machine unit is in a packaged state, it is possible to determine whether or not this is a suitable copying machine unit even before unpackaging it by bringing this closer to the predetermined portion, and for example, in the case of a toner cartridge 26, it is possible to give a display or a warning as to whether this contains a proper toner or a different toner with respect to the predetermined portion.

Figure 25:
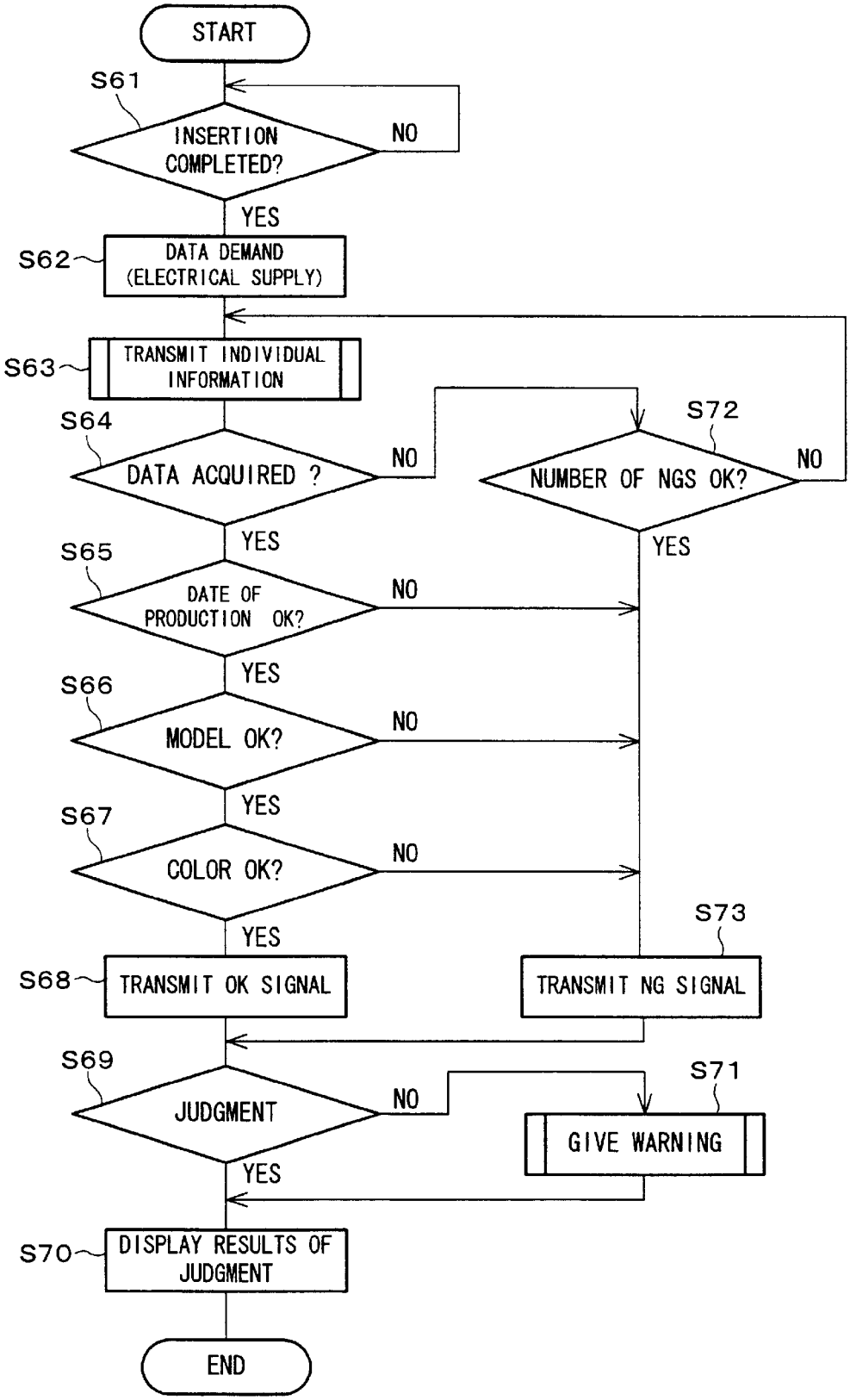
FIG. 25 is a flow chart that shows still another example of the sequence of communication processes between the communication device of FIG. 4 and the main body side communication device of FIG. 6.
Figure 26:
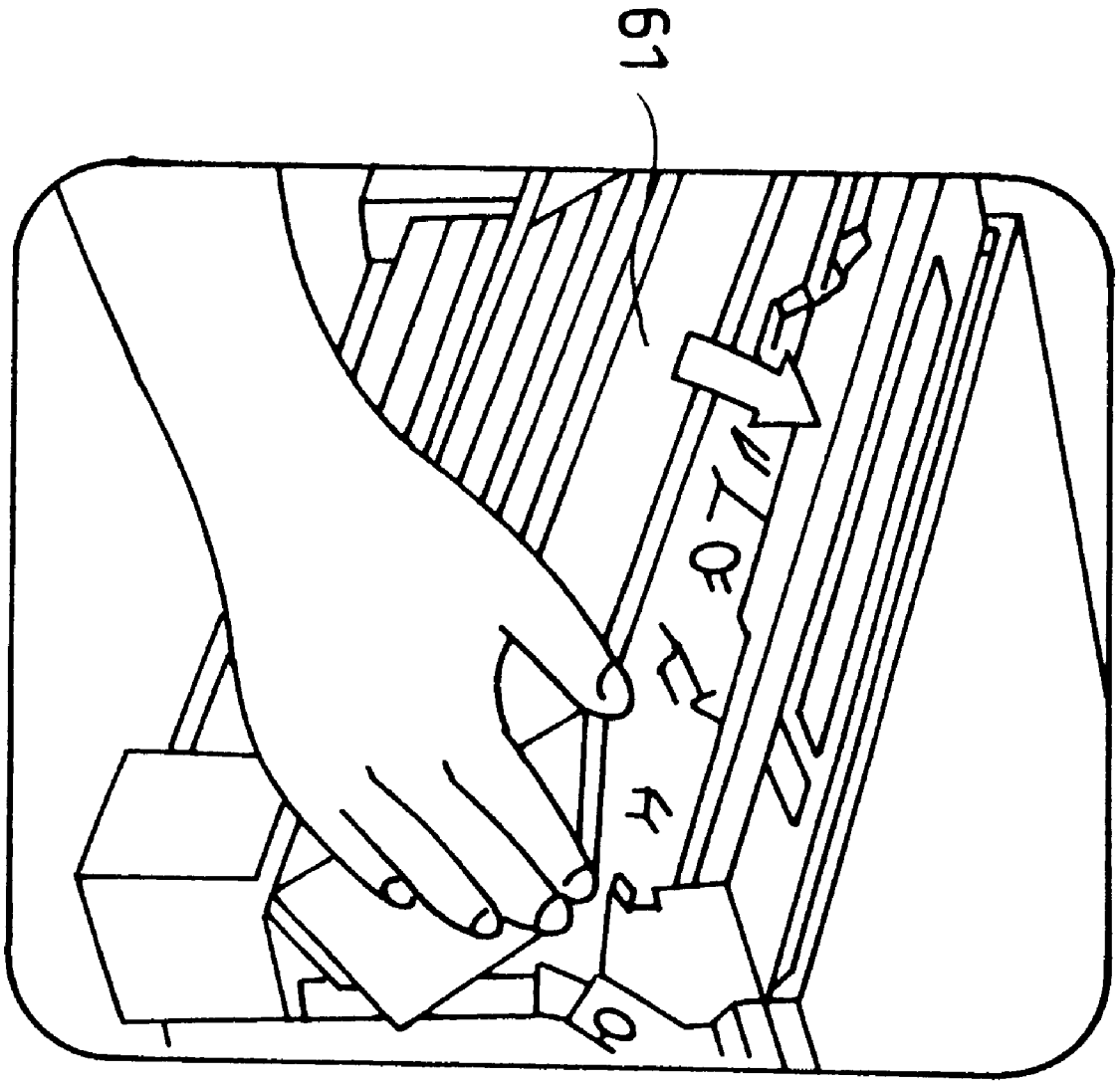
FIG. 26 is an explanatory drawing that shows a first example of the completion of attaching operation in the flow chart of FIG. 25.
Figure 27:
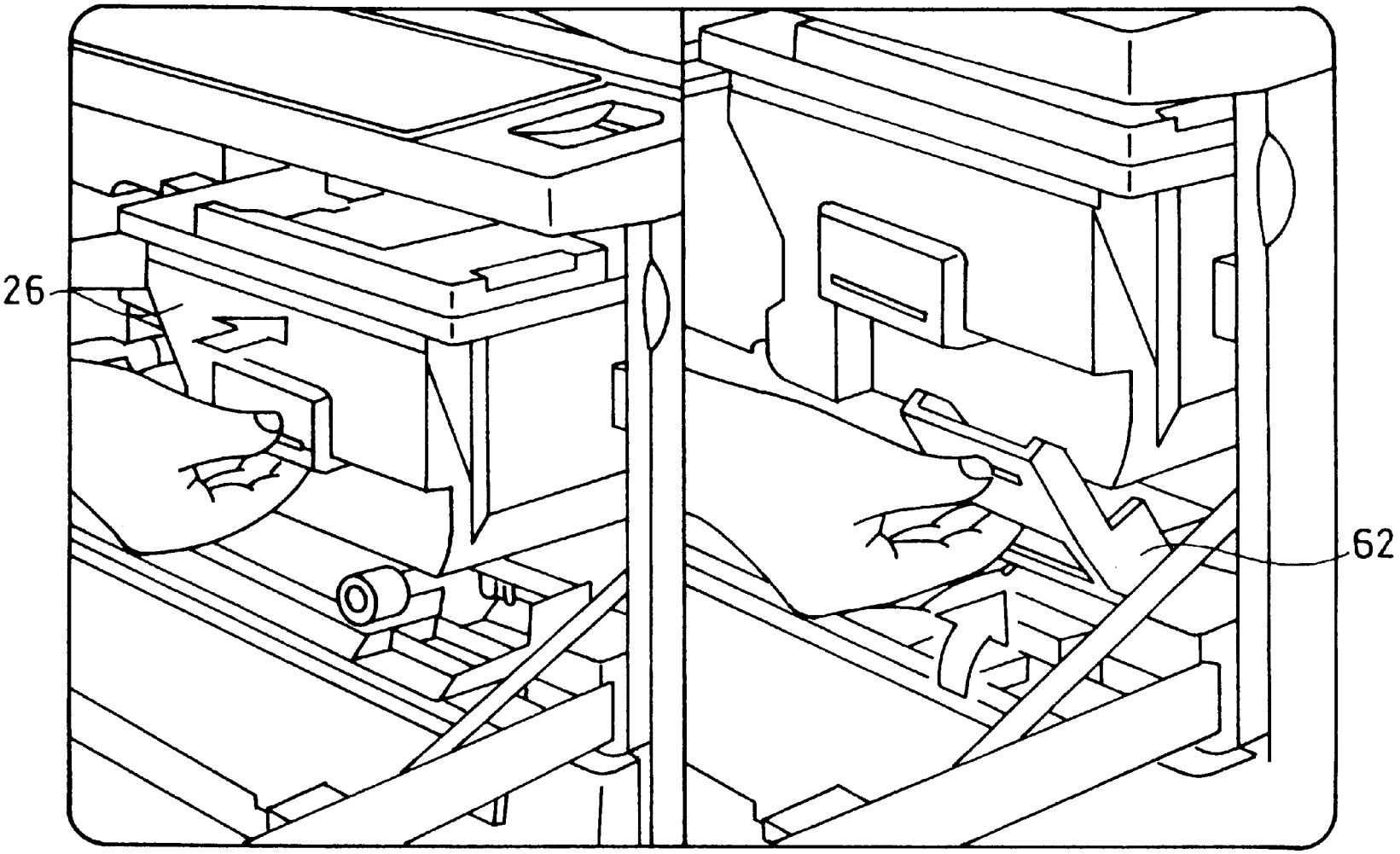
FIG. 27 is an explanatory drawing that shows a second example of the completion of attaching operation in the flow chart of FIG. 25.
Figure 28:
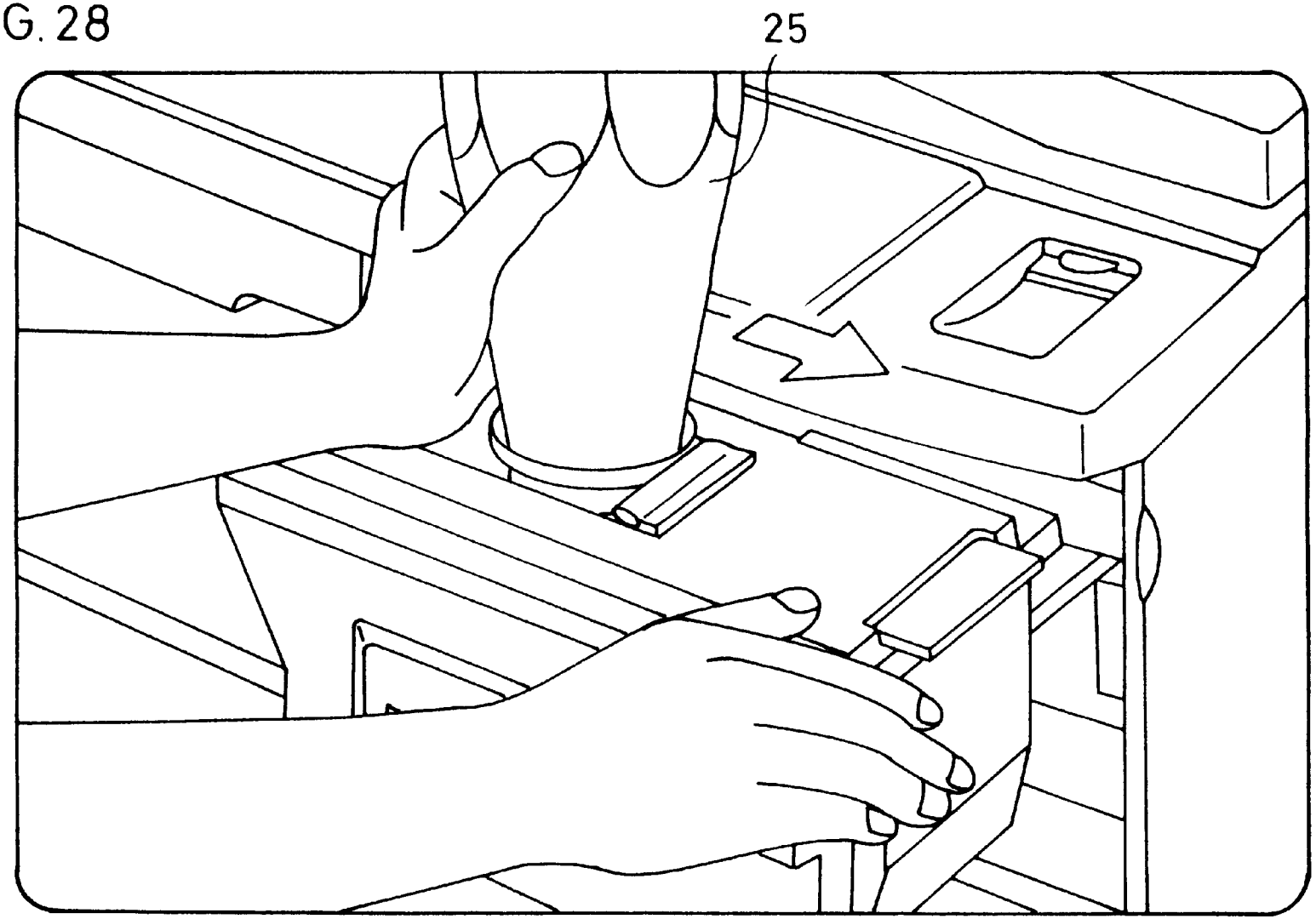
FIG. 28 is an explanatory drawing that shows a third example of the completion of attaching operation in the flow chart of FIG. 25.

FIG. 25 is a flow chart showing a case in which an electrical supply is given from the main body side communication device T2 to the communication device T1. That is, in this flow chart, the transmission of individual information by the communication device T1 is started after a copying machine unit has been inserted to the predetermined portion of the copying machine. For example, as illustrated in FIGS. 26 through 28, operations indicating the completion of the insertion are defined as the following points of time: at the time of closing a front cover 61 of the copying machine main body (FIG. 26), at the time of locking a toner box lever 62 after the toner cartridge 26 has been pushed into a predetermined portion (FIG. 27), and at the time when the toner bottle 25 has been set to a predetermined portion of the copying machine main body. Then, at S61, when the detection circuit 45 of the main body side communication device T2 has detected any of these actions at S61, an electrical supply to the communication device T1 is started.

Since steps S62 to S73 are the same as the aforementioned steps S22 to S33 of FIG. 19, the description thereof is omitted. As described above, the communication device T1 transmits individual information after completion of the insertion to the predetermined portion so that it is possible to confirm the completion of the loading operation. Moreover, since the individual information is not transmitted if the insertion operation has not been completely finished, it is possible to prevent incomplete operations.

Figure 29:
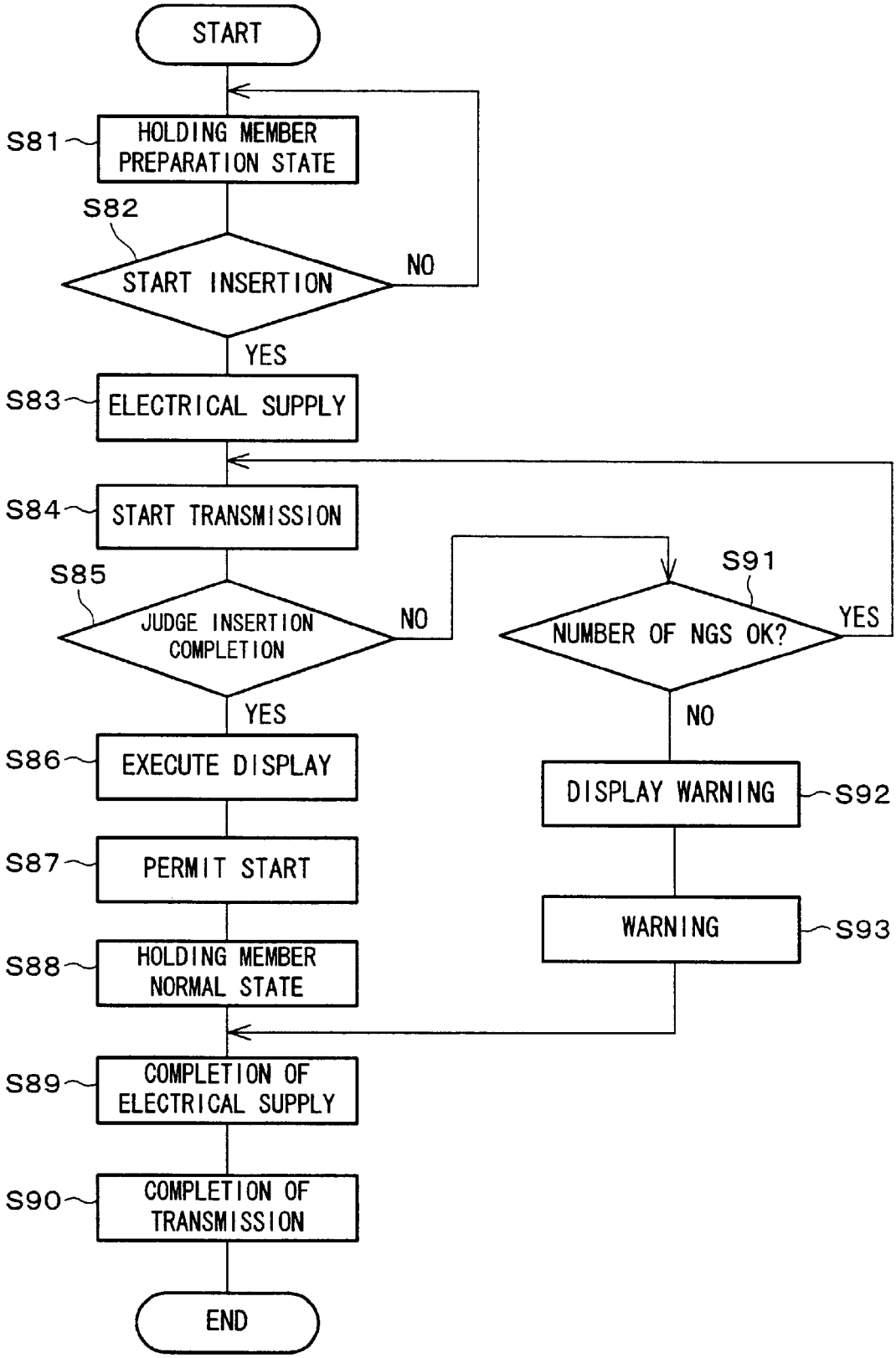
FIG. 29 is a flow chart that shows still another example of the sequence of communication processes between the communication device of FIG. 4 and the main body side communication device of FIG. 6.
Figure 30:
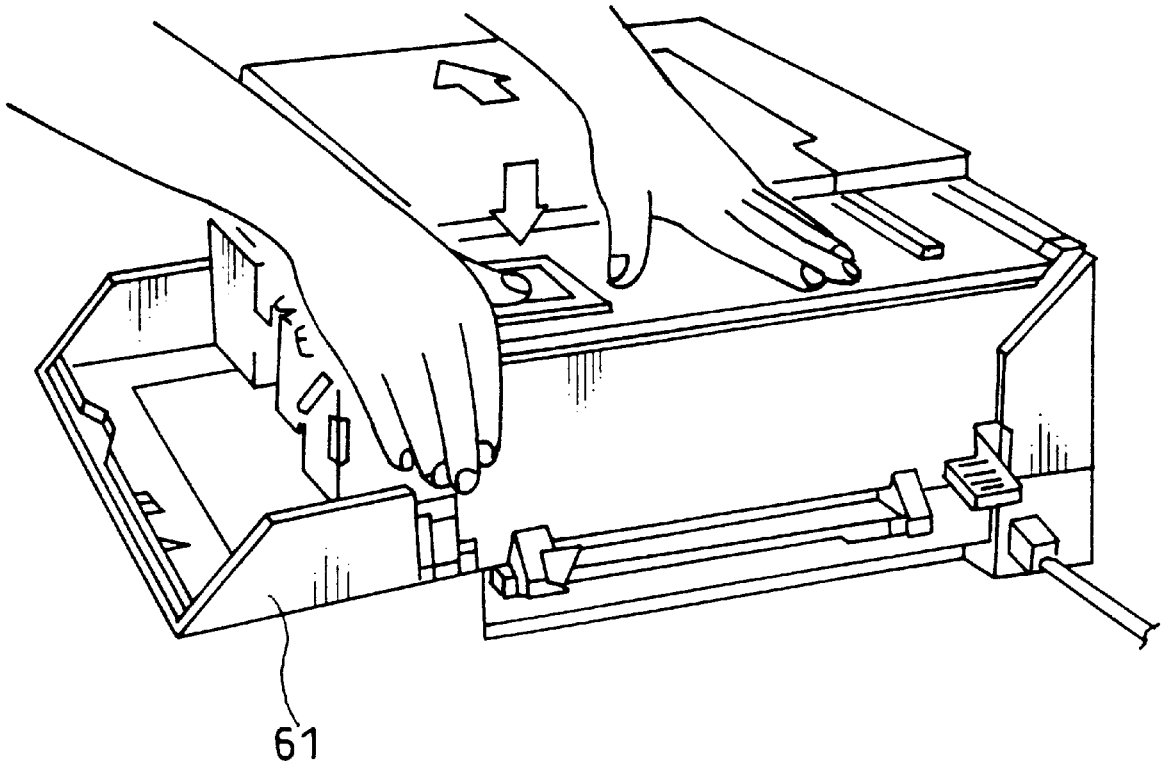
FIG. 30 is an explanatory drawing that shows a first example of an operation for setting a holding member of the flow chart of FIG. 29 in a preparation state.
Figure 31:
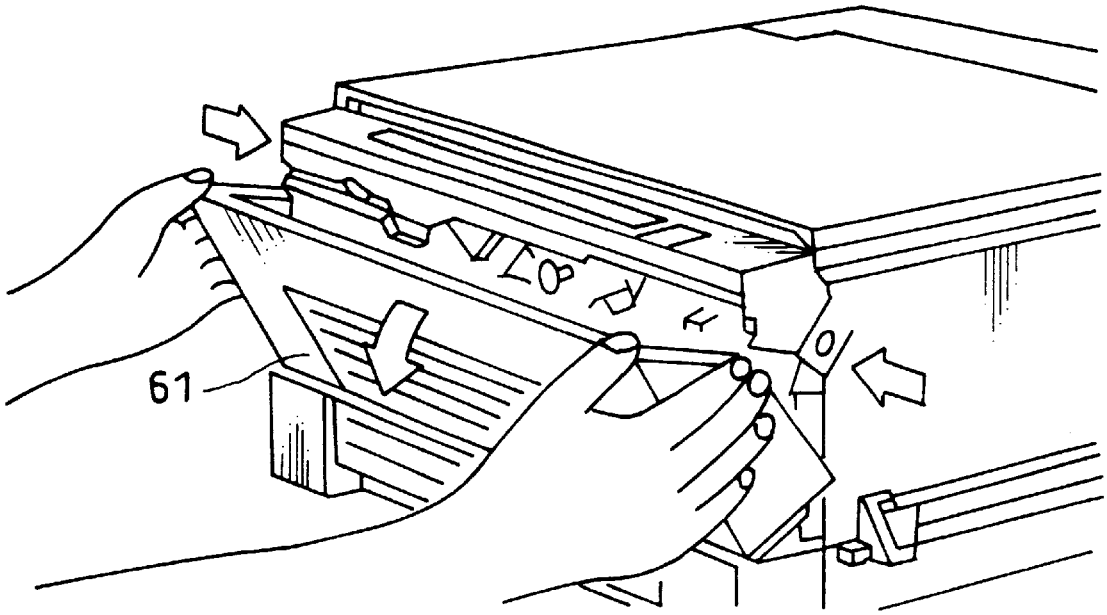
FIG. 31 is an explanatory drawing that shows a second example of the operation for setting a holding member of the flow chart of FIG. 29 in a preparation state.
Figure 32:
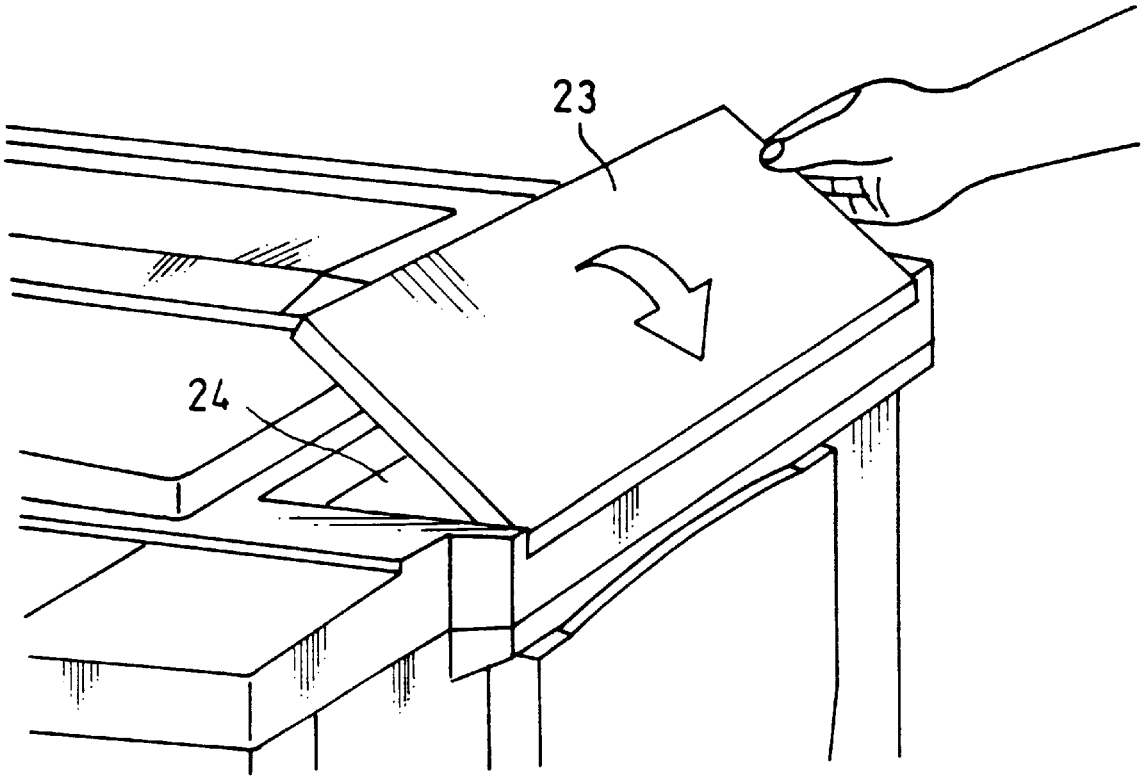
FIG. 32 is an explanatory drawing that shows a third example of the operation for setting a holding member of the flow chart of FIG. 29 in a preparation state.
Figure 33:
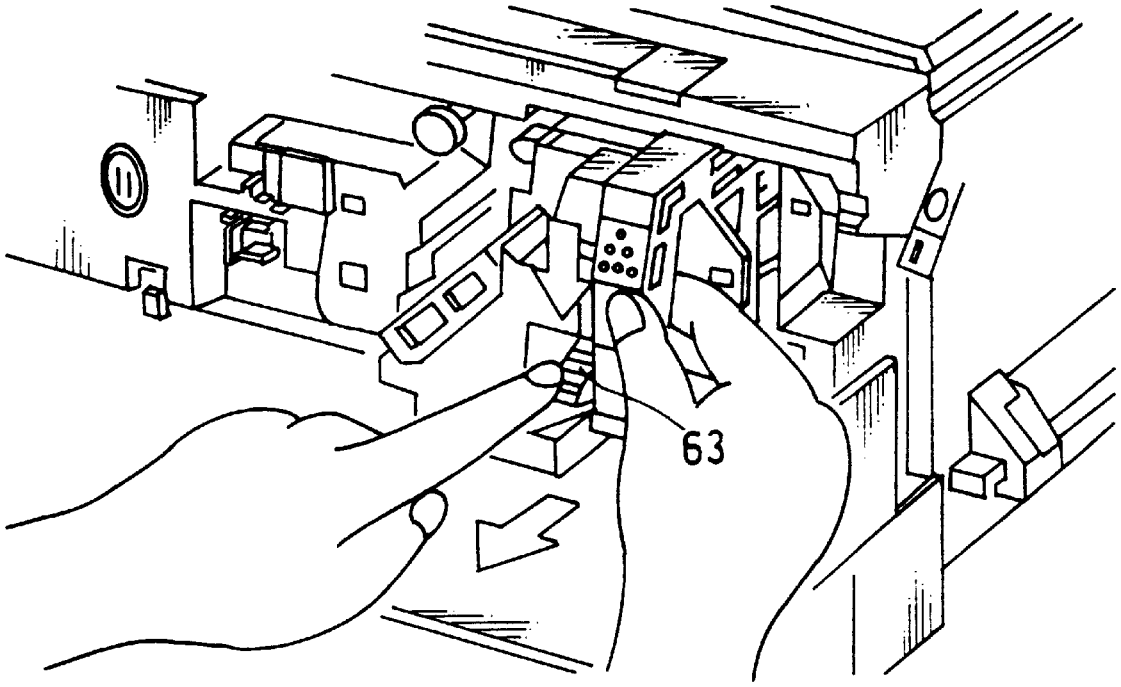
FIG. 33 is an explanatory drawing that shows a fourth example of the operation for setting a holding member of the flow chart of FIG. 29 in a preparation state.
Figure 34:
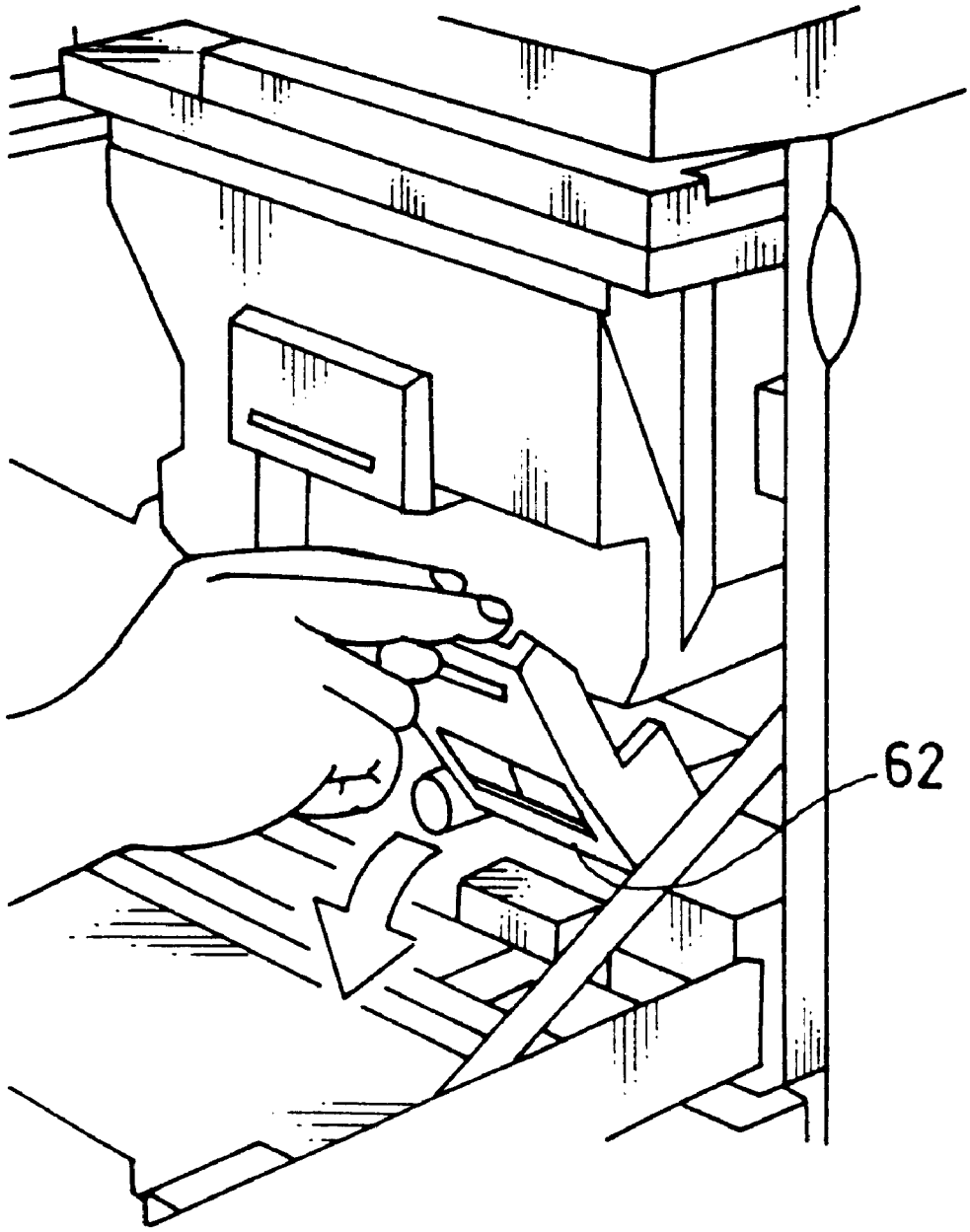
FIG. 34 is an explanatory drawing that shows a fifth example of the operation for setting a holding member of the flow chart of FIG. 29 in a preparation state.
Figure 35:
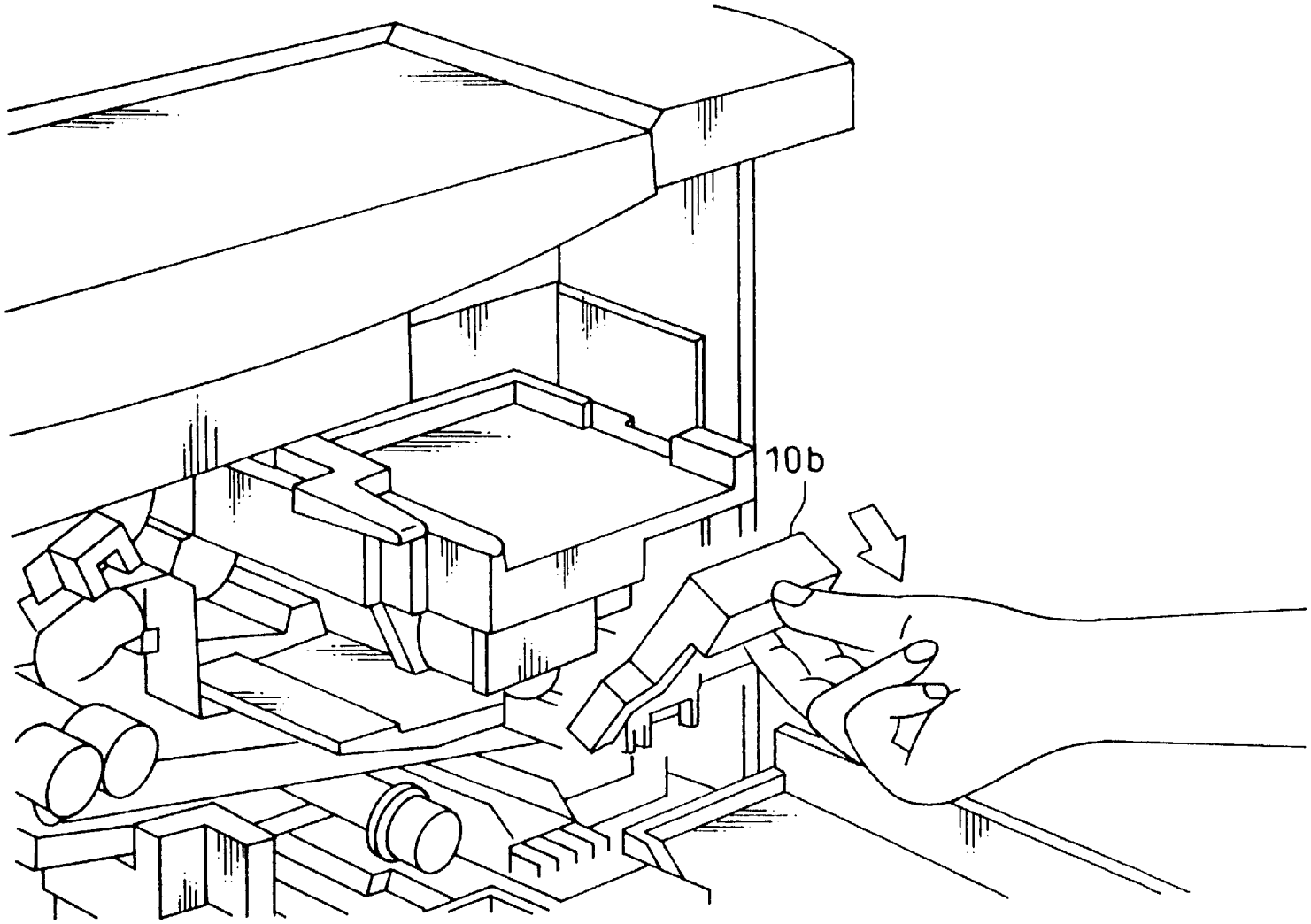
FIG. 35 is an explanatory drawing that shows a sixth example of the operation for setting a holding member of the flow chart of FIG. 29 in a preparation state.
Figure 36:
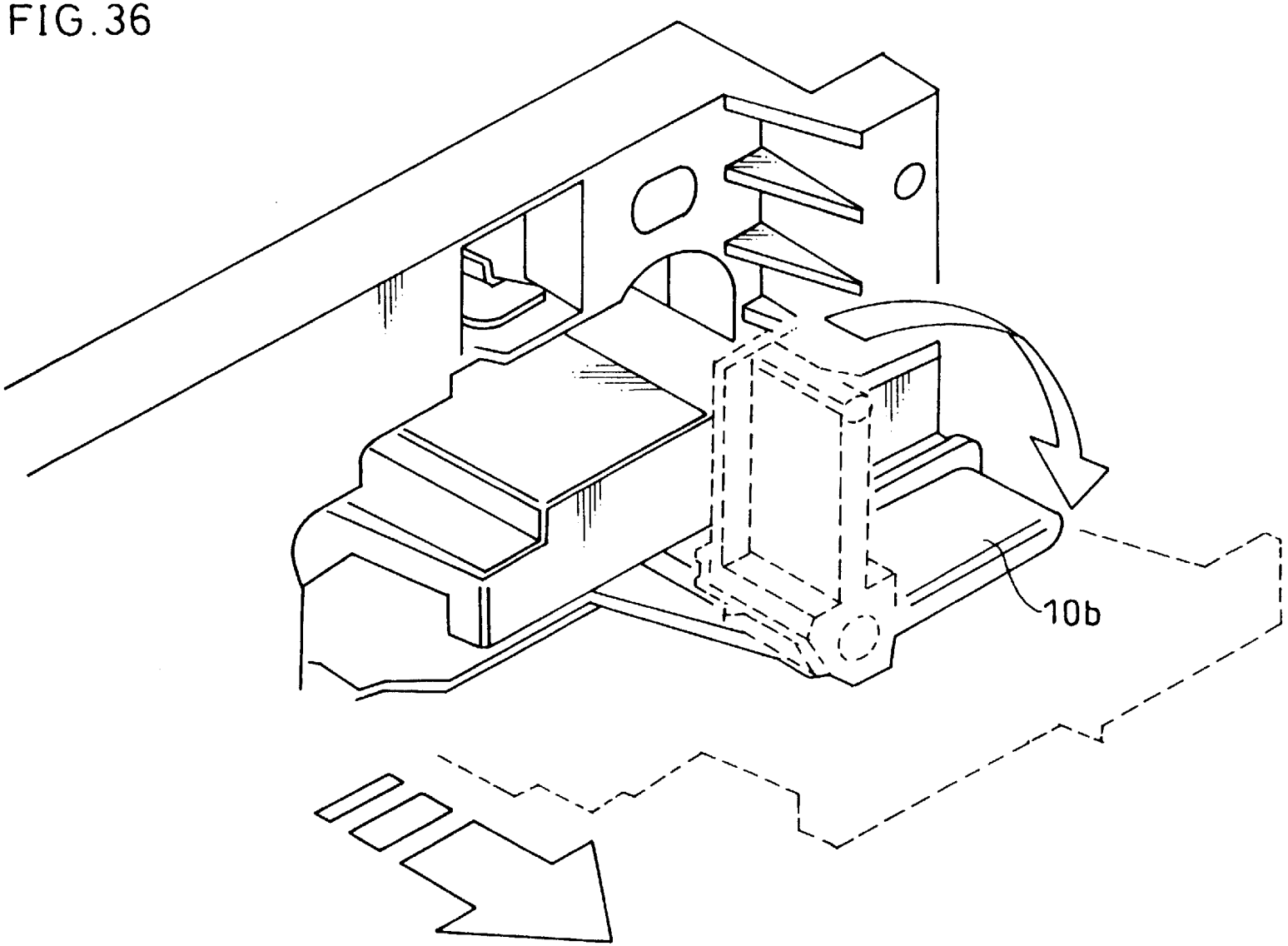
FIG. 36 is an explanatory drawing that shows a seventh example of the operation for setting a holding member of the flow chart of FIG. 29 in a preparation state.
Figure 37:
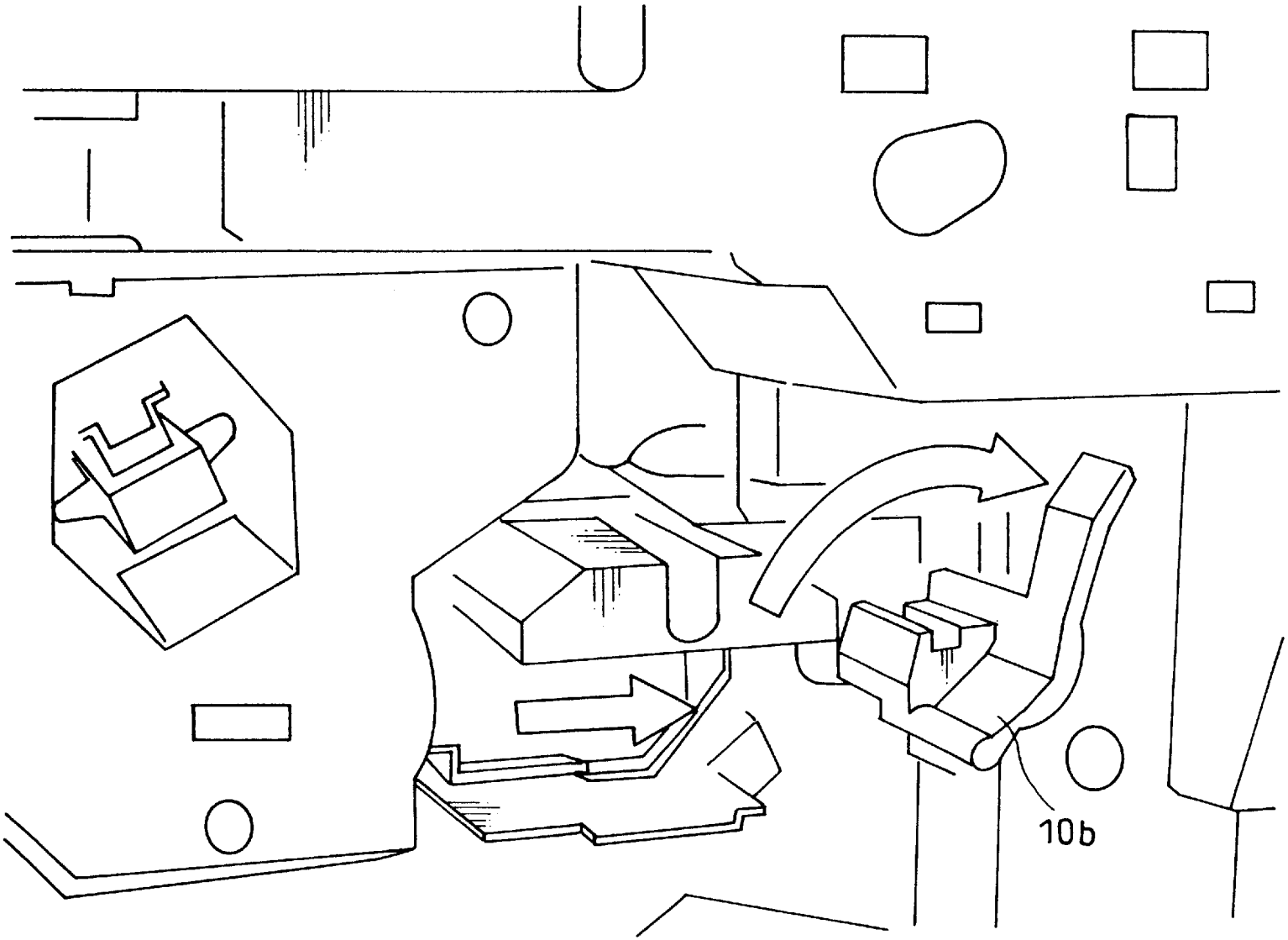
FIG. 37 is an explanatory drawing that shows a eighth example of the operation for setting a holding member of the flow chart of FIG. 29 in a preparation state.

FIG. 29 is a flow chart that shows communication processes where the timing in which an electrical supply is given to the communication device T1 is determined depending on states of the holding member on the copying machine main body side for holding the copying machine unit. Examples of the holding member that is located in the proximity of the predetermined portion of the copying machine main body include a front cover 61 shown in FIG. 30 and FIG. 31, a supply inlet cover 23 for opening and closing the toner supply inlet 24 as shown in FIG. 32, a lock lever 63 as shown in FIG. 33, a toner box lever 62 as shown in FIG. 34, or a developing unit lever 10b as shown in FIG. 35 through FIG. 37.

The electrical supply to the copying machine unit is started at the time when the front cover 61 or the supply inlet cover 23 has been brought from the closed state (normal state) to the open state (preparation state), or at the time when the lock lever 62, the toner box lever 63, or the developing unit lever 10*b* has been brought from the locked state (normal state) to the lock-released state (preparation state). In other words, these members used for positioning the copying machine unit to the predetermined portion are located on an exterior member of the copying machine main body or inside thereof, and simultaneously with the switching action of any one of the holding members from the normal state to the preparation state, the electrical supply is started. Moreover, the electrical supply is completed at the time when, after the completion of the insertion of the copying machine unit, the holding member has returned to the normal state from the preparation state.

An explanation will be given on the flow chart of FIG. 29. At S81, the switching operation of the holding member from the normal state to the preparation state is carried out, and at S82, the insertion of the copying machine unit is started. Then at S83, an electrical supply is started, and at S84, the transmission of individual information is successively started. Here, the sequence may proceed to S83 immediately after S81 in normal processes; however, in this sequence, at S82, a check is made to see if the state switching action has been carried out for the loading operation, thereby making it possible to prevent an unnecessary electrical supply from being started.

Next, when a decision is made at S85 that the insertion has been completed, the result of the decision is displayed on the display 49 at S86, and at S87, processes on the copying machine main body side are allowed to start. Then, at S88, when the holding member is switched from the preparation state to the normal state, the electrical supply is complete at S89, thereby completing the transmission of individual information at S90. In contrast, if, at S85, the insertion has not been completed (NG), the sequence proceeds to S91 where the processes at S84 and S85 are repeated until the number of NGs has reached a predetermined value. When the number of NGs has reached the predetermined value at S91, the sequence proceeds to S92 where a warning indicating the failure in the insertion is displayed on the display section 49, and at S93, a voice warning is given in the warning section 50; then, the sequence proceeds to S89.

As described above, since the communication device T1 of the copying machine unit is allowed to transmit individual information only when the holding member is in the preparation state, the electric waves released from the copying machine unit is reduced to a minimum level required, thereby making it possible to cut costs.

As illustrated in FIG. 4, the communication device T1 may be provided with an operation switch 37 which decides whether or not the electrical supply from the main body side be accepted, and upon turning the operation switch 37 on, the electrical supply is started, and upon turning the operation switch 37 off, the electrical supply is complete. With this arrangement in which the operation switch 37 is turned on only when the communication for individual information is desired between the communication device T1 and the main body side communication device T2, it is possible to prevent erroneous recognition such as unnecessary receipt of new individual information from the copying machine unit made by the main body side communication device T2. Here, the flow chart indicating the communication in this case is obtained by changing S81 to "Operation Switch ON" and S88 to "Operation Switch OFF" in the flow chart of FIG. 29.

Moreover, in another preferred mode, based upon the exchange time necessitating exchange to a new copying machine unit of the same kind, or the replace time necessitating replace to a copying machine unit of a different kind, that has been stored as preliminary information in the RAM 36 of the copying machine unit that has already been inserted, when the time has been reached, the CPU 46 of the main body side communication device T2 is allowed to recognize this fact so as to start an electrical supply to the communication device T1. In still another preferred mode, upon completion of the exchanging job or the replacing job to a new copying machine unit, the CPU 46 is allowed to recognize this fact, and the electrical supply is complete.

With this arrangement, only at the time of maintenance, the copying machine unit is allowed to transmit individual information; therefore, it is possible to avoid unnecessary generation of electric waves.

Figure 38:
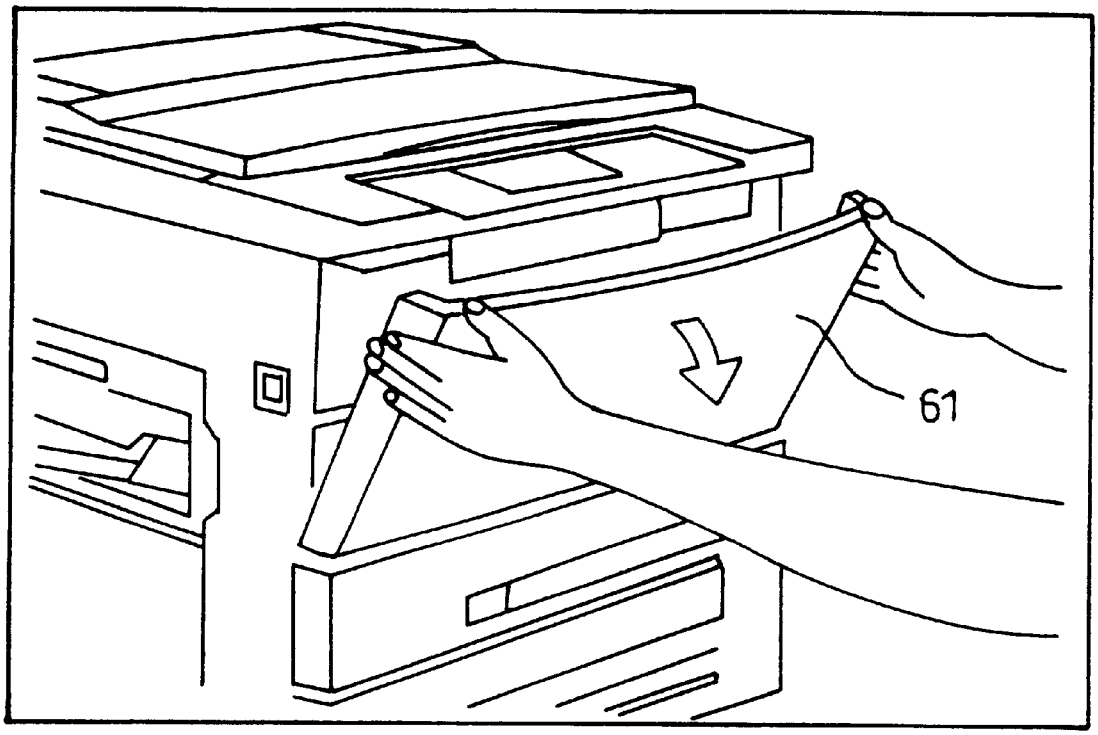
FIG. 38 is an explanatory drawing that shows a first sequence of attaching processes of an image-forming apparatus unit for carrying out display on a display section of the main body side communication device of FIG. 6.
Figure 39:
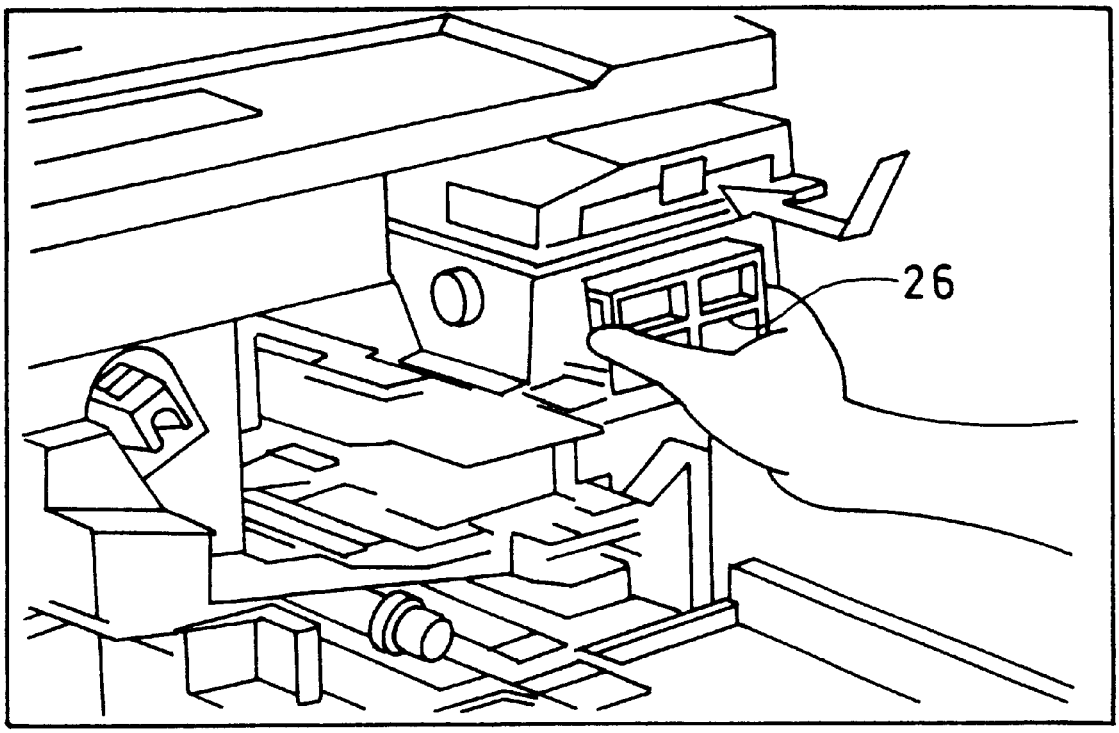
FIG. 39 is an explanatory drawing that shows a second sequence of attaching processes of the image-forming apparatus unit for carrying out display on a display section of the main body side communication device of FIG. 6.
Figure 40:
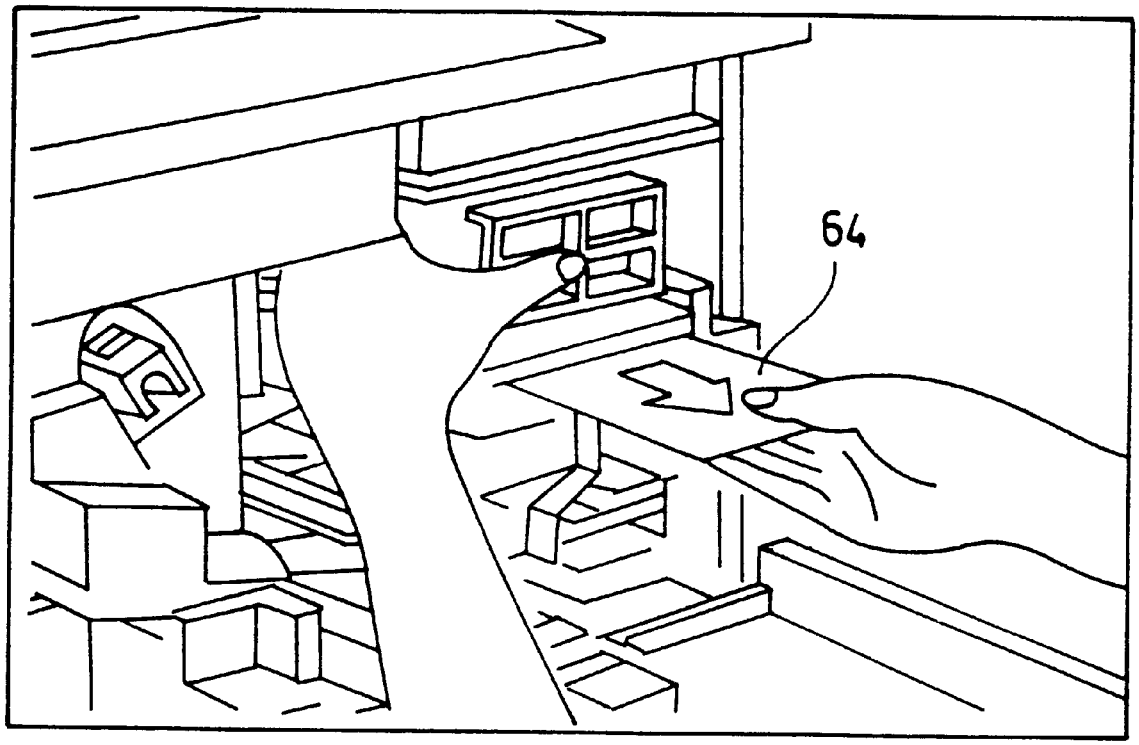
FIG. 40 is an explanatory drawing that shows a third sequence of attaching processes of an image-forming apparatus unit for carrying out display on a display section of the main body side communication device of FIG. 6.
Figure 41:
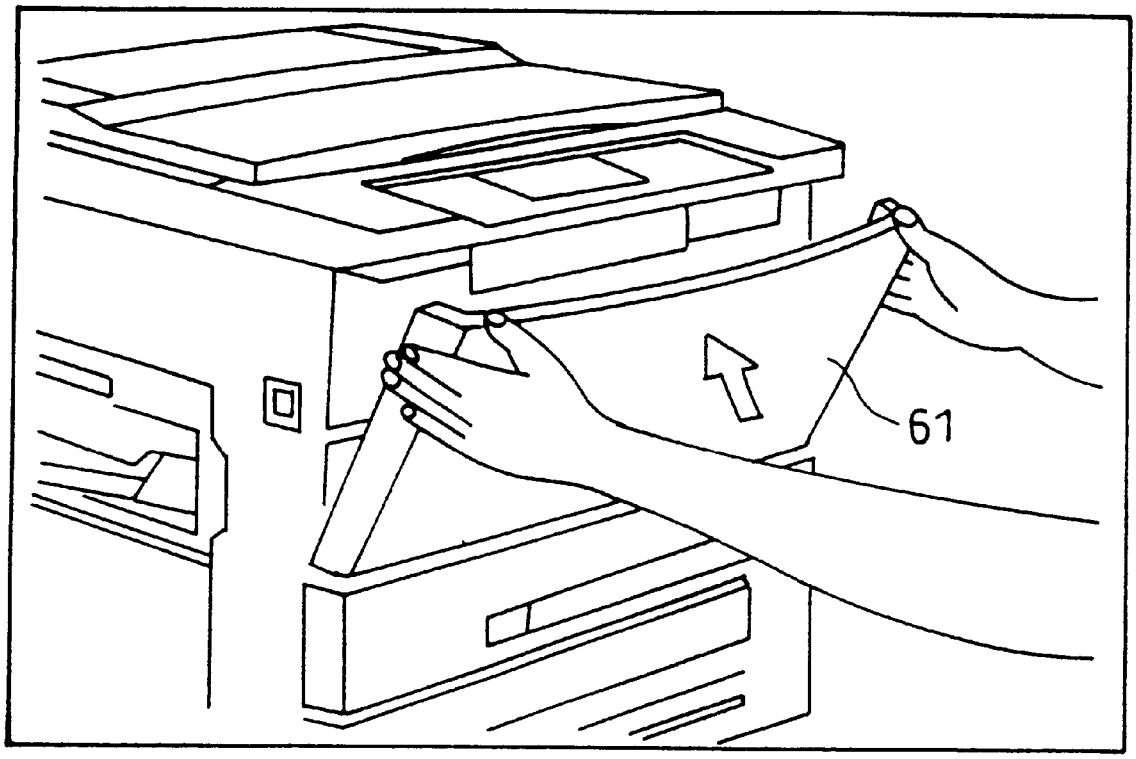
FIG. 41 is an explanatory drawing that shows a fourth sequence of attaching processes of the image-forming apparatus unit for carrying out display on a display section of the main body side communication device of FIG. 6.

In still another preferred mode, upon starting an electrical supply to the communication device T1 as described above, a sequence of insertion processes of the copying machine unit are displayed on the display section 49 of the main body side communication device T2. For example, as illustrated in FIGS. 38 to 41, the sequence of the insertion processes are successively displayed by means of images. Upon start of an electrical supply, the opening operation of the front cover 61 is displayed on the display section as shown in FIG. 38. Upon completion of the opening operation of the front cover 61, the loading operation of the toner cartridge 26 is displayed as illustrated in FIG. 39, and upon completion of this operation, the drawing operation of the toner cartridge 64 is displayed as illustrated in FIG. 40. Upon completion of this operation, the closing operation of the front cover 61 is displayed as illustrated in FIG. 41. The user, who is allowed to see the sequence of the insertion processes displayed as described above, is less susceptible to errors in loading the toner cartridge 26.

Additionally, in the above-mentioned example, the sequence of insertion processes are displayed by means of images; however, the sequence may of course be displayed as explanatory sentences by means of characters. Moreover, in the case when the user erroneously tries to insert a wrong copying machine unit, or in the case when the user is erroneously carrying out an incorrect operation different from the sequence of processes displayed on the display section 49, a warning is given so as to advise the user to correct the operation by the display section 49 and the warning section 50; thus, the contents of countermeasures to be taken in this case are displayed on the display section 49.

Figure 42:
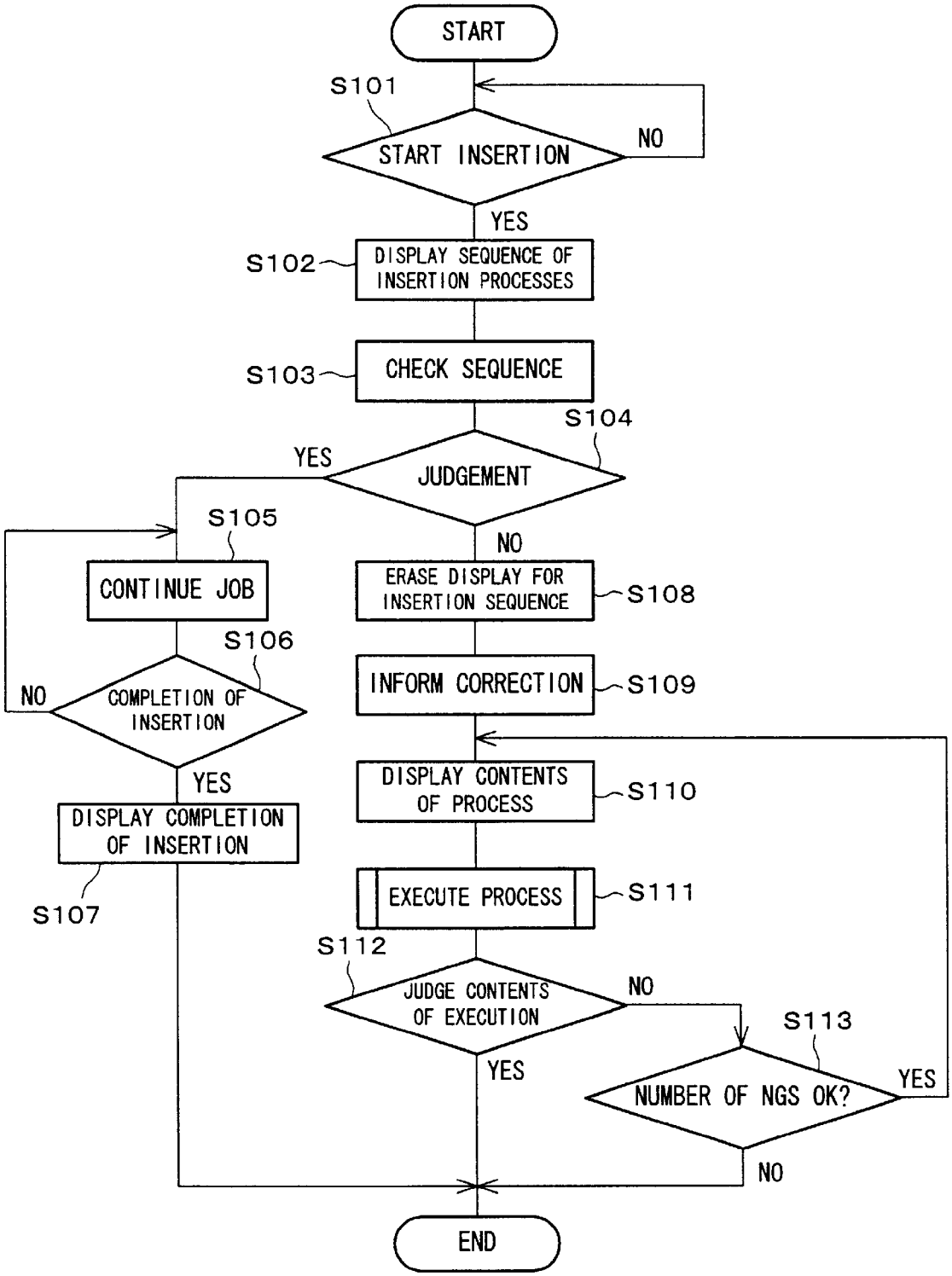
FIG. 42 is a flow chart that explains a sequence of processes for displaying the sequence of the attaching processes shown in FIGS. 38 through 41.
Figure 43:
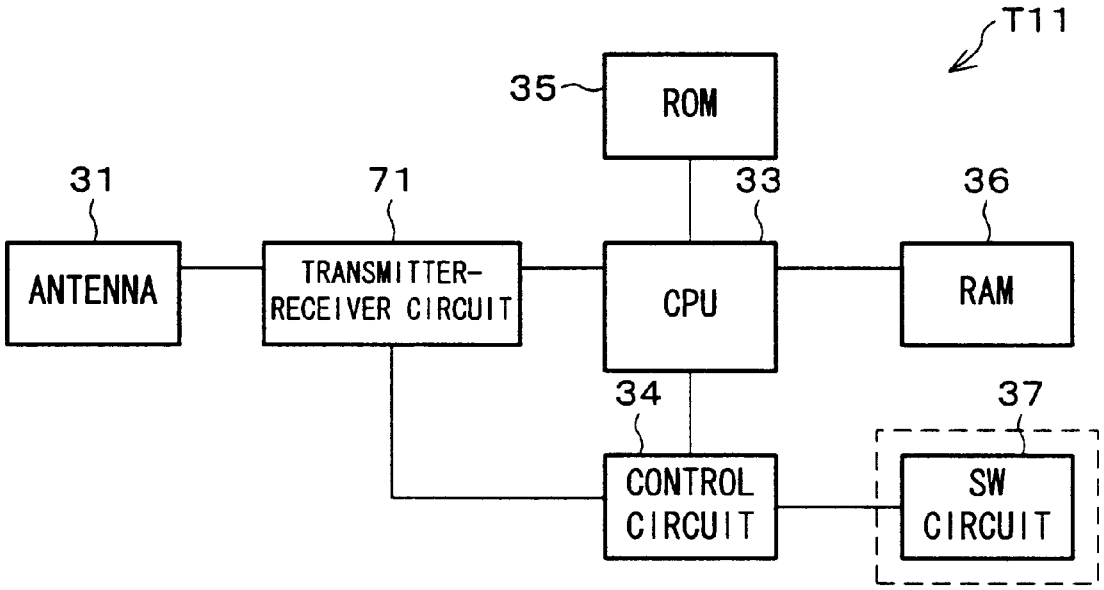
FIG. 43 is a block diagram that shows a construction of a communication device in another embodiment of the image-forming apparatus unit of the present invention.

FIG. 42 is a flow chart that shows the sequence of the above-mentioned processes. When the insertion of a copying machine unit is started at S101, the corresponding sequence of insertion processes are displayed on the display section 49 at S102. At S103, a check is made to see if the sequence of insertion processes being actually carried out by the user is correct, and at S104, if the sequence followed by the user is coincident with the sequence of processes displayed, the sequence proceeds to S105 so as to continue the operations. When the insertion is complete at S106, a display indicating the completion of the insertion is given on the display section 49 at S107, thereby completing the sequence of the processes.

In contrast, at S104, if the sequence followed by the user is not coincident with the sequence of processes displayed, the sequence proceeds to S108, and at S109 a warning is given so as to advise the user to correct the operation by the display section 49 and the warning section 50, and at S110, the contents of countermeasures to be taken thereafter are displayed on the display section 49. At S111, the corrected processes thus displayed are carried out, and at S112, a judgment is made as to whether or not the contents of the executed processes are correct. If the executed processes are correct, the sequence of processes is complete, and if not, the sequence proceeds to S113 where the steps from S110 to S112 are repeated until a predetermined number of NGs have been reached.

[Embodiment 2]

Referring to FIGS. 43 through 46, the following description will discuss another embodiment of an image-forming apparatus unit of the present invention and an image-forming apparatus having such a unit. For convenience of explanation, those of the members described in the first embodiment referring to the Figures thereof are indicated by the same reference numerals and the description thereof is omitted.

Figure 44:
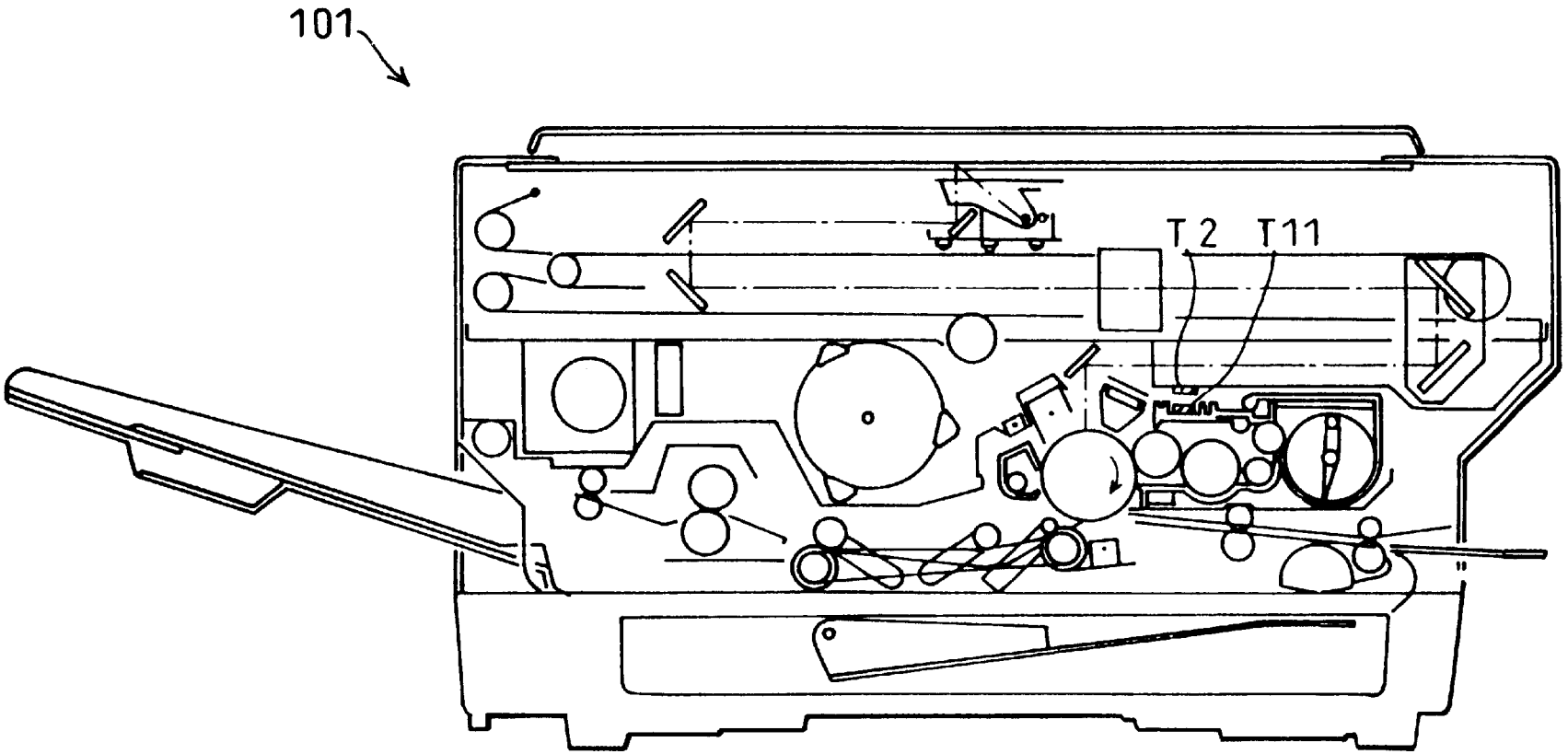
FIG. 44 is a cross-sectional view that shows constructions of an image-forming apparatus unit and an image-forming apparatus in another embodiment.

Different from Embodiment 1, the image-forming apparatus unit (hereinafter, referred to as copying machine unit) is provided with a communication device T11 having a transmitter-receiver circuit (transmitter-receiver means) 71 which can carry out both information transmission and reception, and characterized in that two-way communication is carried out between this and the main body side communication device T2. FIG. 44 shows an example in which this communication device T11 is attached to the developing cartridge 10*a* that is inserted into the developing device 4. The installation position is the same as that of Embodiment 1.

The arrangement of the present embodiment in which the communication device T11 transmits individual information stored in the RAM 36 to the main body side communication device T2 is the same as the above-mentioned arrangement; however, as will be described later, when the transmitter-receiver circuit 71 receives additional information transmitted from the main body side communication device T2, the corresponding individual information is stored in the RAM 36 while being written on demand. Here, the additional information is information that indicates the history of use of the copying machine unit.

Moreover, the image-forming apparatus (hereinafter, referred to as copying machine) 101 of the present embodiment has a main body and a main body side communication device T2 that have respectively the same constructions as those shown FIG. 1 and FIG. 6 of Embodiment 1. However, in a state where the copying machine unit has been inserted in the copying machine main body, the transmitter-receiver circuit 42 of the main body side communication device T2, in its transmission mode, is allowed to transmit information about the history of use of the copying machine unit to the copying machine unit as additional information, and also allowed to transmit to the copying machine unit a request signal for making the copying machine unit diagnose itself on factors, such as the internal state, the loaded state and the working time, as well as for making it inform the results of the diagnosis.

Here, in this transmission mode (transmission operating state), the transmission of the additional information is carried out based upon the intensity of electric waves of the signal level of the transmitter-receiver circuit 42. In other words, the portion in which the copying machine unit has been inserted, that is, the transmission end of the additional information, is allowed to receive the corresponding electric waves having a constant intensity; therefore, by detecting the intensity of the electric waves, the copying machine unit can discriminate and receive the electric waves that has been sent to the portion in which it is inserted. Moreover, when the signal levels are set for the respective kinds of the copying machine units, the copying machine unit can discriminate whether or not the electric waves sent to the insertion portion are for its own use. Therefore, this arrangement makes it possible to select any of the copying machine units from the copying machine main body side.

Moreover, in the case of a reception mode (reception operating state), the transmitter-receiver circuit 42 receives individual information and the results of diagnosis transmitted by the transmitter-receiver circuit 71 of the communication device T11 of the copying machine unit, and these are demodulated by the demodulation circuit 43 and read out. Based upon the individual information thus demodulated, the CPU 46 makes judgments as to the conformity and the suitability of the copying machine unit, and outputs the results of the judgments. Here, the above-mentioned results of diagnosis and judgments are displayed on the display section 49, and if any of the results of diagnosis is improper, or if any erroneous insertion is made, a voice warning is given from the warning section 50.

Figure 45:
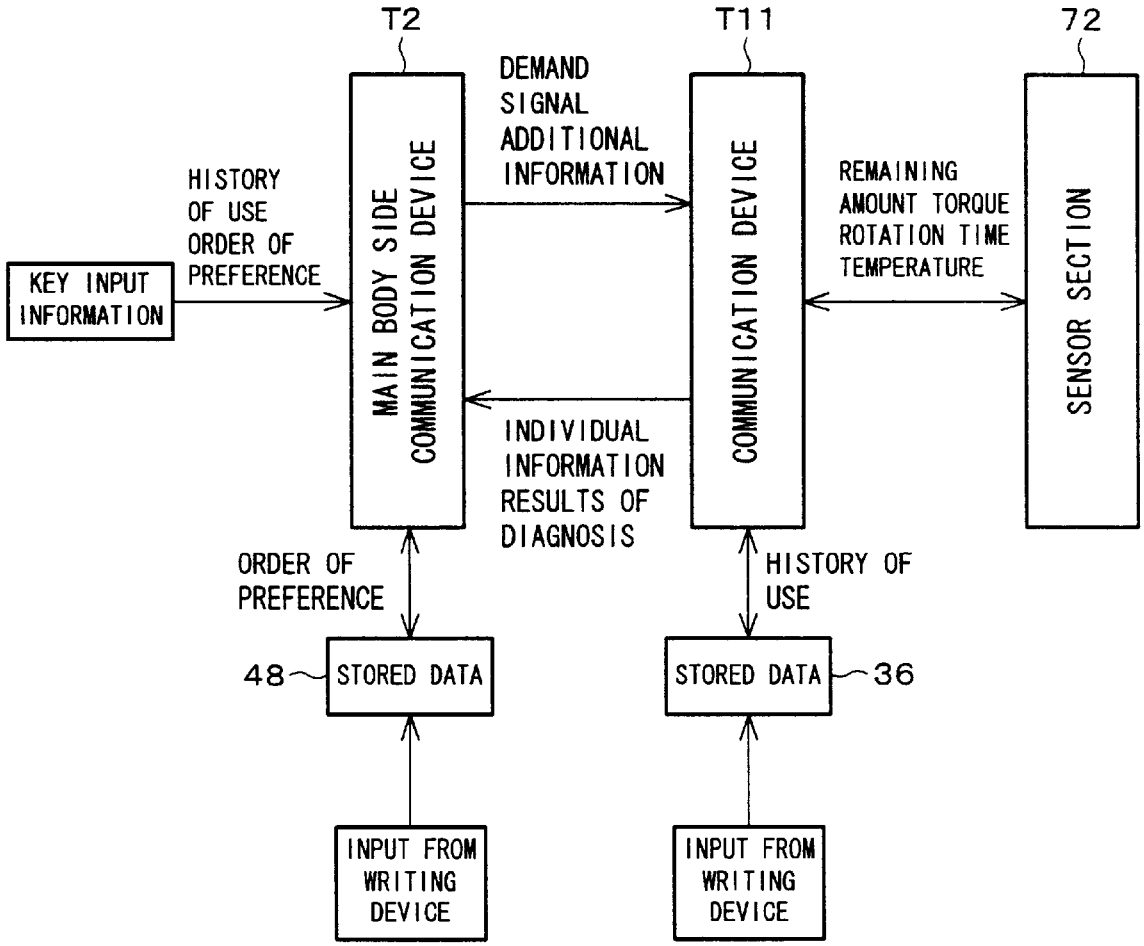
FIG. 45 is an explanatory drawing that shows a communication mode between the communication device of FIG. 43 and the main body side communication device of FIG. 6.

Next, referring to FIG. 45, an explanation will be given of a flow of information between the copying machine main body and the copying machine unit. As illustrated in FIG. 45, two-way communication is carried out between the communication device T11 of the copying machine unit and the main body side communication device T2 of the copying machine main body. Individual information is preliminarily stored in the RAM 36 of the communication device T11 as storage data through inputs by a writing device, and this is transmitted from the transmission device T11 to the main body side communication device T2. Pieces of individual information from various copying machine units are transmitted to the main body side communication device T2; therefore, in accordance with the order of preference in communication that has been preliminarily written in the RAM 48 through key inputs and a writing device, it receives the pieces of individual information as ordered and stores in the RAM 48. In this manner, since the order of preference in communication with the copying machine main body is determined with respect to the kinds of copying machine units, no radio interference occurs even if various pieces of individual information are transmitted to the copying machine main body at the same time from the respective copying machine units.

The main body side communication device T2 transmits the information of history of use of the copying machine unit that has been preliminarily stored in the RAM through key inputs to the communication device T11 as additional information. The additional information thus transmitted is stored in the RAM 36 of the communication device T11, and the previous information in the RAM 36 is updated. Moreover, when the main body side communication device T2 transmits a request signal to the communication device T11, a sensor 72, for example, installed in the copying machine unit, detects factors, such as the remaining quantity of toner, the torque and rotation time of the rotary mechanism and the machine internal temperature, and the communication device T11 diagnoses these factors and replies to the main body side communication device T2.

As described above, the copying machine main body carries out a two-way data communication with the copying machine unit in a non-contact state. Therefore, in addition to the effects of Embodiment 1, the copying machine main body is allowed to transmit desired information that it owns to the copying machine unit as addition information, and for example, in the case when this additional information is given as information related to the history of the copying machine unit, useful information such as recycle information can be stored in the RAM 36 of the copying machine unit. In other words, the RAM 36 of the copying machine unit is allowed to prevent erroneous insertions and also to store the history data, by using only one chip.

Next, an explanation will be given of a sequence of communication processes between the copying machine unit and the copying machine main body having the above-mentioned constructions.

Figure 46:
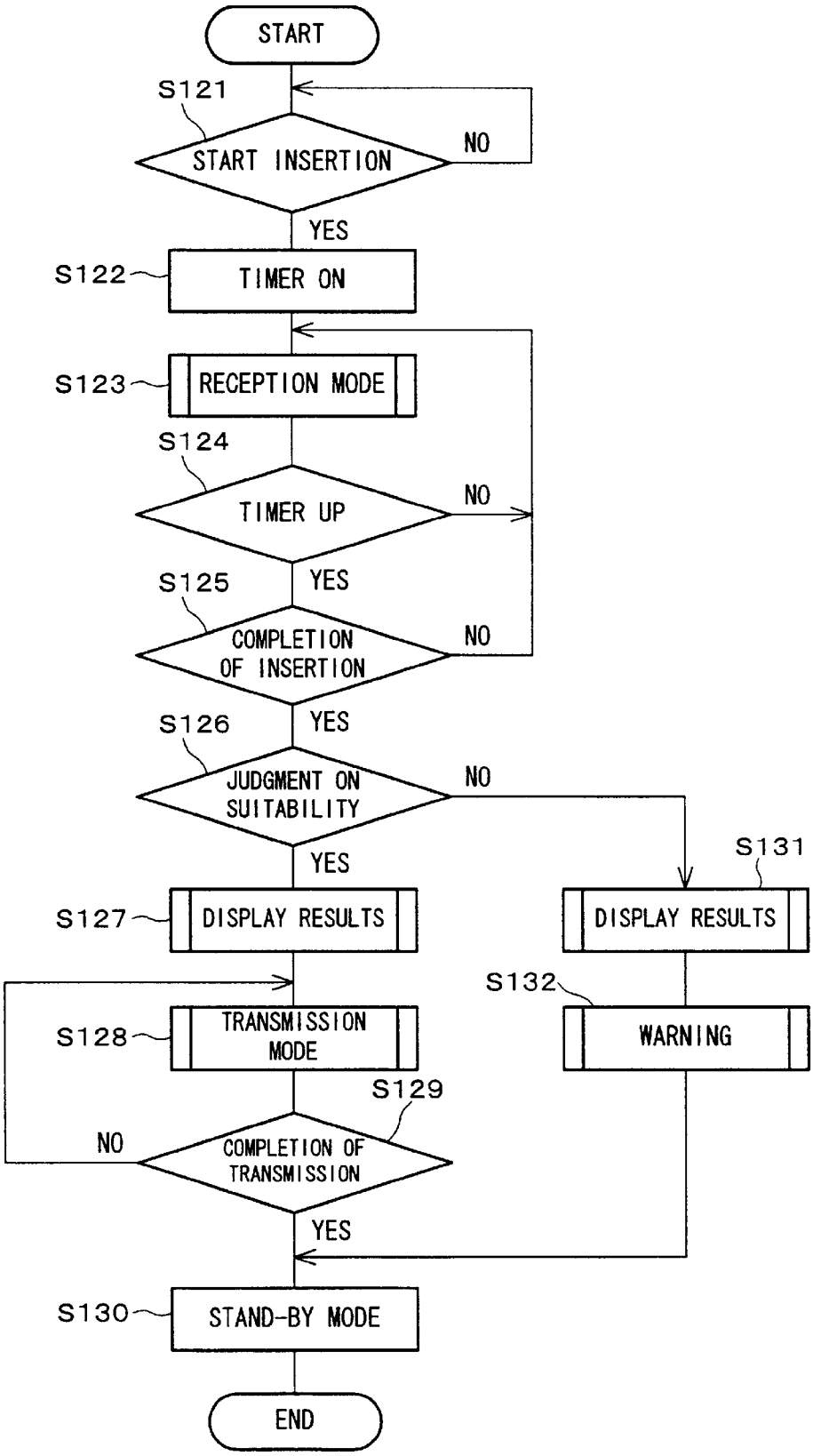
FIG. 46 is a flow chart that shows one example of a sequence of communication processes between the communication device of FIG. 43 and the main body side communication device of FIG. 6.

FIG. 46 is a flow chart that shows the communication when the copying machine and the copying machine unit having the above-mentioned constructions are used. At S121, as the insertion of the copying machine unit is started, the detection circuit 45 detects this action, and by supplying electric waves, an electrical supply is given from the transmitter-receiver circuit 42 of the main body side communication device T2 to the communication device T11 of the copying machine unit so that at S122, the timer in the copying machine main body is actuated, and at S123, the main body side communication device T2 is set to a reception mode. Here, the start of the insertion is the same operation described in Embodiment 1. Since the communication device T11 allows the transmitter-receiver circuit 71 to transmit individual information read out from the RAM 36, and the main body side communication device T2 allows the transmitter-receiver circuit 42 to receive this information.

Thereafter, when a predetermined time has elapsed at S124 (the timer is up), a judgment is made at S125 as to whether or not the insertion has been complete. Here, the completion of the insertion is the same operation as that described in Embodiment 1.

After the individual information has been demodulated in the demodulation circuit, the CPU 46 refers to information stored in the RAM 48 at S126, and makes a judgment as to whether or not the individual information conforms to and/or is suitable for this information. If it conforms to and/or is suitable for the information, the sequence proceeds to S127 and displays the corresponding results of the judgment on the display section 49, and following this process, at S128, the main body side communication device T2 is set to a transmission mode. Thus, the main body side communication device T2 transmits the information of history of use of the copying machine unit that has been inserted to the reception and transmission device 71 of the copying machine unit as additional information. Upon completion of the transmission of the additional information at S129, the sequence proceeds to a stand-by mode at S130.

In contrast, if the CPU 49 makes a judgment that the individual information does not conform to and/or is not suitable for the information, the sequence proceeds to S131 where the corresponding results of the judgment is displayed on the display section 49, and at S132, a warning, such as, for example, lighting up of a warning lamp, is further given by the warning section 50. Then, the sequence proceeds to the stand-by mode at S130.

[Embodiment 3]

Figure 47:
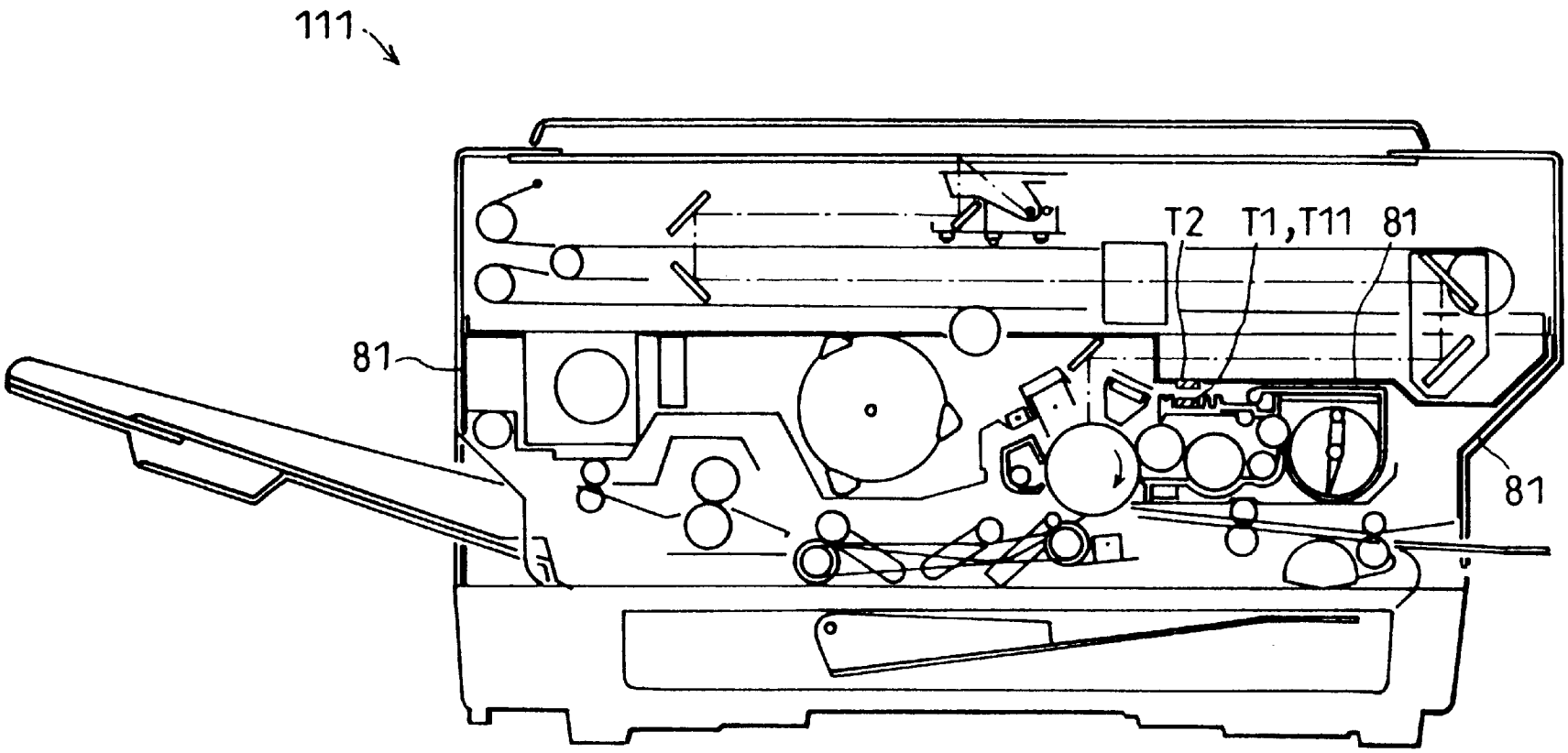
FIG. 47 is a cross-sectional view that shows constructions of an image-forming apparatus unit and an image-forming apparatus in still another embodiment.

Referring to FIG. 47, the following description will discuss still another embodiment of an image-forming apparatus unit of the present invention and an image-forming apparatus having such a unit. For convenience of explanation, those of the members described in the first and second embodiments referring to the Figures thereof are indicated by the same reference numerals and the description thereof is omitted.

FIG. 47 shows a copying machine unit serving as an image-forming apparatus unit and a copying machine 111 serving as an image-forming apparatus of the present invention. The copying machine unit is the same developing cartridge 10*a* as described in Embodiments 1 and 2, and the developing cartridge 10*a* is provided with the communication device T1 or the communication device T11. The following description will exemplifies a case in which the communication device T1 is installed. Moreover, in addition to the construction of the copying machine main body as described in Embodiment 1, the copying machine main body is provided with an electric-wave shielding member (directivity applying means) 81.

The electric-wave shielding member 81 is made of a material, such as copper and ferrite, and as illustrated in FIG.

47, this is affixed onto the upper face and side face frames of the image-forming section 3 of the copying machine main body so that electric waves, transmitted and received between the communication device T1 of the developing cartridge 10*a* and the main body side communication device T2 of the copying machine main body, are made free from leakage outside the machine as effectively as possible.

The electric-wave shielding member 81 formed on the upper face of the image-forming section 3 prevents electric waves radiated from the communication device T1 from leaking upward from the copying machine main body. The electric-wave shielding member 81 formed on the side faces regulates electric waves radiated from the communication device T1 from proceeding in the horizontal directions. In this manner, by applying a directivity to the electric waves, it becomes possible to send the electric waves effectively to the target place, and also to reduce the generation of the electric waves to a minimum. Moreover, it is possible to prevent the electric waves from giving adverse effects on the human body as well as adverse effects, such as maloperation due to noise, on the other peripheral equipment.

Moreover, in FIG. 47, since the communication device T1 is placed virtually in the center of the copying machine main body, it is possible to reduce, in particular, unnecessary radiation to the other equipment. Furthermore, the main body side communication device T2 is also placed virtually in the center of the copying machine; therefore, in the case when a plurality of copying machines are aligned side by side, it is possible to prevent interference from occurring between electric waves sent and received between copying machines in question and electric waves sent and received between the neighboring copying machines.

The image-forming apparatus unit of the present invention, which is detachably attached to a predetermined portion of the main body of an image-forming apparatus for forming an image on a recording material, and carries out an image-forming process, is provided with a storage means for storing individual information that is information related to the unit itself, a communication means which, upon receipt of an electrical supply, transmits the individual information to a main body side communication means installed in the main body of the image-forming apparatus by means of electric waves, wherein, following the loading operation to the predetermined portion, the individual information, stored in the storage means, is transmitted to the main body side communication means by the communication means.

In the above-mentioned invention, the image-forming apparatus unit has the communication means, and the communication means transmits the individual information that is related to the unit itself and stored in the storage means to the main body side communication means installed in the main body of the image-forming apparatus by means of radio waves. Based upon the individual information thus received, the image-forming apparatus makes a judgment as to whether or not the image-forming apparatus unit that is currently being inserted is an appropriate one, and since only one main body side communication means needs to be installed, and since, different from the conventional system, bar code readers need not be installed for the individual toner supply sections, it becomes possible to reduce costs.

Moreover, since the communication is carried out by radio waves, no adverse effect is given to the communication even if the image-forming apparatus units and/or the image-forming apparatus are contaminated by toner, etc., and since the communication is automatically started at the time of attaching any of the copying machine units to the copying machine main body, no complex operation is required for carrying out the communication.

Furthermore, since the communication is made in a non-contact state, limitations in an installation method, which have been imposed on the conventional construction of an electric circuit between the image-forming apparatus unit and the image-forming apparatus main body, are no longer required, thereby improving the degree of freedom in designing the installation mode. The resulting simple construction of the image-forming apparatus reduces a space required and the resulting elimination of terminals (connectors) makes it possible to improve the durability.

Therefore, it is possible to provide an image-forming apparatus unit which can prevent an erroneous insertion to the image-forming apparatus main body by using an inexpensive method with high reliability.

The image-forming apparatus unit of the present invention is at least one unit selected from the group consisting of a photoreceptor unit, a photoreceptor exposure unit, a developer supplying container, a developing cartridge, a photoreceptor charging unit, a photoreceptor static eliminating unit, a photoreceptor cleaning unit, a document reading optical unit, and a fixing unit, which are used in the above-mentioned image-forming apparatus of the electrophotographic system.

In the above-mentioned invention, any one of the parts, such as a photoreceptor unit, a photoreceptor exposure unit, a developer supplying container, a developing cartridge, a photoreceptor charging unit, a photoreceptor static eliminating unit, a photoreceptor cleaning unit, a document reading optical unit, and a fixing unit, which are used in the above-mentioned image-forming apparatus of the electrophotographic system, is adopted as the image-formation apparatus unit.

Therefore, since the communication of the individual information is carried out in association with the kinds of such image-forming apparatus units, it is possible to easily identify these units upon loading them in the image-forming apparatus of the electrophotographic system.

The image-forming apparatus of the present invention is further provided with: the above-mentioned image-forming apparatus unit, a detection means for detecting the loading operation of the image-forming apparatus unit; a reception means for receiving the individual information transmitted from the communication means of the image-forming apparatus unit upon detection of the loading operation of the image-forming apparatus unit by the detection means; a reading means for demodulating and reading the individual information received by the reception means; a judgment means for making a judgment as to conformity indicating whether or not the position to which the image-forming apparatus unit has been attached conforms to a predetermined position suggested by the contents of the individual information read by the reading means and as to suitability indicating whether or not the image-forming apparatus unit attached to the predetermined position is an appropriate one; and at least either a display means for displaying the results of the judgment by the judgment means or a warning means for giving a warning based upon the results thereof.

In accordance with the above-mentioned invention, in the image-forming apparatus, when the insertion of the image-forming apparatus unit is started, the detection means detects this action, and individual information, transmitted from the communication means of the image-forming apparatus unit, is received by the reception means, and demodulated and read by the reading means. Next, the judgment means makes a judgment as to conformity indicating whether or not the position to which the image-forming apparatus unit has been attached conforms to a predetermined position and as to suitability indicating whether or not the image-forming apparatus unit attached to the predetermined position is an appropriate one. Then, the results of the judgment are displayed by the display means, or based upon the results, a warning is given by the warning means.

Therefore, this arrangement allows the user to easily confirm the suitability of an image-forming apparatus unit that is being attached, thereby making it possible to prevent the image-forming apparatus unit from being erroneously attached to the image-forming apparatus.

In the image-forming apparatus of the present invention, the storage means may store additional information that is new information externally added as the individual information, and the communication means is provided with: the above-mentioned image-forming apparatus unit having a communication means which, upon receipt of an electric supply, transmits the individual information to a main body side communication means installed in the main body of the image-forming apparatus by means of electric waves, and which is capable of receiving the additional information; a detection means for detecting the loading operation of the image-forming apparatus unit; a transmitter-receiver means which, upon detection of the loading operation of the image-forming apparatus unit by the detection means, receives the individual information transmitted from the communication means of the image-forming apparatus unit, and transmits the additional information to the communication means of the image-forming apparatus unit; a reading means for demodulating and reading the individual information received by the reception means; a judgment means for making a judgment as to conformity indicating whether or not the position to which the image-forming apparatus unit has been attached conforms to a predetermined position suggested by the contents of the individual information read by the reading means and as to suitability indicating whether or not the image-forming apparatus unit attached to the predetermined position is an appropriate one; and at least either a display means for displaying the results of the judgment by the judgment means and a warning means for giving a warning based upon the results thereof.

In accordance with the above-mentioned invention, the image-forming apparatus unit allows the communication means to receive desired information as additional information and to store it in the storage means. Then, in the image-forming apparatus, when the insertion of the image-forming apparatus unit is started, the detection means detects this action, and individual information, transmitted from the communication means of the image-forming apparatus unit, is received by the reception means, and demodulated and read by the reading means. Next, the judgment means makes a judgment as to conformity indicating whether or not the position to which the image-forming apparatus unit has been attached conforms to a predetermined position and as to suitability indicating whether or not the image-forming apparatus unit attached to the predetermined position is an appropriate one. Then, the results of the judgment are displayed by the display means, or based upon the results, a warning is given by the warning means.

Therefore, this arrangement allows the user to easily confirm the suitability of an image-forming apparatus unit that is being attached, thereby making it possible to prevent the image-forming apparatus unit from being erroneously attached to the image-forming apparatus.

Moreover, since the transmitter-receiver means can transmit the additional information to the image-forming apparatus unit, the individual information of the image-forming apparatus unit is updated to an appropriate information from the image-forming apparatus side. Therefore, for example, in the case when the additional information is given as information related to the history of use of the image-forming apparatus unit, useful information such as recycle information can be stored in the storage means of the copying machine unit. In other words, the storage means of the image-forming apparatus unit is allowed to prevent erroneous insertions and also to store the history data, by using only one chip.

The image-forming apparatus of the present invention may have an arrangement in which: the transmission of the individual information by the communication means of the image-forming apparatus unit is started simultaneously with a predetermined operation indicating the start of the insertion of the image-forming apparatus unit to the predetermined portion, and the operations such as, the reception of the individual information, the demodulation and reading operations of the received individual information, the judgment as to the conformity and suitability based upon the individual information thus read, and the display and warning of the results of the judgment, are completed prior to a predetermined operation indicating the completion of the insertion of the image-forming apparatus unit to the predetermined portion.

In accordance with the above-mentioned invention, during a period between the operation indicating the start of the insertion of the image-forming apparatus unit to the predetermined portion and the operation indicating the completion of the insertion thereto, that is, for example, during a period in which the front cabinet is opened in the case of a copying machine, the communication with the image-forming apparatus main body and the corresponding processes on the main body side are completed. Therefore, before an image-forming apparatus unit has been inserted to the image-forming apparatus main body, the display of the results of the judgment and the warning are given, thereby making it possible to prevent an erroneous insertion beforehand.

In the above-mentioned image-forming apparatus of the present invention, the transmission of the individual information by the communication means of the image-forming apparatus unit may be started upon detection of the image-forming apparatus unit approaching the main body on the way to the predetermined portion.

In the above-mentioned invention, the detection means detects the image-forming apparatus unit even when it is only approaching the predetermined portion of the image-forming apparatus main body, and in response to the detection, the communication means of the image-forming apparatus unit starts transmitting the individual information. Therefore, for example, even if an image-forming apparatus unit is in a packaged state, it is possible to determine whether or not this is a suitable image-forming apparatus unit even before unpackaging it by bringing this closer to the predetermined portion, and for example, in the case of a toner cartridge, it is possible to give a display or a warning as to whether this contains a proper toner or a different toner with respect to the predetermined portion.

In the above-mentioned image-forming apparatus of the present invention, the transmission of the individual information by the communication means of the image-forming apparatus unit may be started in response to an operation indicating the completion of the insertion of the image-forming apparatus unit to the predetermined portion.

In accordance with the above-mentioned invention, the communication device of the image-forming apparatus unit transmits individual information after completion of the insertion of the image-forming apparatus unit to the predetermined portion so that it is possible to confirm the completion of the loading operation. Moreover, since the individual information is not transmitted if the insertion operation has not been completely finished, it is possible to prevent incomplete operations.

The image-forming apparatus of the present invention may have an arrangement in which: a state switchover can be made between a normal state where the image-forming apparatus unit is housed at a predetermined position of the main body and a preparation state where the image-forming apparatus unit is attachably detached, and a holding member for holding the image-forming apparatus unit is provided. In this arrangement, the transmission of the individual information by the communication means of the image-forming apparatus unit is started in response to the state switchover from the normal state of the holding member to the preparation state thereof, followed by an loading operation of the image-forming apparatus unit to the predetermined portion, and is completed in response to the state switchover from the preparation state of the holding member to the normal state of the holding member.

In the above-mentioned invention, since the communication device of the image-forming apparatus unit is allowed to transmit individual information only when the holding member is in the preparation state, the electric waves released from the copying machine unit is reduced to a minimum level required, thereby making it possible to cut costs.

The above-mentioned image-forming apparatus of the present invention may have an arrangement in which: based upon the exchange time necessitating exchange to a new image-forming apparatus unit of the same kind or the replace time necessitating replace to an image-forming apparatus unit of a different kind, that has been stored as preliminary information in the storage device of the image-forming apparatus unit that has already been inserted, when the time has been reached, the transmission of the individual information by the communication means of the image-forming apparatus unit is allowed to start, and upon completion of the exchanging job or the replacing job to a new image-forming apparatus unit, the transmission thereof is completed.

In accordance with the above-mentioned invention, the storage means stores the exchange time necessitating exchange of the image-forming apparatus unit to a new image-forming apparatus unit of the same kind or the replace time necessitating the image-forming apparatus unit to a different image-forming apparatus unit as the individual information. Upon detection of the fact that the image-forming apparatus unit that has inserted to the main body of the image-forming apparatus has reached the exchange time or the replace time, the image-forming apparatus is allowed to accept the transmission of individual information from a new image-forming apparatus unit.

Then, upon detection of the completion of the exchanging job or the replacing job to the new image-forming apparatus unit, the transmission of the individual information from the new image-forming apparatus unit is terminated.

Therefore, since only at the time of maintenance such as the exchanging job or the replacing job, the image-forming apparatus unit is allowed to transmit individual information, it is possible to avoid unnecessary generation of electric waves.

The above-mentioned image-forming apparatus of the present invention may have the following arrangement: When, based upon the order that the transmitter-receiver means has transmitted to the communication means of the image-forming apparatus unit, the transmitter-receiver means receives the results of the diagnosis that the image-forming apparatus unit has diagnosed itself and sent as individual information, at least either the display means displays the results of the diagnosis or the warning means gives a warning as to the results of the diagnosis.

In accordance with the above-mentioned invention, the transmitter-receiver means of the image-forming apparatus gives a request to the communication means of the image-forming apparatus unit so as to make the image-forming apparatus unit diagnose itself as to factors, such as the internal conditions such as the internal temperature, the load condition, and the working time of the image-forming apparatus unit, and upon receipt of such a request, the image-forming apparatus unit transmits the results of the diagnosis to the transmitter-receiver means of the image-forming apparatus as individual information. When the image-forming apparatus receives the individual information, it displays the results of the diagnosis or gives a warning as to the results of the diagnosis.

Therefore, each time the request is given from the image-forming apparatus side, it is possible to confirm whether or not the information such as the history of use of an image-forming apparatus unit for use in exchange is suitable for the image-forming apparatus.

The above-mentioned image-forming apparatus of the present invention may have an arrangement in which: in the case when the detection means detects the loading operation of the image-forming apparatus unit, after the operation state of the transmitter-receiver means has been maintained at a reception state for receiving the individual information for a predetermined time, based upon the results of the judgment as to the conformity and suitability made by the judgment means on the image-forming apparatus unit that has been inserted, the operation state of the transmitter-receiver means is switched to a transmission state for transmitting the additional information to the image-forming apparatus unit.

In accordance with the above-mentioned invention, upon detection of the loading operation of an image-forming apparatus unit, the image-forming apparatus becomes the reception state so as to receive the individual information, and after a lapse of a predetermined time, is automatically switched to the transmission state so as to transmit to the image-forming apparatus unit the additional information based upon the results of the judgement as to the conformity and suitability. Therefore, the image-forming apparatus unit is allowed to receive suitable additional information depending on situations.

The above-mentioned image-forming apparatus of the present invention is preferably provided with a directivity applying means for applying directivity to the progressing direction of the electric waves.

In accordance with the above-mentioned invention, since the directivity is applied to the electric waves, it becomes possible to efficiently send the electric waves to the target position, and also to reduce the generation of the electric waves to a minimum.

The above-mentioned image-forming apparatus may have an arrangement in which the main body side communication means is installed virtually in the center of the main body.

In the above-mentioned invention, the main body side communication device is placed virtually in the center of the copying machine main body; therefore, in the case when a plurality of copying machines are aligned side by side, it is possible to prevent interference from occurring between electric waves sent and received between copying machines in question and electric waves sent and received between the neighboring copying machines.

The above-mentioned image-forming apparatus of the present invention may have an arrangement in which the image-forming apparatus unit is attached virtually to the center of the main body of the image-forming apparatus.

In accordance with the above-mentioned invention, since the image-forming apparatus unit is attached virtually to the center of the main body of the image-forming apparatus, the communication means of the image-forming apparatus unit is located virtually in the center thereof; therefore, it is possible to reduce unnecessary radiation of electric waves to the other equipment, and consequently to prevent malfunctions of the other equipment.

The above-mentioned image-forming apparatus of the present invention may have an arrangement in which the main body side communication means is attached to a movable portion that is shifted in a departing manner from the main body following the loading operation of the image-forming apparatus unit.

In accordance with the above-mentioned invention, since the image-forming apparatus unit is attached to the movable portion that is shifted in a manner so as to be separated from the main body following the operation of attaching the image-forming apparatus unit to a predetermined position of the main body; therefore, the communication is carried out with the movable portion being separated from the main body so that the communication with the image-forming apparatus unit is carried out at a position sufficiently apart from the main body frame made of metal, thereby making it possible to ensure a stable transmission state of electric waves.

[Embodiment 4]

Figure 48:
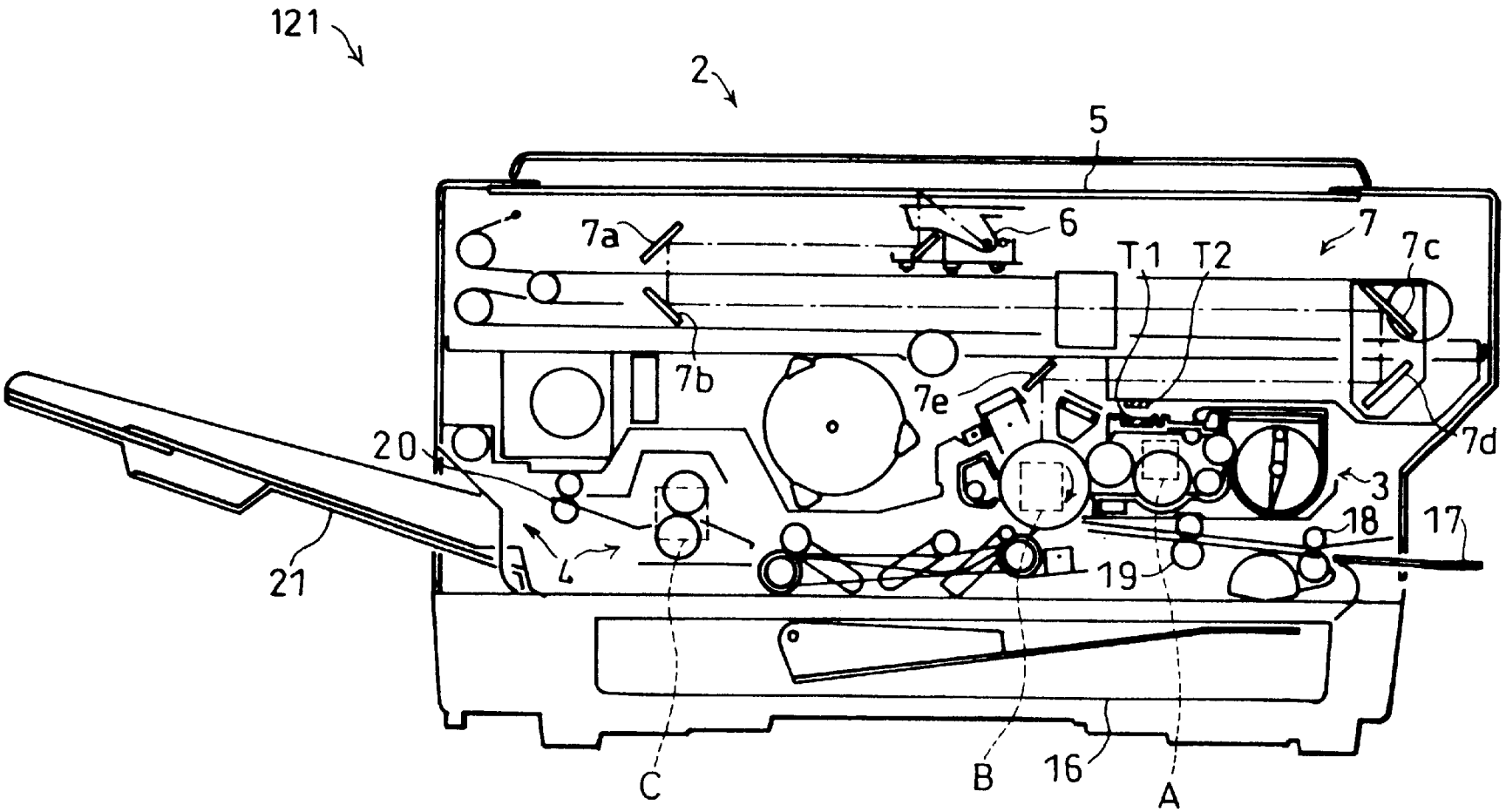
FIG. 48 is a block diagram that shows a construction of a communication device in another embodiment of the image-forming apparatus unit of the present invention.
Figure 49:
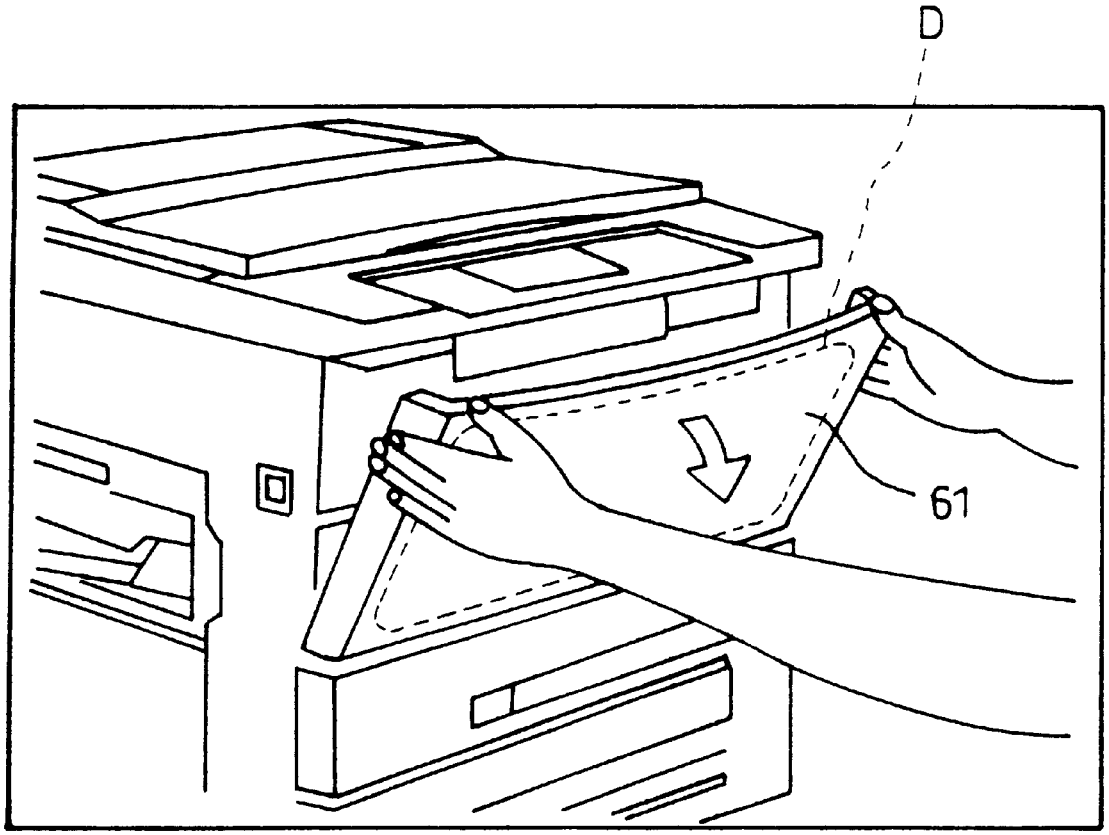
FIG. 49 is an explanatory drawing that shows a loop-shaped antenna installed in the image-forming apparatus of FIG. 48.

Referring to FIGS. 48 and 49, the following description will discuss still another embodiment of an image-forming apparatus unit of the present invention and an image-forming apparatus having such a unit. For convenience of explanation, those of the members described in the first through third embodiments referring to the Figures thereof are indicated by the same reference numerals and the description thereof is omitted.

FIG. 48 shows copying machine units serving as image-forming apparatus units and a copying machine 121 serving as an image-forming apparatus of the present embodiment. The copying machine units are the developing unit 10, photoreceptor unit 8 and the fixing unit 14, as described in Embodiment 1, and these units are provided with the aforementioned communication device T1 or communication device T11. The following description will exemplifies a case in which the communication device T1 is installed.

As illustrated in FIG. 48, a developing unit communication device the developing unit communication device A, the photoreceptor unit communication device B and the fixing unit communication device C.

Here, on the inside face of the front cover 61 shown in FIG. 49, an antenna (loop antenna) D having a loop shape, indicated by a dashed line in the Figure, is installed. This enables communications between the main body side communication device T2 and the communication devices T1 that are attached to the respective units located at a plurality of different positions.

In the copying machine 121 using the above-mentioned loop antenna D, when communications are made between a number of communication devices T1 installed in a number of units and one main body side communication device T2, the following arrangement is proposed so as to prevent radio interference.

First, specific codes are respectively assigned to the developing unit communication device A, the photoreceptor unit communication device B and the fixing unit communication device C. For example, code "1" is assigned to the developing unit communication device A, code "2", to the photoreceptor unit communication device B, and code "3", to the fixing unit communication device C.

The above-mentioned specific codes are contained in data that the main body side communication device T2 transmits, and at the time of starting a communication, the communication device T1 on the unit side is allowed to return a response signal to the main body side communication device T2 only when the specific code assigned to the unit in question is included in the data. With this arrangement, even when communications are made between a number of communication devices T1 and one main body side communication device T2, each of the units can carry out a communication on one-to-one basis with the main body side communication device T2 without causing radio interference. Therefore, since only one main body side communication device T2 is required with respect to a plurality of communication devices T1, it is possible to cut costs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image-forming apparatus unit, which is detachably attached to a predetermined portion of the main body of an image-forming apparatus, comprising:

communication means which transmits individual information that is information related to the unit itself to a main body side communication means installed in the main body of the image-forming apparatus by means of electric waves, following a loading operation of the image-forming apparatus unit to the predetermined portion, wherein the transmission by the communication means is started in response to an operation indicating the completion of the loading of the image-forming apparatus unit to the predetermined portion.

2. The image-forming apparatus unit as defined in claim 1, further comprising:

storage means for storing the individual information.

3. The image-forming apparatus unit as defined in claim 2, wherein said storage means is a ferroelectric memory.

4. The image-forming apparatus unit as defined in claim 1, wherein the communication means carries out a two-way communication with the main body side communication means.

5. The image-forming apparatus unit as defined in claim 1, further comprising:

an operation switch for starting and completing an electrical supply used for transmission by the communication means.

6. An image-forming apparatus unit, which is detachably attached to a predetermined portion of the main body of an image-forming apparatus for forming an image on a recording material, and carries out an image-forming process, comprising:

storage means for storing individual information that is information related to the unit itself; and communication means which, upon receipt of an electrical supply, transmits the individual information to a main body side communication means installed in the main body of the image-forming apparatus by means of electric waves, wherein, following a loading operation to the predetermined portion, the individual information, stored in the storage means, is transmitted to the main body side communication means by said communication means.

7. The image-forming apparatus unit as defined in claim 6, which is at least one unit selected from the group consisting of a photoreceptor unit, a photoreceptor exposure unit, a developer supplying container, a developing cartridge, a photoreceptor charging unit, a photoreceptor static eliminating unit, a photoreceptor cleaning unit, a document reading optical unit, and a fixing unit, which are used in the image-forming apparatus of an electrophotographic system.

8. An image-forming apparatus comprising:

a predetermined portion to which an image-forming apparatus unit for carrying out an image-forming process is detachably attached;

detection means for detecting a loading operation of the image-forming apparatus unit;

main body side communication means which, upon detection by the detection means, receives individual information that is information related to the image-forming apparatus unit itself by means of electric waves; and judgment means which makes a judgment on the individual information based upon a preselected standard, and outputs the results of the judgment.

9. The image-forming apparatus as defined in claim 8, wherein said judgment means makes a judgment on conformity indicating whether or not a position to which the image-forming apparatus unit has been attached conforms to an appropriate position of the image-forming apparatus based upon an intensity of an electric wave received by the main body side communication means.

10. The image-forming apparatus as defined in claim 8, wherein said judgment means makes a judgment on suitably indicating whether or not the image-forming apparatus unit attached to the predetermined portion is an appropriate one based upon a level of a signal released from the image-forming apparatus unit to the image forming apparatus.

11. The image-forming apparatus as defined in claim 8, wherein, upon detection made by the detection means, an electric wave is supplied from the main body side communication means to a communication means of the image-forming apparatus unit so that an electrical supply is given to the communication means.

12. The image-forming apparatus as defined in claim 8, wherein communication between a communication means of the image-forming apparatus unit and the main body side communication means is started and completed in response to the start and completion of an electric wave supply for giving an electrical supply from the main body side communication means to the communication means.

13. The image-forming apparatus as defined in claim 8, further comprising:

at least one means selected from the group consisting of: reading means for demodulating and reading the individual information, a display means for displaying the results of the judgment outputted from the judgment means and a warning means for giving a waning based upon the results of the judgment.

14. The image-forming apparatus as defined in claim 8, wherein the main body side communication means starts to communicate with the image-forming apparatus unit in response to detection of the loading operation by the detection means through an electric wave.

15. The image-forming apparatus as defined in claim 8, wherein the loading operation is a start of the insertion of the image-forming apparatus unit to the image-forming apparatus.

16. The image-forming apparatus as defined in claim 8, wherein the loading operation is an approach of the image-forming apparatus unit to the image-forming apparatus.

17. The image-forming apparatus as defined in claim 8, wherein said detection means includes a proximity circuit for detecting the fact that the image-forming apparatus unit is located within a predetermined distance from the predetermined portion.

18. The image-forming apparatus as defined in claim 8, wherein the loading operation is a completion of the insertion of the image-forming apparatus unit to the predetermined portion of the image-forming apparatus.

19. The image-forming apparatus as defined in claim 8, wherein said detection means detects an acceleration exerted when the image-forming apparatus unit is shifted toward the image-forming apparatus.

20. The image-forming apparatus as defined in claim 8, wherein:

the image-forming apparatus further includes a holding member for placing the image-forming apparatus unit at the predetermined portion of the image-forming apparatus, and the main body side communication means starts the communication in response to a switching operation of the holding member from a normal state to a preparation state.

21. The image-forming apparatus as defined in claim 8, further comprising:

display means for displaying a sequence of processes for loading the image-forming apparatus unit.

22. The image-forming apparatus as defined in claim 8, wherein the main body side communication means transmits individual information related to the main body of the image-forming apparatus itself or to the image-forming apparatus unit to the image-forming apparatus unit as additional information.

23. The image-forming apparatus as defined in claim 22, wherein the image-forming apparatus unit includes:

updating means for updating the individual information by the additional information.

24. The image-forming apparatus as defined in claim 22, wherein the additional information is information indicating history of use of the image-forming apparatus unit.

25. The image-forming apparatus as defined in claim 8, further comprising:

directivity applying means for applying directivity to the electric wave.

26. The image-forming apparatus as defined in claim 8, wherein the main body side communication means is attached to a movable portion that is moved when the image-forming apparatus unit is inserted into the predetermined portion main body of the image-forming apparatus.

27. The image-forming apparatus as defined in claim 8, further comprising:

main body side control means for making a judgment as to the time for exchange based upon the time for exchange contained in individual information preliminarily stored in the image-forming apparatus unit, and for controlling the main body side communication means so as to start the corresponding communication.

28. The image-forming apparatus as defined in claim 8, further comprising:

storage means for storing a rank order of preference in communications that indicates the order of receptions of individual information.

29. The image-forming apparatus as defined in claim 8, wherein the main body side communication means comprises a loop-shaped antenna installed on an externally attached member to the main body of the image forming apparatus or the inside thereof.

30. The image-forming apparatus as defined in claim 29, wherein:

data that the main body side communication means transmits to the image-forming apparatus unit includes a specific code that is assigned to the image-forming apparatus unit, and the main body side communication means is allowed to receive a response signal including the individual information only from the image-forming apparatus unit to which the specific code has been assigned.

31. An image-forming apparatus comprising:

an image-forming apparatus unit related to an image-forming process;

detection means for detecting a loading operation of the image-forming apparatus unit;

reception means for receiving individual information related to the image-forming apparatus unit itself transmitted from a communication means of the image-forming apparatus unit upon detection of the loading operation of the image-forming apparatus unit by the detection means;

reading means for demodulating and reading the individual information received by the reception means;

judgment means for making a judgment as to conformity indicating whether or not a portion to which the image-forming apparatus unit has been attached conforms to a predetermined portion suggested by the contents of the individual information read by the reading means and so as to suitably indicating whether or not the image-forming apparatus unit attached to the predetermined portion is an appropriate one; and at least either a display means for displaying the judgment by the judgment means, or a warning means for giving a warning based on the results thereof.

32. The image-forming apparatus as defined in claim 31, wherein: the transmission of the individual information by the communication means of the image-forming apparatus unit is started simultaneously with a predetermined operation indicating the start of the insertion of the image-forming apparatus unit to the predetermined portion, and the operations such as, the reception of the individual information, the demodulation and reading operations of the received individual information, the judgment as to the conformity and suitability based upon the individual information thus read, and the display and warning of the results of the judgment, are completed prior to a predetermined operation indicating the completion of the insertion of the image-forming apparatus unit to the predetermined portion.

33. The image-forming apparatus as defined in claim 31, wherein the transmission of the individual information by the communication means of the image-forming apparatus unit is started upon detection of the image-forming apparatus unit approaching the main body on the way to the predetermined portion.

34. The image-forming apparatus as defined in claim 31, wherein the transmission of the individual information by the communication means of the image-forming apparatus unit is started in response to an operation indicating the completion of the insertion of the image-forming apparatus unit to the predetermined portion.

35. The image-forming apparatus as defined in claim 31 wherein:

a holding member, which makes a switchover between a normal state where the image-forming apparatus unit is housed at a predetermined position of the main body and a preparation state where the image-forming apparatus unit is attachably detached, and holds the image-forming apparatus unit, is provided, wherein: the transmission of individual information by the communication means of the image-forming apparatus unit being started in response to the state switchover from the normal state of the holding member to the preparation state thereof, followed by a loading operation of the image forming apparatus unit to the predetermined portion, and is completed in response to the state switchover from the preparation state of the holding member to the normal state of the holding member.

36. The image-forming apparatus as defined in claim 31, further comprising:

directivity applying means for applying directivity to a progressing direction of electric waves.

37. The image-forming apparatus as defined in claim 31, wherein the image-forming apparatus unit is attached virtually to the center of the main body of the image-forming apparatus.

38. An image-forming apparatus comprising:

an image-forming apparatus unit having storage means and communication means, said storage means storing (a) individual information related to the image-forming apparatus itself and (b) additional information externally added as a part of the individual information, said communication means transmitting the individual information, upon the receipt of an electric supply, to a main body side communication means installed in the main body of the image-forming apparatus by means of electric waves, said communication means being capable of receiving the additional information;

detection means for detecting a loading operation of the image-forming apparatus unit;

transmitter-receiver means which, upon detection of the loading operation of the image-forming apparatus unit by the detection means, receives the individual information transmitted from the communication means of the image-forming apparatus unit, and transmits the additional information to the communication means of the image-forming apparatus unit;

reading means for demodulating and reading the individual information received by the transmitter-receiver means, a judgment means for making a judgment as to conformity indicating whether or not a portion to which the image-forming apparatus unit has been attached conforms to a predetermined portion suggested by the contents of the individual information read by the reading means and so as to suitability indicate whether or not the image-forming apparatus unit attached to the predetermined portion is an appropriate one; and at least either a display means for displaying the results of the judgment by the judgment means and a warning means for giving a warning based upon the results thereof.

39. The image-forming apparatus as defined in claim 38, wherein:

when an exchange time or a replace time, stored as preliminary information in the storage means of the image-forming apparatus unit that has already been inserted, has been reached, the transmission of the individual information by the communication means of the image-forming apparatus unit is allowed to start, and upon completion of the exchange job or the replacing job to a new image-forming apparatus unit, the transmission thereof is completed.

40. The image-forming apparatus as defined in claim 38, wherein:

when, based upon an order of the transmitter-receiver means has transmitted to the communication means has transmitted to the image-forming apparatus unit, the transmitter-receiver means receives results of a diagnosis that the image-forming apparatus unit has diagnosed itself and sent as individual information, at least either the display means displays the results of the diagnosis or the warning means gives a warning as to the results of the diagnosis.

41. The image-forming apparatus as defined in claim 38, wherein:

in the case when the detection means detects the loading operation of the image-forming apparatus unit, after the operation state of the transmitter-receiver means has been maintained at a reception state for receiving the individual information for a predetermined time, based upon the results of the judgment as to the conformity and suitability made by the judgment means on the image-forming apparatus unit that has been inserted, the operation state of the transmitter-receiver means is switched to a transmission state for transmitting the additional information to the image-forming apparatus unit.

42. The image-forming apparatus as defined in claim 38, wherein the main body side communication means is installed virtually in the center of the main body of the image-forming apparatus.

43. The image-forming apparatus as defined in claim 38, wherein the main body side communication means is attached to a movable portion that is shifted in a departing manner from the main body of the image-forming apparatus following the loading operation of the image-forming apparatus unit.

44. The image-forming apparatus as defined in claim 43, wherein the main body side communication means is arranged so that, with the movable portion being located farthest from the main body of the image-forming apparatus, an antenna of the communication means is allowed to come closest to an antenna of the main body side communication means.

* * * * *